US012616865B2

(12) United States Patent
Zwiren et al.

(10) Patent No.: US 12,616,865 B2
(45) Date of Patent: May 5, 2026

(54) VARIABLE RESISTANCE WALKING DEVICE WITH DEDICATED FOOT ANCHOR AND ERGONOMIC NETWORK INTERFACE HANDLE

(71) Applicant: MY WORLD OF WALKING, INC., Wilmington, DE (US)

(72) Inventors: Janelle Zwiren, Philadelphia, PA (US); Matthew Paprocki, Ojai, CA (US)

(73) Assignee: MY WORLD OF WALKING, INC., Wilmington, DE (US)

( * ) Notice: Subject to any disclaimer, the term of this patent is extended or adjusted under 35 U.S.C. 154(b) by 144 days.

(21) Appl. No.: 18/622,876

(22) Filed: Mar. 30, 2024

(65) Prior Publication Data

US 2024/0325812 A1 Oct. 3, 2024

Related U.S. Application Data

(60) Provisional application No. 63/456,079, filed on Mar. 31, 2023.

(51) Int. Cl.
*A63B 21/00* (2006.01)
*A63B 21/04* (2006.01)
(Continued)

(52) U.S. Cl.
CPC .. *A63B 21/00185* (2013.01); *A63B 21/00061* (2013.01); *A63B 21/0442* (2013.01);
(Continued)

(58) Field of Classification Search
CPC ..... A63B 21/00185; A63B 21/00061; A63B 21/0442; A63B 21/0552; A63B 21/4015;
(Continued)

(56) References Cited

U.S. PATENT DOCUMENTS 843,478 A * 2/1907 Muller ..... A63B 21/0552 482/124
866,495 A * 9/1907 Marks ..... A63B 21/02 482/124

(Continued)

OTHER PUBLICATIONS

United Kingdom Design No. 6 185 895, Certificate of Registration for a UK Design (Jan. 12, 2022).

*Primary Examiner* — Andrew S Lo
(74) *Attorney, Agent, or Firm* — Volpe Koenig

(57) ABSTRACT

A device for variable resistance walking with the capability to measure user exercise metrics, including a user's oxygen consumption, is provided, comprising a pair of elastomeric resistance elements configured to provide a variable resistance and having a foot anchor at a first end and a modular handle at a second end. The modular handles may each include at least one sensor and a network interface in communication with at least one sensor and at least one website via a network. In addition, the device may feature a dedicated website for displaying the exercise metrics and shared data and may provide for variable resistance walking in which a user's leg and arm regions experience a counter resistance to achieve aerobic and anaerobic benefits. The device may be utilized for indoor and outdoor resistance walking in physical therapy and may be adapted to healthcare conditions, including foot ailments, obesity, and diabetes.

18 Claims, 31 Drawing Sheets

(51) Int. Cl.

| | |
|---|---|
| ***A63B 21/055*** | (2006.01) |
| ***A63B 23/035*** | (2006.01) |
| ***A63B 23/04*** | (2006.01) |
| ***A63B 24/00*** | (2006.01) |
| ***A63B 71/06*** | (2006.01) |

(52) U.S. Cl.
CPC ..... *A63B 21/0552* (2013.01); *A63B 21/4015* (2015.10); *A63B 21/4035* (2015.10); *A63B 23/03541* (2013.01); *A63B 23/0405* (2013.01); *A63B 24/0062* (2013.01); *A63B 71/0622* (2013.01); *A63B 2220/40* (2013.01); *A63B 2220/833* (2013.01); *A63B 2225/20* (2013.01); *A63B 2230/75* (2013.01)

(58) Field of Classification Search
CPC ..... A63B 21/4035; A63B 23/03541; A63B 23/0405; A63B 24/0062; A63B 71/0622; A63B 2220/40; A63B 2220/833; A63B 2225/20; A63B 2230/75; A63B 2071/0694; A63B 2209/10; A63B 2210/50; A63B 2220/17; A63B 2225/09; A63B 21/0555; A63B 2220/803; A63B 2230/06; A63B 21/0557; A63B 2225/50
See application file for complete search history.

(56) References Cited

U.S. PATENT DOCUMENTS

| | | | | | |
|---|---|---|---|---|---|
| 2,160,722 | A * | 5/1939 | Cunningham | A63B 21/0552 | 482/79 |
| 4,195,835 | A * | 4/1980 | Hinds | A63B 21/0552 | 482/125 |
| D262,228 | S * | 12/1981 | Docic | D21/693 | |
| 4,728,103 | A * | 3/1988 | Fulton | A63B 23/085 | 482/125 |
| 5,518,486 | A * | 5/1996 | Sheeler | A63B 21/0004 | 482/131 |
| 5,558,609 | A * | 9/1996 | Olschansky | A63B 21/4015 | 482/125 |
| 5,582,579 | A * | 12/1996 | Chism | A61H 1/0259 | 482/79 |
| 5,695,437 | A * | 12/1997 | Olschansky | A63B 21/4015 | 482/125 |
| 5,873,805 | A * | 2/1999 | Ayres | A63B 21/0552 | 482/125 |
| 6,368,258 | B1 * | 4/2002 | Emlaw | A63B 21/0004 | 482/79 |
| 7,946,965 | B2 * | 5/2011 | Carbonero | A63B 25/00 | 482/75 |
| 7,955,236 | B2 * | 6/2011 | DiGiovanni | A63B 21/0552 | 482/129 |
| 8,075,462 | B1 * | 12/2011 | Hinds | A63B 21/00061 | 482/125 |
| 9,630,081 | B2 | 4/2017 | Gillespie | | |
| 9,821,189 | B1 * | 11/2017 | Saar | A63B 21/4015 | |
| 10,413,775 | B2 * | 9/2019 | Kasner | A63B 21/4034 | |
| 11,331,529 | B1 | 5/2022 | Cranke | | |
| 11,400,332 | B1 | 8/2022 | Alford et al. | | |
| 12,029,942 | B2 * | 7/2024 | McInturf | A63B 71/0622 | |
| 2007/0287616 | A1 * | 12/2007 | Weaver | A63B 21/0552 | 482/121 |
| 2012/0302406 | A1 * | 11/2012 | Hinds | A63B 21/0055 | 482/121 |
| 2013/0065680 | A1 | 3/2013 | Zavadsky et al. | | |
| 2015/0317438 | A1 * | 11/2015 | Ingrassia, Jr. | G16H 20/30 | 702/19 |
| 2015/0374290 | A1 * | 12/2015 | Spears | A61B 5/1118 | 600/595 |
| 2020/0023229 | A1 * | 1/2020 | Oltorik | A63B 24/0062 | |
| 2020/0086159 | A1 * | 3/2020 | Marti | A63B 23/03508 | |
| 2020/0086173 | A1 * | 3/2020 | Marti | A63B 21/0552 | |
| 2020/0129130 | A1 * | 4/2020 | Korhonen | G16H 50/20 | |
| 2020/0206556 | A1 | 7/2020 | Souffrain | | |
| 2022/0008775 | A1 | 1/2022 | Rubin et al. | | |
| 2022/0233905 | A1 | 7/2022 | Bar et al. | | |
| 2023/0347210 | A1 * | 11/2023 | McInturf | G06T 13/80 | |
| 2024/0359057 | A1 * | 10/2024 | McInturf | A63B 21/0552 | |

* cited by examiner

VARIABLE RESISTANCE WALKING DEVICE WITH DEDICATED FOOT ANCHOR AND ERGONOMIC NETWORK INTERFACE HANDLE

CROSS-REFERENCE TO RELATED APPLICATION

This application is based upon and claims the benefit of priority from U.S. Provisional Patent Application No. 63/456,079, filed on Mar. 31, 2023, the entire contents of which are incorporated herein by reference.

FIELD OF INVENTION

The present invention generally relates to exercise equipment and, more particularly, to a variable resistance walking device with a dedicated foot anchor and an ergonomic handle featuring a display and network interface.

BACKGROUND

In this new era of the awareness of the myriad of benefits of exercise, resistance walking, in which both the leg and arm regions experience a counter resistance, is known to provide both aerobic and anaerobic benefits. However, in current practice, the combination of this functionality in a device configured for both indoor and outdoor use is unavailable in a compact and convenient resistance walking device. It would be advantageous to implement a variable resistance walking device that is optimized with a predetermined range of interchangeable and convenient user-selected resistance levels. The variable resistance walking device may be further configured to measure multiple exercise metrics of a user that are tracked and used personally or shared via a network interface on a dedicated website so that a user experience may be motivated by private or shared user statistics and social capabilities including virtual challenges. It would also be beneficial to provide such a variable resistance walking device configured for indoor and outdoor training that networks together a broad range of user communities. The device's specifications should also apply to physical therapy and be adapted to particular healthcare conditions, including foot ailments, obesity, and diabetes.

SUMMARY

According to the embodiments of the invention, there is an apparatus for resistance walking comprising a pair of elastomeric bands, each band further comprising a foot anchor at the first end and a handle at the second end. Each handle may house a plurality of insertable electronic components comprising at least one sensor, the at least one sensor configured to track exercise data. In addition, the insertable electronic components of the apparatus may further include a network interface disposed within at least one handle. The network interface may comprise a processor and a memory, and the network interface may communicate wirelessly with at least one sensor and with at least one website via a network. The insertable electronic components may communicate wirelessly to applications on a device such as a phone, tablet or computer. The applications may then communicate with the website. In addition, the apparatus may include a wireless interface with a website displaying the exercise data and shared data. The processor may store and send the exercise data to the website via the network, retrieve the shared data from the network, and store the shared data in the memory.

According to the embodiments of the invention, there is also provided a device for resistance walking comprising a pair of elastomeric bands. Each band may include a first end extending toward a foot anchor that may be permanently or detachably coupled to the foot anchor and a second end extending toward a handle portion that may be permanently or detachably coupled to the handle portion. The device may include a sensor disposed within each handle, and the sensor may be configured to track exercise data. The device may include a network interface disposed within at least one handle. The network interface may comprise a processor and a memory, and the network interface may be in communication with the sensors and with at least one website via a network. The device may further communicate with the website to display the exercise data and shared data. The processor may store and send the exercise data to the website via the network, retrieve the shared data from the network, and store the shared data in the memory.

There is also provided according to the embodiments of the invention device for measuring oxygen consumption during resistance walking comprising a pair of elastomeric resistance elements. Each resistance element may have an anchor at the first end, and the anchor may be configured to couple to a foot accessory of a user detachably. Each resistance element may also include a handle portion at a second end, and the resistance element may extend linearly in an axis of the handle portion. The device may include at least one sensor disposed within each handle configured to track exercise data, including an oxygen consumption of the user based upon measurements taken by at least one sensor. In addition, the device may include a network interface disposed within at least one handle. The network interface may comprise a processor and a memory, and the network interface may be in communication with at least one sensor and with at least one website via a network. The device may further include the network interface wirelessly communicating with a website for displaying the exercise data and shared data. The processor may store and send the exercise data to the website via the network, retrieve the shared data from the network, and store the shared data in the memory.

These and other objects, features, and advantages of the present invention will be apparent from the following detailed description of illustrative embodiments, which will be read in connection with the accompanying drawings.

BRIEF DESCRIPTION OF THE DRAWINGS

The present invention is illustrated by way of example, and not by way of limitation, in the figures of the accompanying drawings in which.

DETAILED DESCRIPTION

Figure 1A:
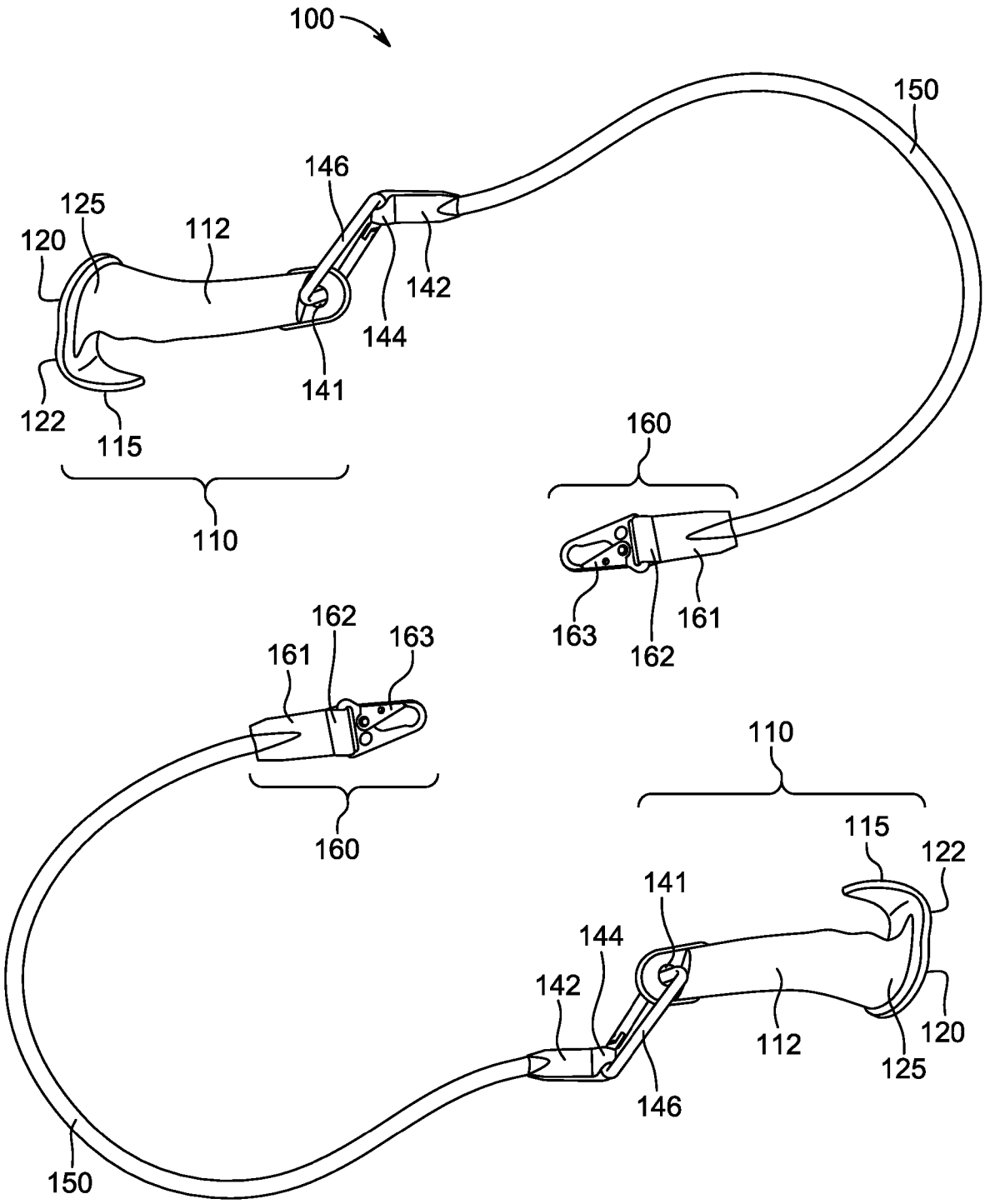
FIG. 1A is a perspective view of an embodiment of the variable resistance walking device with a dedicated foot anchor and ergonomic handle, including a display and network interface.

Embodiments of the present disclosure are described herein. It should be appreciated that drawing numbers appearing in different drawing views identify identical or functionally similar structural elements. Also, it is to be understood that the disclosed embodiments are merely examples, and other embodiments can take various and alternative forms. The figures are not necessarily to scale; some features could be exaggerated or minimized to show details of particular components. Therefore, specific structural and functional details disclosed herein are not to be interpreted as limiting but merely as a representative basis for teaching one skilled in the art to employ various embodiments. As those of ordinary skill in the art will understand, various features illustrated and described concerning any one of the figures can be combined with features illustrated in one or more other figures to produce embodiments that are not explicitly illustrated or described. The combinations of features illustrated provide representative embodiments for typical applications. However, various combinations and modifications of the features consistent with the teachings of this disclosure could be desired for particular applications or implementations.

The terminology used herein is to describe particular aspects only and is not intended to limit the scope of the present disclosure. Unless defined otherwise, all technical and scientific terms used herein have the same meaning as commonly understood to one of ordinary skill in the art to which this disclosure belongs. Although any methods, devices, or materials similar or equivalent to those described herein can be used in the practice or testing of the disclosure, the following example methods, devices, and materials are now described.

In general, exercise resistance walking using the device described herein may advantageously provide for coordinated and ergonomic movement of a user's body, including the arms, hands, legs, and feet, during resistance walking. For example, as will be described in further detail, a user's steps may be kinetically resisted by the physical motion of the user's arm movements during walking. Likewise, the user's arm movements may be kinetically resisted by the physical motion of the user's steps during resistance walking.

The device as described herein may be used for indoor anaerobic exercises and outdoor resistance walking daily. The device may also be used in physical therapy and adapted to healthcare conditions, where walking is recognized as a significant benefit for heart health. The device may help strengthen the heart and cardiovascular system, lower blood pressure, and reduce bad cholesterol. Walking is a weight-bearing exercise that helps maintain bone density and strengthens leg, core, and hip muscles.

A device for resistance walking comprising a pair of elastomeric bands, with each band featuring a foot anchor at the first end and a handle with an ergonomic grip at the second end, may provide the enhanced exercise benefits of resistance walking when used both indoors and outdoors. Such a device for resistance walking may improve physical and mental health and, in particular, help to decrease morbidity and mortality associated with heart disease. Resistance walking includes aerobic and anaerobic movements that promote healthy heart function.

Elastomeric exercise resistance bands have not been implemented in exercise resistance walking. Traditional exercise resistance bands may be combined with a fixed, immobile structure, such as a gym rack, with commercial and home gyms being the most likely option. In such configurations, the resistance band may be stretched against the counter resistance of the immobile structure. For example, a traditional resistance band may feature a handle or foot attachment at the first end, while a second end may be attached to the immobile structure. In particular, the structure of the handle and foot attachments in such configurations fails to contemplate the ergonomics of a user's hand and foot movements relative to resistance walking with exercise bands. Therefore, it would be infeasible to implement such resistance bands into the performance of exercise resistance walking using similar handles and foot attachments. Further, such configurations are necessarily limited to the attachment of a band end to a fixed, immobile structure. An exercise resistance band for use without reliance upon a fixed, immobile structure configured with dedicated handle and foot elements may provide a broader range of fitness applications, including outdoor resistance walking.

Another version of a traditional resistance band may alternatively include handles at each end of the band, which has applications for strength training of the arms and upper body but not for resistance walking. In such a configuration, a user may hold a handle in each hand and pull each one simultaneously against the counter resistance of the band.

In other traditional resistance bands, a first band end may feature a handle, and a second band end may be connected to a separate body part of a user, such as an ankle, waist, chest, or shoulder region, so that such resistance bands are not dependent upon attachment to fixed, immobile structures. However, such configurations are intended for strength resistance training of a user's arms while the user remains stationary and are not intended for resistance walking. In addition, the designs featuring the handle at the first band end and the ankle attachment at the second band end cannot contemplate the ergonomic movements and mechanics of a user's foot flexion in conjunction with the pivoting of the ankle and knee joints as a user takes steps during resistance walking. More specifically, if a band end features a foot portion for attachment to a user's foot rather than the ankle, the plantar flexion motion of the foot during resistance walking may advantageously be correlated with the extension and resistance of the band, which is not possible when a band is attached to a user's ankle, for example.

Further, current exercise resistance bands in physical training systems feature cumbersome arrangements with several resistance bands that do not provide ergonomic advantages relative to correlating the kinetic force between a user's steps and arm motions during resistance walking. More specifically, such physical training systems are not explicitly dedicated to exercise resistance walking because a first resistance band attached between a user's shoulders and hands stretches irrespective of a second band attached between a user's waist and foot.

Accordingly, a variable resistance walking device, as described herein, may be configured with a handle portion at the first end and a foot attachment portion at the second end. The handle portion may include a handle with an ergonomic grip and insertable electronic components, and the foot attachment portion may include a dedicated foot anchor. In such a device, a user may advantageously perform ergonomic resistance walking so that a user's steps are effectively resisted by the mechanical motion of the user's arm movements during walking. Likewise, the user's arm movements are effectively resisted by the mechanical motion of the user's steps during walking.

In addition to promoting cardiovascular function, a device for resistance walking as disclosed herein may be implemented generally to enhance the use of the orthopedic system, including essential joints, muscles, tendons, bones, and ligaments, and more particularly in the area of physical therapy, to maintain and nurture flexibility, balance, bone density and muscle strength for the elderly and to facilitate recovery and rehab following health trauma. Rehab patients may choose and are frequently expected to perform an exercise component of a rehab regimen at home. Without access to the proper equipment and limited home gym options, the device for resistance walking, as disclosed herein, may assist rehab patients in overcoming these limitations. In addition, the device for resistance walking as disclosed herein may also engage the vestibular system for improving balance, spatial orientation, and coordination.

Traditional exercise resistance bands do not provide the cardiovascular health benefits of resistance walking in indoor and outdoor environments. Accordingly, there is a need for an exercise resistance band device that provides optionality for indoor and outdoor resistance walking. The advantage of walking outdoors is supported by science, and it is known that exposure to green space and sunlight is associated with wide-ranging health benefits, including higher serotonin levels, lower blood pressure, and cholesterol, and lower rates of diabetes, stroke, asthma, heart disease, and overall death. In addition, the device for resistance walking, as disclosed, may facilitate outdoor resistance walking as a preventative measure against cardiovascular morbidity: the American Heart Association estimates that, on average, someone in the United States dies of cardiovascular disease (CVD) every 34 seconds, with 2544 U.S. deaths from CVD each day, and on average someone in the U.S. dies of a stroke every 3 minutes and 17 seconds, with 439 U.S. deaths from stroke each day. As such, the device for resistance walking, as disclosed herein utilizing resistance bands, may promote significant improvement in cardiovascular health with enhanced access to indoor and outdoor resistance walking.

In light of the scientific evidence and health statistics supporting the need for an apparatus for resistance walking, as disclosed herein, it would also be beneficial to implement a variable resistance walking device that is further configured to provide incentives for resistance walking based upon tracked and shared exercise data. For example, the device, as disclosed herein, may measure the exercise metrics of a user, such as several steps taken by a user that may be shared via a network interface on a dedicated website so that a user experience may be motivated by the shared user data.

In addition to tracking several steps taken, cardiac metrics relative to oxygen consumption, heart rate, recovery time, resting heart rate, and average and peak heart rates of a user when using the device may be measured. Aerobic fitness, measured as maximal oxygen uptake (VO2 max), is a good indicator of cardiovascular health and a strong predictor of cardiovascular mortality. Biomarkers associated with low VO2 max may therefore represent potential early markers of future CVD. Additional exercise metrics that may be tracked and monitored and determined may include body composition, speed, moderate exercise intensity, vigorous exercise intensity, target heart rates, heart rate variability (HRV), resting heart rate (RHR), calories, strength, mobility, endurance, productivity, and mood.

Further exercise parameters that may be tracked and measured may include heart EKG, repetitions of lifting and lowering arm cycles, time duration of overall exercise session, time duration of a cycle relative to raising and lowering of an arm or leg, resistance force exerted on an elastomeric resistance band, motion of the device, position data of the device relative to the user, position data via GPS of the device in the world, temperature of ambient temperature, and temperature of user's skin. While tracking and measuring biometric exercise parameters may be achieved using sensors as described herein, exercise parameters may also be derived, calculated, and/or estimated from the acceleration, motion and position data that may be collected from an accelerometer or force gauge, for example.

Additionally, any combination of the collected data may be processed by calculation and algorithm to further deductively estimate statistics that relate to the efficaciousness of the workout. The algorithm may be performed all or in part on the insertable electronic components and technology on the device, within an application on a user device or remotely on a server via an internet connection. The data processed and/or displayed may also include data collected from the connected user device such as phone, smart watch or additional fitness tracker.

Measurement and tracking of such exercise metrics may generally be achieved in various embodiments of the resistance walking device as disclosed herein based upon input devices, including a keyboard, a keypad, a touch screen, a touchpad, a sensor, a microphone, an accelerometer, a gyroscope, GPS sensors, a biometric scanner, or a network connection (e.g., a wireless local area network card for transmission and reception of wireless IEEE 802 signals). The implementation of such input devices within the embodiments of the resistance walking device will be described in further detail in conjunction with the accompanying drawings and detailed description.

In addition to measuring and tracking exercise data, including steps are taken and maximal oxygen uptake, the device, as disclosed herein, may also provide social networking capabilities for virtual engagement with users in virtual challenges and virtual training. Networking capability may include sharing performance information and competing in personal and team challenges, such as virtual heart walk challenges within a community network for users of the device in outdoor and indoor resistance walking.

As will be described in further detail herein, the networking capability provided by the resistance walking device may be achieved via a dedicated network interface and website for displaying the tracked exercise data and shared data. The network interface may include a processor and memory to store and send the exercise data to the website via the network, retrieve the shared data from the network, and store the shared data in the memory. In addition, the network interface may include input and output devices with network connections, such as wireless local area network cards for transmission and reception of wireless IEEE 802 signals.

The capability above to track and share exercise metrics in the variable resistance walking device, as disclosed herein, may be implemented as part of a modular design concept that comprises both electronic technology components and kinesthetic mechanical parts. In general, a variable resistance walking device may include the integral mechanical components of the handles, elastomeric bands, and foot portion. In addition, the electrical components may include web interfaces, network interfaces, Bluetooth® and wireless coupling with phone apps, graphical user interface (GUI) displays, sensors, processors, graphics processing units (GPU), memory, and a rechargeable battery that may be utilized to power a Bluetooth® communication component, for example.

A modular handle portion at the end of an elastomeric resistance band may include mechanical components such as a cushioned grip that rotates 360 degrees about an axis of the handle to reduce stress on a user's wrist and to alleviate carpal tunnel stress when exerting a pulling force against the resistance of the band.

A modular handle portion may also feature a cushioned grip portion that extends linearly from top to bottom in the same axis as a resistance band, thereby alleviating carpal tunnel stress while providing an additional ergonomic configuration of the handle portion relative to a user's pulling force against the resistance of a band. In an embodiment in which a cushioned grip portion may be on the same axis as the band, a top portion of the grip may also feature a cushioned cap member that meets the top region of a user's hand when the user grasps the cushioned grip. When a user grasps the cushioned grip and exerts force to stretch the resistance band, the user's hand may exert force against the cushioned cap member to provide force to stretch the resistance of a band. In such a configuration, it may not be necessary for the user to grasp the cushioned grip portion tightly since a user may instead effectively stretch the resistance band based on the force applied to the cushioned cap member. As such, an embodiment of the resistance walking device that includes a cushioned cap member in the modular handle portion may also alleviate carpal tunnel stress when a user exerts a force against the resistance of a band.

As understood by those of skill in the art, components of the modular handle portion as described in the embodiments disclosed herein may be formed based upon a PC/ABS injection molding process using nylon or similar parts in conjunction with overmolded or insert molded EVA/PTU components of the modular handle portion. For example and as will be described in further details, a cushion member of the modular handle portion may be formed based upon an overmolded elastomer. A palm member of the modular handle portion may also be formed based upon an overmolding process. A material of a modular handle portion may comprise a Hypalon® material or similar material. It is to be further understood that the components of the modular handle portion as described in the embodiments disclosed herein may also be formed based upon 3-D printing processes and 3-D printed models.

A modular handle portion may be coupled to a resistance band directly or indirectly. In an embodiment in which a handle portion is directly and immediately attached to a resistance band, there may be no yoke or intermediary parts between the handle and the band. For example, an embodiment of a modular handle portion may include a threaded attachment member, which may include threads that may be screwed into and attached within a lower portion of the modular handle portion. The threaded attachment member may enable the resistance bands to directly and detachably couple to the modular handle portion. The ability to directly and detachably couple a resistance band to a modular handle portion may provide enhanced efficiency and convenience in enabling a user to quickly and selectively interchange a range of resistance bands having predetermined resistance levels when adjusting a variable resistance of a band attached to the handle. For example, resistance may be changed by swapping out resistance bands having a predetermined resistance level with resistance bands having another predetermined resistance level.

In another embodiment in which the handle portion couples indirectly to a band, a yoke comprising a metal loop component or chain element may couple the handle portion to the resistance band. For example and as will be described in further detail in the embodiments disclosed herein, to indirectly and detachably couple a resistance band to a modular handle portion, a resistor handle end sheath may comprise a Hypalon® material or similar material that may be stitched and/or heat welded over a resistance band. The Hypalon® material or similar material of the resistor handle end sheath that may be stitched and/or heat welded over the resistance band may also form a loop for a securing member, such as a spring-loaded clip or carabiner that may be comprised of a suitable material for repetitive use with force applied, such as a steel and aluminum material. The carabiner may enable a user to indirectly and detachably couple the resistance band to the modular handle portion. For example, the carabiner may attach to the modular handle portion at an attachment point, such as a hole formed within the modular handle portion. The ability to indirectly and detachably couple a resistance band to a modular handle portion may provide enhanced efficiency and convenience in enabling a user to quickly and selectively interchange a range of resistance bands having predetermined resistance levels when adjusting a variable resistance of a band attached to the handle. As aforementioned, a resistance may be selectively and efficiently changed by swapping out resistance bands having a predetermined resistance level with resistance bands having another predetermined resistance level.

With respect to the coupling and connection of the handle portion to the resistance band as described herein, it is understood that the attachment points, methods of attachments and the drawings are just illustrative, and the resistance bands may be directly attached to the handles and the anchors. For example, in an embodiment, a handle portion may be directly welded to a resistance band.

A modular handle portion may also include mechanical components for adjusting a variable resistance of a band attached to the handle. For example, in an embodiment, a handle portion may include a winding wheel component that enables a user to wind a band to shorten or extend the length of the band to increase or decrease a variable resistance of the band. In another embodiment, a handle may feature grommets that may be secured and affixed to a resistance band. In such embodiments, the resistance bands may be either permanently or detachably coupled to the handle and foot portions of the variable resistance walking device. One or more grommets may be mechanically secured and affixed over the resistance band with glue or heat molding during assembly to secure and hold the grommets in place over the resistance band. Grommets secured on an elastomeric resistance band may enable a length and variable resistance of the elastomeric resistance band to be adjusted based upon a friction provided by the grommet against the band, or based upon a pinching or deforming of the resistance band by the grommet. Grommets may be of varying diameters to enable a user to pull up and secure a band to reduce slack in the band to increase a variable resistance of a band. Likewise, in an embodiment featuring grommets of varying diameters, a user may extend and secure a band to increase slack in the band to reduce a variable resistance of a band. In another embodiment, a handle may enable a user to pinch a band at a desired band length to set the device to a calibrated, predetermined resistance.

In general, grommets as disclosed herein may be utilized in conjunction with elastomeric resistance bands that may be fixed, replaceable or swappable. Resistance bands may be fixed if the resistance bands are permanently coupled to the handle and foot portions of the variable resistance walking device. Resistance bands may be replaceable if the resistance bands of a certain resistance level may be detachably coupled to the handle and foot portions of the variable resistance walking device and replaced with resistance bands of the same resistance level. Resistance bands may be swappable if the resistance bands of a certain resistance level may be detachably coupled to the handle and foot portions of the variable resistance walking device and swapped with resistance bands of a different resistance level.

Further and in combination with the aforementioned modular handle portion, a variable resistance walking device may also comprise electrical components, such as sensors located within the housing of the handle portion. Sensor may be located in each handle or in just one handle. Sensors may include a force gauge to measure the amount of force exerted by a user when exerting a pulling force against a band's resistance. Sensors may also include an accelerometer to measure repetitions based on the displacement of a band via stretching movements. In addition to measuring repetitions, accelerometers as disclosed herein may also measure the acceleration and relative position of the variable resistance walking device. Sensors in the device, as disclosed herein, may also include a gyroscope to measure orientation in space and angular velocity.

Sensors may include GPS sensors to determine location, speed, and elevation difference, for example, when exercising with the variable resistance walking device as disclosed herein. Sensors as implemented with the variable resistance walking device as described herein may also include pedometers and temperature sensors and integrated sensors. Sensors may be in the modular handle portions and/or the modular foot portions including a dedicated foot anchor. Sensors may be in either just one modular handle portion or in both of the modular handle portions, and sensors may be in either just one modular foot portion or in both of the modular foot portions including a dedicated foot anchor. Sensors in the modular handle portions may collaborate and communicate with sensors in the modular foot portions including a dedicated foot anchor to measure and capture exercise metrics as described herein. Such exercise metrics may include continuous glucose monitoring (CGM) for continuous monitoring of blood sugar levels during workouts with the variable resistance walking device as disclosed herein. Such exercise metrics may also include several steps taken by a user that may be shared via a network interface on a dedicated website so that a user experience may be motivated by the shared user data. In addition to tracking several steps taken, sensors as described herein may also track cardiac metrics relative to oxygen consumption, heart rate, recovery time, resting heart rate, and average and peak heart rates of a user when using the variable resistance walking device as described herein. In an embodiment, the sensors as described herein may explicitly measure the exercise data and exercise metrics as detailed herein. In another embodiment, the sensors as described herein may not explicitly measure the exercise data and exercise metrics as detailed herein, but they may calculate and/or estimate the exercise data and exercise metrics from the motion and position data that may be collected from an accelerometer or force gauge, for example. In another embodiment, the sensors as described herein may explicitly measure the exercise data and exercise metrics as detailed herein while also calculating and/or estimating the exercise data and exercise metrics from the motion and position data that may be collected from an accelerometer or force gauge, for example.

Based on the sensors described herein that may be implemented in the modular handle portion of the device, it may be possible to measure and track various types of exercise data. For example, exercise data may include metrics based on the time and distance measured during exercise with the resistance walking device. In addition, performance measurement data may include a calculation of exercise performance based on the distance traveled when using the device relative to a user's weight. Further, biometric sensor tracking data may monitor a user's heart rate independently of the movement and operation of the resistance walking device.

Various embodiments of the device may include a modular handle portion that includes any combination of the sensors or just one of the sensors, as described herein, to determine the efficacy of a user's workout and motivate a user to exercise. In an embodiment, an accelerometer may be used to determine the number of steps a user takes and the force exerted. In another embodiment, an accelerometer may be used to acquire metrics, including several steps taken and resistance data to determine exercise metrics. In yet another embodiment, an accelerometer and a gyroscope may be used to calculate force without implementing a force sensor. Finally, another embodiment may include an accelerometer, a gyroscope, and a force sensor to acquire exercise metrics. It is understood that each handle of the variable resistance walking device may include any combination and number of sensors as described herein.

In addition to implementing sensors into the modular handle portion, other electrical components in the handle portion may include at least one display, for example, a GUI or LCD, that may be utilized to indicate the number of steps taken, as tracked by the sensors. It is understood that a display may be implemented in the modular handle portion in combination with other electrical components described herein. Embodiments of the resistance walking device, as described herein, may feature one or more displays at different locations on the modular handle portion. For example, and as will be described in further detail and illustrated in the accompanying drawings, a display within a handle portion may be implemented on a top region of a handle or a side region of a handle adjacent to a grip region of the handle.

In addition to the visual data from displays implemented within the modular handle portion, further electronic components within the handle portion may also include LED lights of particular colors associated with unique status updates. For example, an LED light within the modular handle portion may provide an indication of the status of a user's unique biomarkers or workout progress based upon red, green or blue LED light indicators.

In addition to the LED light indicators, the modular handle portion of the variable resistance walking device as disclosed herein may also include audible indicators to provide a status of a user's biomarkers or workout progress. For example, the modular handle portion may be configured to beep or provide another sound when a user may need to raise the modular handle portion higher to a predetermined level to achieve a more efficacious workout. The audio cues provided by the modular handle portion may also be associated with a user's biomarkers, such as when the user's heart rate reaches a predetermined level during a workout.

Further, in addition to the aforementioned LED light indicators and audible indicators, the modular handle portion of the variable resistance walking device as disclosed herein may also include sensory indicators and cues to provide a status of a user's biomarkers or workout progress. For example, the modular handle portion may be configured to vibrate or buzz or shake when a user may need to raise the modular handle portion higher to a predetermined level to achieve a more efficacious workout. The sensory cues based upon a vibration or buzzing or shaking as provided by the modular handle portion may also be associated with a user's biomarkers, such as when the user's heart rate reaches a predetermined level during a workout.

Additional electrical components that may be implemented within the modular handle portion of the resistance walking device may include an internal battery component that may be utilized to power a Bluetooth® communication component. A single handle portion may include one or more sensors in combination with a display and a battery component. In another embodiment, a single handle portion may include one or more sensors in combination with a display or a battery component. In another embodiment, each handle portion may include at least one display and battery component. It is understood that each handle may include any number and combination of sensors, battery components, and displays as described herein.

Electrical components within the modular handle portion of the device may include a network interface in communication with at least one sensor and a website via a network. The network interface may include a processor and memory. In addition, it may be in communication with input and output devices with wireless network connections for sharing performance information that is tracked and measured by one or more sensors in the modular handle portion.

With the electrical components described herein that may be implemented into the kinesthetic mechanical part of the modular handle portion, the handle portion with the aforementioned soft-cushioned grip and cushioned cap member may provide an ergonomic and comfortable resistance walking experience for a user. In addition, the modular handle portion may further include the technology mentioned above and electrical components that may enhance a user experience, in part, by indicating to a user how many steps are required for a particular virtual challenge walk, how many have been taken as required by the science of the American Heart Association, and how much resistance has been applied with an instant virtual walk.

Referring to the resistance bands adjoining the modular handle and foot portions as an additional kinesthetic mechanical part of the resistance walking device as described herein, embodiments of the resistance bands may feature various materials and parameters that determine the resistivity and durability of the band.

For example, embodiments of the resistance bands may include a resistive elastomeric flex band or tube, a custom-molded resistive flex band, and a braided rubber cord. A band or tube may feature a flat, rectangular, square, oval or circular cross section. In addition, a band or tube may be made from a particular material or feature a certain thickness or width based on stretching resistivity and suitability for long-term durability. In addition, a band may also be comprised of a specific material based upon compatibility with particular modular designs of the handle and foot portions. For example, depending on whether a band may directly or indirectly attach to the handle portion and foot portions, a particular material may be implemented for the resistance bands based on a set of parameters for how the bands are coupled or attached to the hand portions and foot portions of the resistance walking device. Likewise, specific materials and specifications for a resistance band may be preferably based on how a variable resistance of the band may be implemented in combination with a modular handle portion. For example, whether a band may be pinched or wound into a wheel within the handle or pulled into grommets within a handle to adjust slack and variable resistance may determine the particular material and dimensional parameters for the band. In an embodiment, a material of the resistance bands may include a latex/ethylene vinyl acetate EVA material, for example.

As aforementioned, a resistance band may directly or indirectly couple to a modular handle portion and a dedicated foot anchor portion. In addition, a resistance band may be permanently or detachably coupled to the handle or foot portions. In an embodiment in which the hand and foot portions are coupled indirectly to a band, a yoke comprising a metal loop component or chain element may couple the hand and foot portions to the resistance band. With respect to the coupling and connection of the handle portion and the dedicated foot anchor portion to a resistance band as described herein, it is understood that the attachment points, methods of attachments and the drawings are just illustrative, and the resistance bands may be directly attached to the handle portion and to the dedicated foot anchor portion. For example, in an embodiment, a handle portion and/or a dedicated foot anchor portion may be directly welded to a resistance band.

In addition, attachment of a resistance band at the handle and/or the foot anchor may include an ability to adjust a length of the device to accommodate a particular body size or height of a given user. An adjustment of the device to accommodate a user's body size or height may be done independently of and without any change to the length of a resistance band or resistance level of the resistance band. As will be described in further detail in the embodiments as disclosed herein, an adjustment of the device to accommodate a user's body size or height may be achieved via a variable length of an attachment element that may include VELCRO®, mechanical strap hardware, a screw/compression element for variable length adjustment or mechanical fixed positions via button, snap, or grommet and hooks assembly. In other embodiments, an additional adjustment to the effective length of the resistance band that changes the portion of the resistance band that is intended to extend and retract in order to adjust the resistance force may also be used.

Referring to the modular foot portions as an additional kinesthetic mechanical part of the resistance walking device as described herein, embodiments of the modular foot portion may be configured for use in conjunction with a user's foot accessories not limited to the user's shoes, sneakers, hiking boots, and socks. For example, the modular foot portion may feature a foot anchor element that a user may attach or step into and that supports the user's foot when using the resistance walking device. In use, a user may first attach or step into the foot anchor before subsequently wearing the foot-mentioned accessories used when exercising with the resistance walking device. In an embodiment, a foot anchor may comprise a plurality of adjustable Velcro® straps, such as a Velcro® strap that wraps around a bottom of the user's shoe to secure the dedicated foot anchor to the user's shoe, an adjustable Velcro® instep strap extending over a user's instep region, and an adjustable Velcro® heal strap. One or more Velcro® straps may be utilized in an anchor portion to secure the foot anchor to a user's shoe and accommodate detachable coupling to a range of resistance bands each having a predetermined resistance level. A material of the foot anchor including the straps may also be comprised of a Hypalon® material or similar material that provides a wear-resistant plastic material suitable for repetitive use with force.

In addition, and as will be described in further detail, the modular foot portions may be adapted and configured to the needs of particular users and patient groups. In an embodiment, the anchor may be configured for users with flat feet by including a cushioned arch inside an insole of the anchor. In addition, an anchor or stirrup may be configured to accommodate diabetes patients who have developed foot neuropathy. In particular, a dedicated anchor for diabetes patients may feature a reinforced insole portion that protects a patient's foot from bruising if a patient inadvertently steps on hard or sharp objects when using the resistance walking device. A foot anchor configured for diabetes patients may also be more spacious in width and length, for example, to avoid tightness and provide comfort for the patient's feet when using the device. Likewise, a foot anchor may also be configured for medically obese patients by providing an extra-large anchor that may include TransDRY® technology to keep the patient's feet dry when using the device. In addition, a foot anchor may be configured to accommodate patients who suffer from foot bunions to soften the steps taken and allow for longer walks when using the device.

As will be described in further detail in conjunction with the accompany drawings provided herein, in some embodiments, a dedicated foot anchor portion may include a foot anchor built into a dedicated shoe or compression support or sock of the variable resistance walking device. For example, a foot anchor may be sewn into a construction of a dedicated shoe of the variable resistance walking device. In addition, an ankle and foot compression support with podiatry benefits may include a foot anchor sewn into the fabric of the dedicated compression support. A foot anchor may also be sewn into the fabric of a dedicated sock of the variable resistance walking device.

With respect to the various embodiments of the modular foot portion, several configurations may be implemented into the resistance walking device as described herein. In some embodiments, a foot portion, including an anchor, may be permanently attached to a resistance band. In contrast, in other embodiments, the anchor may be detachable from the resistance band so that it may be washable or interchangeable with other anchors dedicated to particular health concerns and patient groups as described herein. A detachable foot portion may feature a clip or attachment portion between the resistance band and the anchor.

In some embodiments, the modular foot portion may not include a foot anchor. In such embodiments, the modular foot portion may comprise saddle, harness, and cord elements that may attach to a user's sock or shoelaces, such as by clipping or fastening, or tying the resistance band directly to the user's sock or shoe, for example. In such an embodiment, the resistance walking device may feature the kinesthetic mechanical parts of the modular handle and resistance band and a foot portion without an anchor. In such an embodiment of the device without an anchor, a resistance band may feature a foot portion with a saddle piece or harness portion that attaches to an upper surface or laces region of a user's shoe. In an embodiment, a saddle piece or harness portion may include a thin cord that fastens the saddle piece or harness portion to a user's shoe or shoe laces by running the thin cord under the shoe laces or through the eyelets of the shoe. In another embodiment of the device without a foot anchor, a resistance band may feature a foot portion, including a thin cord, without the saddle piece or harness portion. The thin cord may affix the resistance band to a user's shoe or shoe laces by running the thin cord under the shoe laces or through the shoe's eyelets.

In an embodiment, a resistance band may indirectly and detachably couple to a dedicated foot anchor. As will be described in further detail, in such an embodiment, a resistance band may feature an anchor attachment member including a resistor anchor side sheath comprising a Hypalon® material or similar material that may be stitched and/or heat welded over the resistance band. The Hypalon® material or similar material of the resistor anchor side sheath that may be stitched and/or heat welded over the resistance band may also form a loop for a metal-gated hook. The metal-gated hook may be configured based upon a standard construction for low profile and high strength, with a custom hook to attach to a dedicated foot anchor. The metal-gated hook may be attached and removed from a dedicated foot anchor.

Further and in combination with the aforementioned modular foot portions that may include a dedicated foot anchor, a variable resistance walking device may also comprise electrical components, such as sensors located within one or within both of the modular foot portions that may include a dedicated foot anchor. Sensors in the aforementioned modular foot portions that may include a dedicated foot anchor may be in addition to and in conjunction with sensors within a modular handle portion as described above. As aforementioned, sensors in the modular foot portions including a dedicated foot anchor may collaborate and communicate with sensors in the modular handle portion to measure and capture exercise metrics as described herein. Such exercise metrics may be measured based upon sensors located in either or both of the modular handle portion and the modular foot portion with dedicated foot anchor.

Various embodiments are described in the following paragraphs. Where like elements have been depicted in multiple embodiments, identical or similar reference numerals have been used for case of understanding.

Referring to FIG. 1A, a perspective view of an embodiment of a variable resistance walking device 100 as described herein is shown, including a pair of elastomeric resistance bands 150, with each band 150 featuring an anchor attachment member 160 at the first end of each band 150 and a modular handle portion 110 at a second end of each resistance band 150. The modular handle portion 110 may provide an ergonomic and comfortable grip when exercising, and the anchor attachment member 160 may securely fasten a resistance band 150 to a user's foot accessory, such as a shoe, hiking boot, or sneaker, for example.

Referring again to FIG. 1A, as will be described in further detail, the modular handle portion 110 may comprise one or more of a variety of mechanical and electrical features detailed in the herein-disclosed embodiments of the variable resistance walking device 100. The modular handle portion 110 may generally include a palm member 112 configured to meet the palm of a user's hand. The palm member 112 may extend linearly toward a top section 122 with a securing member 115 adjacent to the palm member 112. When a user grasps the palm member 112, the top section 122 with securing member 115 may extend over and around an upper portion of a user's hand to secure the modular handle portion 110 within the user's grasp. The configuration of the securing member 115 adjacent to the palm member 112 may provide a comfortable and ergonomic space for the user's hand to securely hold the modular handle portion 110 without requiring the user to clench the palm member 112 tightly within the user's hand.

In addition, and as shown in FIG. 1A, the palm member 112 may extend linearly from top to bottom in the same axis as the resistance band 150, thereby alleviating carpal tunnel stress while providing an additional ergonomic configuration of the handle portion 110 relative to a user's pulling force against the resistance of a resistance band 150.

Referring to FIG. 1A, an upper portion of the palm member 112 may also feature a cushion member 125 comprising a material that may be softer than a material of the palm member 112. A cushion member 125 may meet a top region of a user's hand when the user grasps the palm member 112. When a user grasps the palm member 112 with cushion member 125 and exerts a force against cushion member 125 to stretch the resistance band 150, the user's hand may exert force against cushion member 125 to provide force to stretch the resistance of band 150. In such a configuration, it may not be necessary for the user to tightly grasp the palm member 112 with cushion member 125 when exerting force against the resistance band 150 since a user may instead effectively stretch the resistance band 150 based upon the force applied to the cushion member 125. As such, an embodiment of the resistance walking device 100 that includes a cushion member 125 in the modular handle portion 110 may also alleviate carpal tunnel stress when a user exerts a force against the resistance of a resistance band 150.

As will be described in further detail, the top section 122 of the modular handle portion 110 shown in FIG. 1A may include insertable electronic components 120 (to be described in further detail in FIGS. 14A-14C), including a GUI or LED display that may reside within the modular handle portion 110. Although the embodiment of FIG. 1A illustrates the insertable electronic components 120 within the modular handle portion 110, it is understood that other embodiments of the modular handle portion 110 may not include the insertable electronic components 120. The insertable electronic component 120 may indicate a desired exercise metric, such as the number of steps taken by a user, a user's oxygen consumption, a user's heart rate, or any other available health metrics when exercising with the variable resistance walking device 100. It is understood that the insertable electronic components 120 may also include sensors such as a force gauge to measure the amount of force exerted by a user when exerting a pulling force against a resistance of a resistance band 150. Sensors may also include an accelerometer to measure repetitions based on the displacement of a resistance band 150 via stretching movements. Sensors in the device, as disclosed herein, may also include a gyroscope to measure orientation in space and angular velocity. Additional insertable electronic components 120 that may be implemented within the modular handle portion 110 of the resistance walking device 100 may include an internal battery component, such as a rechargeable battery that may be utilized to power a Bluetooth® communication component. Insertable electronic components 120 within the modular handle portion 110 may include a network interface in communication with at least one of the sensors mentioned above and a website via a network. The network interface may include a processor and memory. The network interface may be in communication with input and output devices with wireless network connections for sharing performance information that is tracked and measured by one or more sensors in the modular handle portion 110. The network interface may communicate wirelessly with at least one sensor and with at least one website via a network. The insertable electronic components 120 may communicate wirelessly such as via Bluetooth®, to applications on a user device such as a phone, tablet or computer. The applications may then communicate with the website. In addition, the device 100 may include a wireless interface with a website displaying the exercise data and shared data. In an embodiment, the insertable electronic components 120 may communicate wirelessly to applications on a user device such as a phone, tablet or computer even if the application does not communicate with a website. In another embodiment, a user's tracked exercise data may be collected on the device 100 by the insertable electronic components 120 before the same tracked exercise data may then be transferred wirelessly or otherwise by a direct USB connection or other cable connection to an application on a user device such as a phone, tablet or computer.

Referring again to FIG. 1A, the elastomeric resistance bands 150 may directly or indirectly and permanently or detachably couple to the anchor attachment member 160 at the first end of each band 150 and to the modular handle portion 110 at a second end of each resistance band 150. In the embodiment shown in FIG. 1A, the resistance band 150 may indirectly and detachably couple to the modular handle portion 110 or anchor attachment member 160. For example, to indirectly and detachably couple the resistance band 150 to the modular handle portion 110, a resistor handle end sheath 142 may comprise a Hypalon® material or similar material that may be stitched and/or heat welded over the resistance band 150. The Hypalon® material or similar material of the resistor handle end sheath 142 that may be stitched and/or heat welded over the resistance band 150 may also form a loop 144 for a detachable and interchangeable securing member, such as a spring-loaded clip or carabiner 146 that may be comprised of a suitable material for repetitive use with force applied, such as a steel and aluminum material. The carabiner 146 may enable a user to indirectly and detachably couple the resistance band 150 to the modular handle portion 110. For example, the carabiner 146 may attach to the modular handle portion 110 at an attachment point, such as a hole 141 formed within the modular handle portion 110.

To indirectly and detachably couple the resistance band 150 to a dedicated foot anchor 390 (as shown and to be described for example in FIG. 3C), the resistance band 150 may feature an anchor attachment member 160 including a resistor anchor side sheath 161 comprising a Hypalon® material or similar material that may be stitched and/or heat welded over the resistance band 150. The Hypalon® material or similar material of the resistor anchor side sheath 161 that may be stitched and/or heat welded over the resistance band 150 may also form a loop 162 for a metal-gated hook 163. The metal-gated hook 163 may be configured based upon a standard construction for low profile and high strength, with a custom hook to attach to a dedicated foot anchor 390 (as shown and to be described for example in FIG. 3C). The metal-gated hook 163 may be attached and removed from a dedicated foot anchor 390, as shown and to be described for example in FIG. 3C.

Concerning the amount of resistance provided by the resistance bands 150, as shown in FIG. 1A, a resistance level may be determined by the length of the bands 150. In embodiments of the resistance walking device 100 featuring elastomeric resistance bands 150 that may indirectly and detachably couple to a dedicated foot anchor 390 and the modular handle portion 110, a resistance level of the resistance bands 150 may be increased by attaching a shorter resistance band 150 or decreased by attaching a more extended resistance band 150. A resistance level of the resistance band 150 may also be increased by attaching a more wide, thicker resistance band 150 or decreased by attaching a narrower, thinner resistance band 150. In addition, a resistance level of the resistance band 150 may also be increased by attaching a more broad, shorter resistance band 150 or decreased by attaching a narrower, longer resistance band 150. Additionally, different materials may be used for the resistance bands 150 that may provide more or less resistance for the user.

Referring again to FIG. 1A, a material of a resistance band 150 may include a latex/ethylene vinyl acetate EVA material, for example. A material of the resistor handle end sheath 142 may comprise a Hypalon® material or similar material that may be stitched and/or heat welded over the resistance band 150. A material of the resistor anchor side sheath 161 may comprise a Hypalon® material or similar material that may be stitched and/or heat welded over the resistance band 150.

Figure 1B:
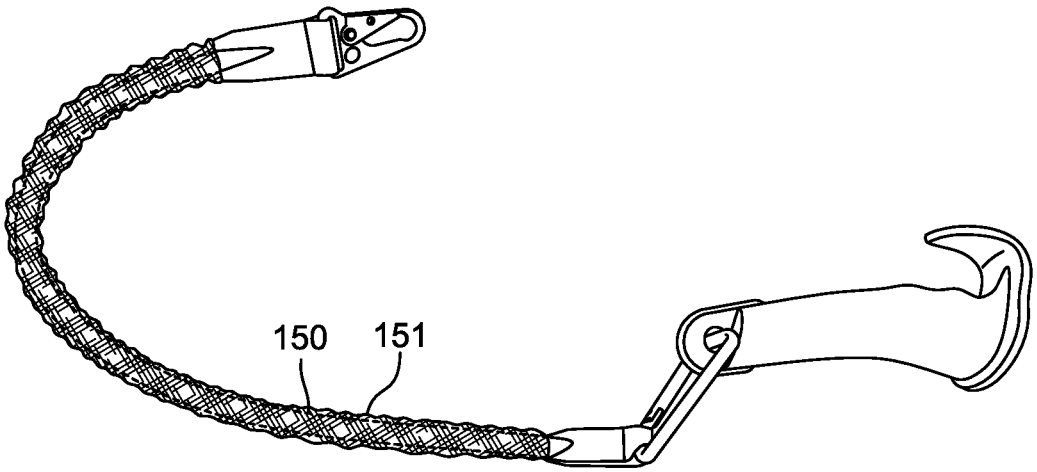
FIG. 1B is a perspective view of an embodiment of the variable resistance walking device with a dedicated foot anchor and ergonomic handle, including a display and network interface, with a protective waterproof material over a surface of the resistance band.

Referring to FIG. 1B, in an embodiment, each of the resistance bands 150 may further include a waterproof fabric 151 that may be wrapped around and line an exterior surface of the resistance band 150. The waterproof fabric 151 may serve as a liner to protect each resistance band 150 from wear and abrasion during outdoor use, for example. To accommodate the elasticity of a resistance band 150 when the resistance band 150 stretches during exercise by a user, the waterproof fabric 151 may also comprise a material suitable for providing an clastic quality to enable the material of the waterproof fabric 151 to stretch to cover the resistance band 150 when the resistance band 150 is stretched during use. The material of the waterproof fabric 151 may also be suitable to cover the resistance band 150 when the resistance band 150 returns to its pre-stretched condition. The waterproof fabric 151 may thus stretch and conform to the length of the resistance band 150 to cover the resistance band 150 as it stretches during use. It is understood that a material of the waterproof fabric 151 may be stitched and/or heat welded over the resistance band 150 at each end of the resistance band, so that the resistance band may stretch freely within the covering provided by the waterproof fabric 151, while the waterproof fabric 151 is secured to each end of the resistance band 150, such as on the resistor handle end sheath 142 and on the resistor anchor side sheath 161, as shown in FIG. 1A.

Figure 2:
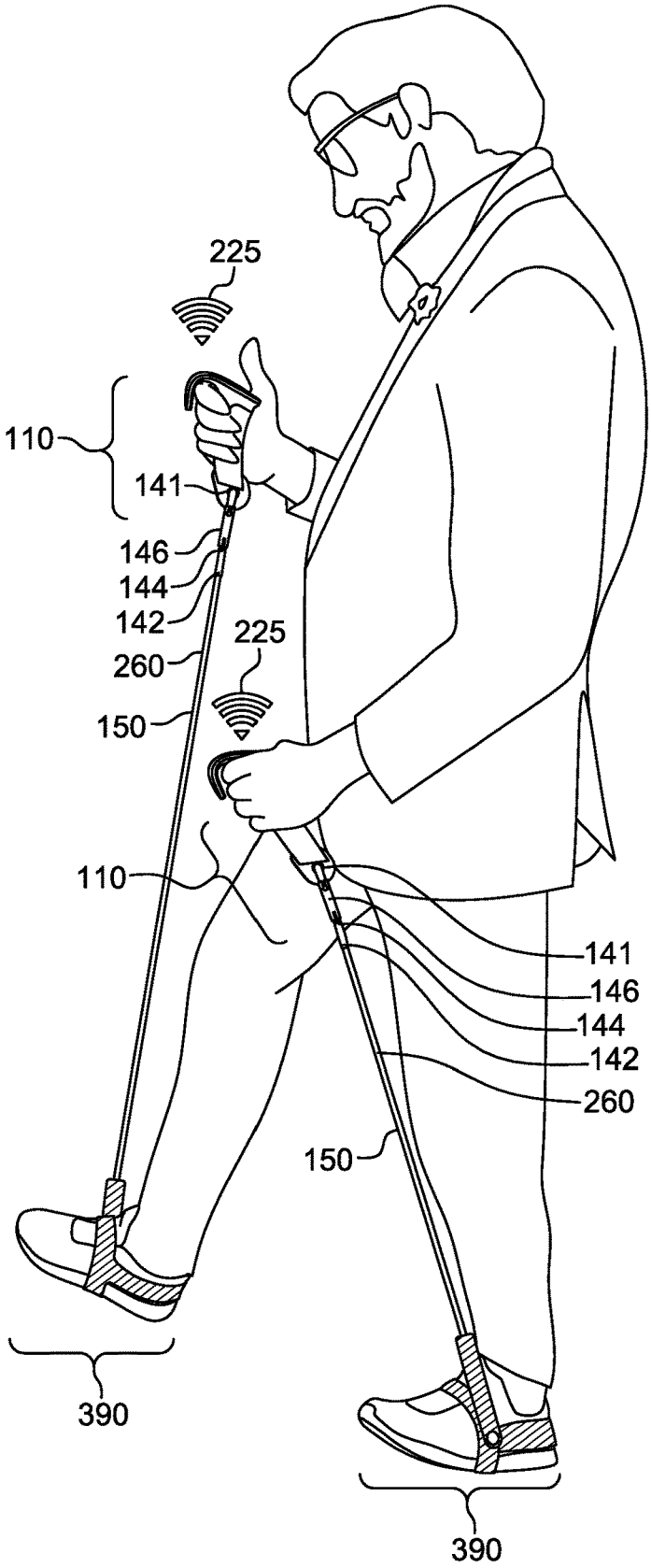
FIG. 2 is an exemplary view of a user exercising with an embodiment of the variable resistance walking device with a dedicated foot anchor and ergonomic handle, including a display and network interface.

Referring to FIG. 2, an exemplary illustration is provided of a user exercising with an embodiment of the variable resistance walking device 100 as shown in FIG. 1A with a modular handle portion 110 including a display and network interface in each of the user's hands and an anchor attachment member 160 secured to a dedicated foot anchor 390 at each of the user's feet. As shown in FIG. 2 in conjunction with FIG. 1A, the modular handle portion 110 including a display and network interface provides the user with an ergonomic and comfortable experience when exercising with the device 100, as the top 122 section with securing member 115 may extend over and around an upper portion of the user's hand to secure the modular handle portion 110 within the user's grasp. The user's hand may securely hold the modular handle portion 110 without requiring the user to clench the palm member 112 tightly within the user's hand.

Referring again to FIG. 2, in conjunction with FIG. 1A, the top 122 section of the modular handle portion 110 may include insertable electronic components 120, including a GUI or LED display that may reside within the modular handle portion 110. Accordingly, the modular handle portion 110 may feature wireless capability 225, including a rechargeable Bluetooth® battery and a network interface with wireless network connections in communication with at least one of the sensors mentioned above and the website via a network for communication of performance information that is tracked and measured by the one or more sensors in the modular handle portion 110.

In addition to the insertable electronic components 120 within the modular handle portion 110, the resistance band 150, as shown in FIG. 2, may also include an insert or slot region 260 within the resistance band 150 and just below the modular handle portion 110 for insertion of an LED light within the resistance band 150 and modular handle portion 110, so that the resistance band 150 may be lit from the inside of the resistance band 150 and modular handle portion 110, as a safety feature when utilizing the device 100 at night. It is understood that in such embodiments that comprise an insert or slot region 260 within the resistance band 150 for insertion of an LED light or another lighting device, a material of the resistance band 150 may be sufficiently transparent to enable the light provided by the LED light or other lighting device inserted within the slot region 260 of the resistance band 150 to be visible through the material of the resistance band 150. It is further understood that an LED light or other lighting device inserted within the slot region 260 of the resistance band 150 may include a wireless charging feature such as a rechargeable Bluetooth® battery or a battery that may be utilized to power a Bluetooth® communication component. It should also be noted that the color of the LED lights may be configured by the user or may automatically adjust based on the user's performance. This adjustment may be based on the number of steps, frequency of steps, portion of the complete walk, the resistance level of the band, a team that the user is part of, or any other factors.

As shown in the embodiment of FIG. 2, a user may select a desired resistance for exercise with the variable resistance walking device 100 by choosing longer or thinner resistance bands 150 of less resistance or shorter or thicker bands 150 of more excellent resistance. Accordingly, particular resistance bands 150 of predetermined resistance may be interchangeably implemented into the variable resistance walking device 100. Upon selecting a particular resistance band 150 of desired resistance, the resistance band 150 may then be indirectly and detachably coupled to the modular handle portion 110 or a dedicated foot anchor 390.

Figure 3A:
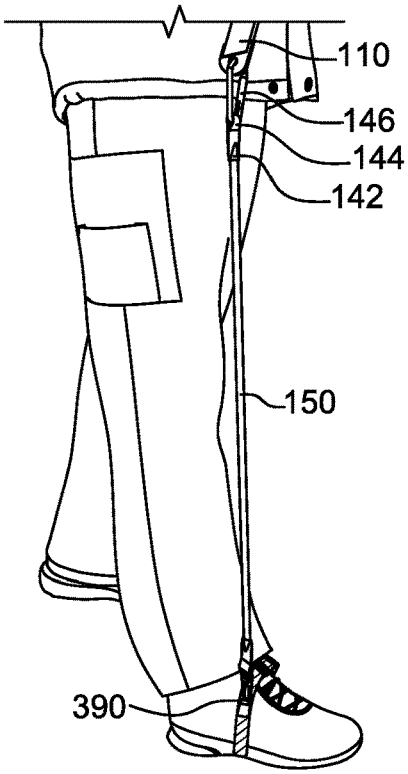
FIG. 3A is an additional exemplary view of a user exercising with an embodiment of the variable resistance walking device in which a resistance band is detachably coupled by a carabiner to a dedicated foot anchor and by another carabiner to an ergonomic handle.
Figure 3B:
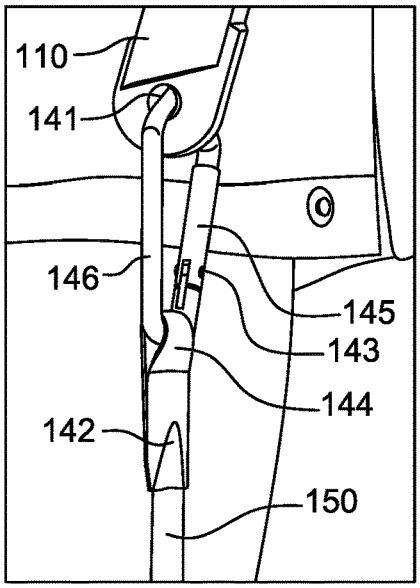
FIG. 3B is an additional exemplary view of an embodiment of the variable resistance walking device in which a resistance band is detachably coupled by a carabiner to an ergonomic handle.

Referring to FIGS. 3A and 3B, the carabiner 146 may enable a user to indirectly and detachably couple the resistance band 150 to the modular handle portion 110. For example, the carabiner 146 may attach to the modular handle portion 110 at an attachment point, such as a hole 141 formed within the modular handle portion 110. To indirectly and detachably couple the resistance band 150 to the modular handle portion 110, a Hypalon® material or similar material may be stitched and/or heat welded over the resistance band 150. The Hypalon® material or similar material of the resistor handle end sheath 142 that may be stitched and/or heat welded over the resistance band 150 may also form a loop 144 for carabiner 146.

Figure 3C:
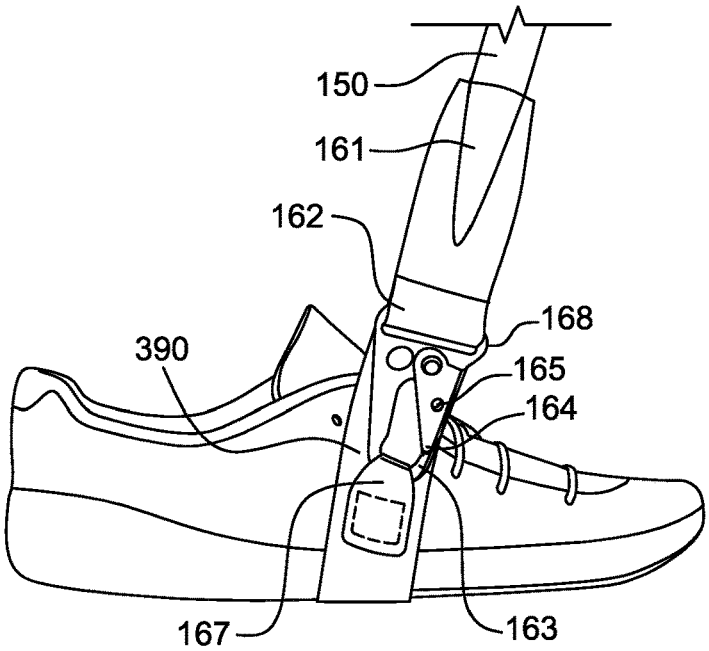
FIG. 3C is an additional exemplary view of an embodiment of the variable resistance walking device in which a resistance band is detachably coupled by a carabiner to a dedicated foot anchor.

To indirectly and detachably couple the resistance band 150 to a dedicated foot anchor 390 (as shown and to be described for example in FIG. 3C), a metal-gated hook 163 on an end of the resistance band 150 may be attached and removed from a dedicated foot anchor 390 (as shown and to be described for example in FIG. 3C). For example, the resistance band 150 may feature an anchor attachment member 160 (as shown in FIG. 1A) including a resistor anchor side sheath 161 comprising a Hypalon® material or similar material that may be stitched and/or heat welded over the resistance band 150. The Hypalon® material or similar material of the resistor anchor side sheath 161 that may be stitched and/or heat welded over the resistance band 150 may also form a loop 162 for the metal-gated hook 163. The metal-gated hook 163 may be configured based upon a standard construction with custom hook to attach to and remove from a dedicated foot anchor 390 (as shown and to be described for example in FIG. 3C).

Referring again to FIG. 3A, a perspective view of a resistance band 150 is shown that is attached to a user's foot at a dedicated foot anchor 390 at one end of the resistance band 150 and to modular handle portion 110 in the hand of the user at another end of the resistance band 150. As shown in FIG. 3B, the resistance band 150 is indirectly and detachably coupled to the modular handle portion 110. For example, to indirectly and detachably couple the resistance band 150 to the modular handle portion 110, a Hypalon® material or similar material may be stitched and/or heat welded over the resistance band 150. The Hypalon® material or similar material of the resistor handle end sheath 142 that may be stitched and/or heat welded over the resistance band 150 may also form a loop 144 for carabiner 146. The carabiner 146 may be inserted through the loop 144 to enable a user to indirectly and detachably couple the resistance band 150 to the modular handle portion 110. The carabiner 146 may include a spring loaded swinging leaver 145 that swings about the axis of a pin 143. As aforementioned, the carabiner 146 may serve as a detachable and interchangeable securing member for efficient and convenient detachable coupling between the resistance band 150 and the modular handle portion 110. The carabiner 146 may be a spring-loaded clip that may be comprised of a suitable material for repetitive use with force applied, such as a steel and aluminum material.

Referring again to FIG. 3A, the resistance band 150 may also be indirectly and detachably coupled to a dedicated foot anchor 390 as shown and to be described for example in FIG. 3C). As shown in FIG. 3C, the resistance band 150 may feature an anchor attachment member 160 (as shown in FIG. 1A) including a resistor anchor side sheath 161 comprising a Hypalon® material or similar material that may be stitched and/or heat welded over the resistance band 150. The Hypalon® material or similar material of the resistor anchor side sheath 161 that may be stitched and/or heat welded over the resistance band 150 may also form a loop 162 for the buckle hardware 168 of the metal-gated hook 163. The metal-gated hook 163 may be configured based upon a standard construction for low profile and high strength to attach to an attachment point or coupling member, such as a loop portion 167 of a dedicated foot anchor 390. The metal-gated hook 163 may include a spring loaded swinging leaver 164 that swings about the axis of a pin 165. The metal-gated hook 163 may be attached and removed from an attachment point or coupling member of the dedicated foot anchor 390, such as a loop portion 167 of the dedicated foot anchor 390, as shown in FIG. 3C. Although a metal-gated hook 163 is shown in the embodiment of FIG. 3C, it is understood that a carabiner, similar to the carabiner 146 as shown and described relative to FIG. 3B, may be implemented instead of a metal-gated hook 163, so that the resistance band 150 may also be indirectly and detachably coupled to a dedicated foot anchor 390 based upon the functionality of a carabiner, similar to the carabiner 146. The metal-gated hook 163 as shown in the embodiment of FIG. 3C may provide and serve as a detachable and interchangeable securing member between the resistance band 150 and the dedicated foot anchor 390 for efficient and convenient detachable coupling between the resistance band 150 and the dedicated foot anchor 390. The metal-gated hook 163 that may include a spring loaded swinging leaver 164 that swings about the axis of a pin 165 may therefore provide a spring-loaded clip or carabiner that may be comprised of a suitable material for repetitive use with force applied, such as a steel and aluminum material.

Figure 4A:
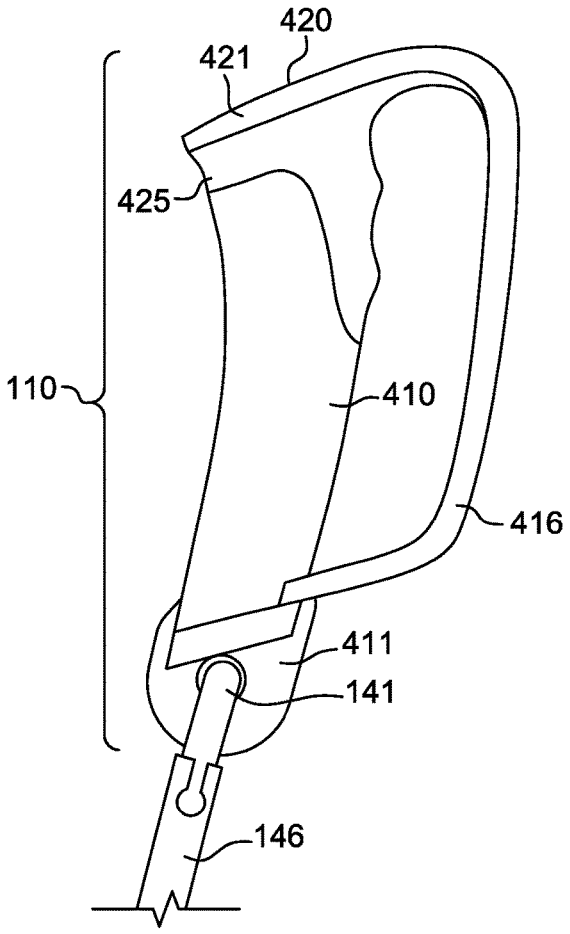
FIG. 4A is a perspective view of an embodiment of an ergonomic handle, including a display and network interface, in which a securing member provides a complete loop to enclose the palm member of the handle.
Figure 4B:
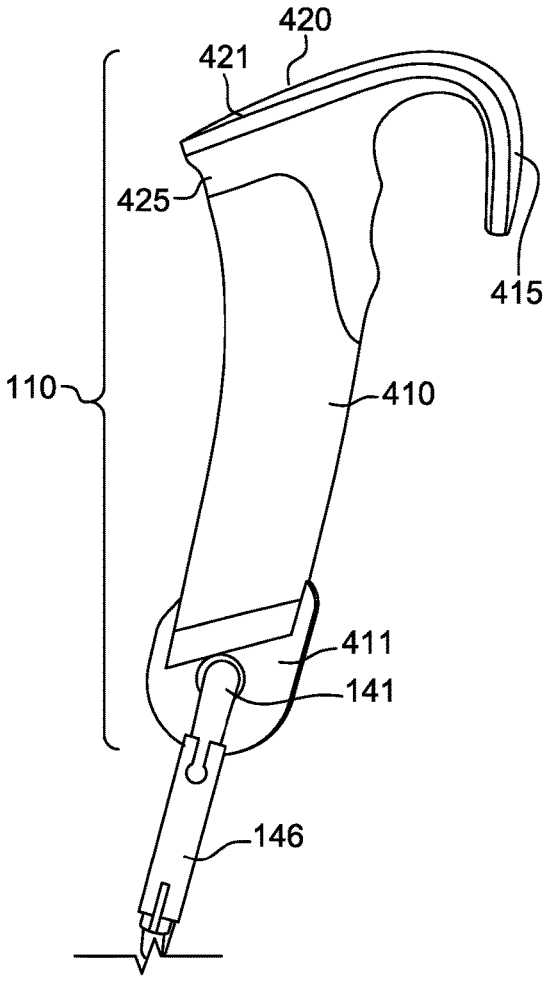
FIG. 4B is an additional perspective view of an embodiment of an ergonomic handle, including a display and network interface in which a securing member provides a partial loop over the palm member of the handle.

Referring to FIGS. 4A and 4B, perspective views of embodiments of the modular handle portion 110 as implemented in the variable resistance walking device 100 of FIG. 1A are illustrated for additional reference. As shown in the embodiments of FIGS. 4A through 4B, the modular handle portion 110 may provide an ergonomic and comfortable grip when exercising and includes a palm member 410 configured to meet the palm of a user's hand, a securing member 415, 416 that protrudes outward from and adjacent to the palm member 410, and a cushion member 425 comprising a material that may be softer than a material of the palm member 410. The palm member 410 may extend linearly toward the securing member 415, 416 adjacent to the palm member 410. When a user grasps the palm member 410, the securing member 415, 416 may extend over and around an upper portion of a user's hand to secure the modular handle portion 110 within the user's grasp. The configuration of the securing member 415, 416 adjacent to the palm member 410 may provide a comfortable and ergonomic space for the user's hand to securely hold the modular handle portion 110 without requiring the user to clench the palm member 410 tightly within the user's hand. The securing member 415 as shown in FIG. 4B may also serve as a "hook" to attach the modular handle portion 110 onto a user's waist band, pocket or belt loop when the user wants to have hands free and not hold the modular handle portion 110.

As shown in the embodiments of the modular handle portion 110 in FIGS. 4A through 4B, the palm member 410 may extend linearly from top to bottom in the same axis as the resistance band 150 (as shown in FIG. 1A), thereby alleviating carpal tunnel stress while providing an additional ergonomic configuration of the modular handle portion 110 relative to a user's pulling force against the resistance of a band 150. In addition, as shown in the embodiment of the modular handle portion 110 as shown in FIG. 4A, the securing member 416 may provide a complete loop to enclose the palm member 410, to secure a user's grip within the securing member 416. In addition, as shown in the embodiment of FIG. 4B, the securing member 415 may provide a partial loop to secure a user's grip within the partial loop of the securing member 415. Based on the configurations of the securing member 415, 416 as shown in FIGS. 4A and 4B, a user may relax a hand-held grip of the palm member 410 so that it is not necessary to firmly grasp the palm member 410 when holding the modular handle portion 110.

Referring again to FIGS. 4A through 4B, an upper portion of the palm member 410 may also feature a cushion member 425 comprising a material that may be softer than a material of the palm member 410. A cushion member 425 may meet a top region of a user's hand when the user grasps the palm member 410. When a user grasps the palm member 410 with cushion member 425 and exerts a force against the cushion member 425 to stretch the resistance band 150, the user's hand may exert force against the cushion member 425 to provide force to stretch resistance of a band 150. In such a configuration, it may not be necessary for the user to tightly grasp the palm member 410 with cushion member 425 since a user may instead effectively stretch the resistance band 150 based upon the force applied to the cushion member 425. As such, an embodiment of the resistance walking device 100 that includes a cushion member 425 in the modular handle portion 110 may also alleviate carpal tunnel stress when a user exerts a force against the resistance of a band 150.

As will be described in further detail, the modular handle portion 110 as shown in FIGS. 4A through 4B may also include a press-fit or threaded removable capsule bezel 421 (also illustrated and described in FIGS. 14A and 14B) that secures the insertable electronic components 420, including a GUI or LED display that may reside within the modular handle portion 110. Depending on the relative size of the insertable electronic components 420, the insertable electronic components 420 may reside partially or entirely within the palm member 410 of the modular handle portion 110. The removable capsule bezel 421 may be removed to place and install insertable electronic components 420. The insertable electronic components 420 may indicate a desired exercise metric, such as the number of steps taken by a user or a user's oxygen consumption when exercising with the variable resistance walking device 100. It is understood that the insertable electronic components 420 may also include sensors such as a force gauge to measure the amount of force exerted by a user when exerting a pulling force against a resistance of a band 150. Sensors may also include an accelerometer to measure repetitions based on the displacement of a band 150 via stretching movements. Sensors in the device, as disclosed herein, may also include a gyroscope to measure orientation in space and angular velocity. Additional insertable electronic components 420 that may be implemented within the modular handle portion 110 of the resistance walking device 100 may include an internal battery component that may be utilized to power a Bluetooth® communication component. Insertable electronic components 420 within the modular handle portion 110 may include a network interface in communication with at least one of the sensors above and a website via a network. The network interface may include a processor and a memory and may be in communication with input and output devices with wireless network connections for sharing of performance information that is tracked and measured by one or more sensors in the modular handle portion 110.

Referring again to FIGS. 4A through 4B, in conjunction with FIG. 1A, the resistance bands 150 may indirectly and detachably couple to the modular handle portion 110. For example, the carabiner 146 may enable a user to indirectly and detachably couple the resistance band 150 to the modular handle portion 110. In the embodiments of FIGS. 4A and 4B, the carabiner 146 that is detachably coupled to the resistance band 150 may attach to the modular handle portion 110 at an attachment point, such as a hole 141 formed within a bottom portion 411 of the modular handle portion 110. As shown in the embodiments of the modular handle portion 110 in FIGS. 4A and 4B, the bottom portion 411 may be a separate portion of the modular handle portion 110, so that the bottom portion 411 is apart and separate from the palm member 410 that may house and contain the insertable electronic components 420. The bottom portion 411 with hole 141 may provide the modular handle portion 110 with a point for the detachable coupling of the resistance band 150 without detracting from the space within the palm member 410 that may be dedicated to housing and containing the insertable electronic components 420.

Figure 15A:
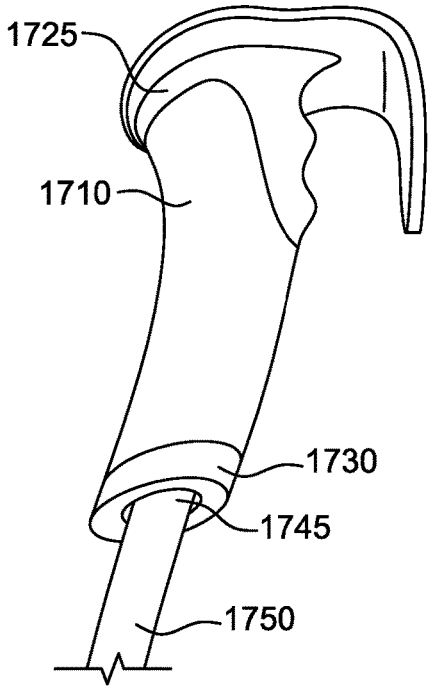
FIG. 15A is a perspective view of another embodiment of an ergonomic handle, including a threaded member that has been detachably coupled within a bottom receiving member of the handle.

In embodiments of the modular handle portion 110 as shown in FIGS. 4A and 4B, because the resistance band 150 may attach to the modular handle portion 110 at an attachment point such as a hole 141 formed within a bottom portion 411 of the modular handle portion 110, the palm member 410 of the modular handle portion 110 may be dedicated, in part, to including a large interior area for purposes of housing the insertable electronic components 420. The embodiment of the modular handle portion 110 as shown in FIGS. 4A and 4B may therefore provide a larger interior area for purposes of housing the insertable electronic components 420 and PCB board than an embodiment of the modular handle portion 1210 as shown in FIG. 15A, for example, in which the resistance band 1750 runs up inside the modular handle portion 1210. In the embodiment of the modular handle portion 1210 as shown in FIG. 15A, a threaded attachment member 1730 (also shown in FIG. 15B), may include threads 1735 that may be screwed into and attached within a lower portion of the modular handle portion 1210. As shown in FIG. 15A, the resistance band 1750 may extend through the opening 1745 of the threaded attachment member 1730, and the threaded attachment member 1730 may reside within an interior area of a lower portion of the modular handle portion 1210. In the embodiment of the modular handle portion 1210 as shown in FIG. 15A, a portion of the interior area of the palm member 1710 may therefore house the insertable electronic components, in addition to at least the threaded attachment member 1730 and a portion of the resistance band 1750 when the resistance band 1750 is detachably coupled to the modular handle portion 1210. In embodiments of the modular handle portion 110 as shown in FIGS. 4A and 4B, the interior area of the palm member 410 of the modular handle portion 110 may house and contain a larger area of insertable electronic components 420 and PCB board because the resistance band 150 may attach to the modular handle portion 110 at an attachment point, such as a hole 141 formed within a bottom portion 411 of the modular handle portion 110.

Referring again to FIGS. 4A and 4B, as understood by those of skill in the art, the components of the modular handle portion 110 as described in the embodiments disclosed herein may be formed based upon a PC/ABS injection molding process using nylon or similar parts in conjunction with overmolded or insert molded EVA/PTU components of the modular handle portion 110. For example, the cushion member 425 may be formed based upon an overmolded elastomer. The palm member 410 of the modular handle portion 110 may also be formed based upon an overmolding process. A material of the modular handle portion 110 at a bottom portion 411 and at the hole 141 formed within a bottom portion 411 of the modular handle portion 110 may also comprise a wear-resistant plastic material suitable for repetitive use with force applied from the carabiner 146 that may be detachably coupled to the modular handle portion 110 at the hole 141 formed within the bottom portion 411 of the modular handle portion 110. It is to be further understood that the components of the modular handle portion 110 as described in the embodiments disclosed herein may also be formed based upon 3-D printing processes and 3-D printed models.

Figure 5A:
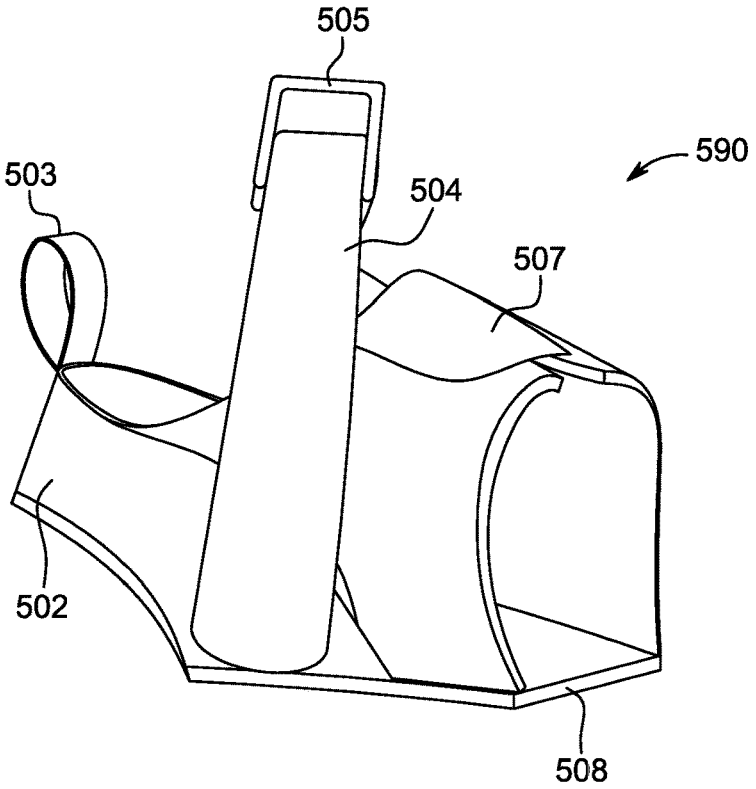
FIG. 5A is an embodiment of a dedicated foot anchor that may be implemented with a resistance band and modular handle portion of the herein described embodiments of the variable resistance walking device.
Figure 5B:
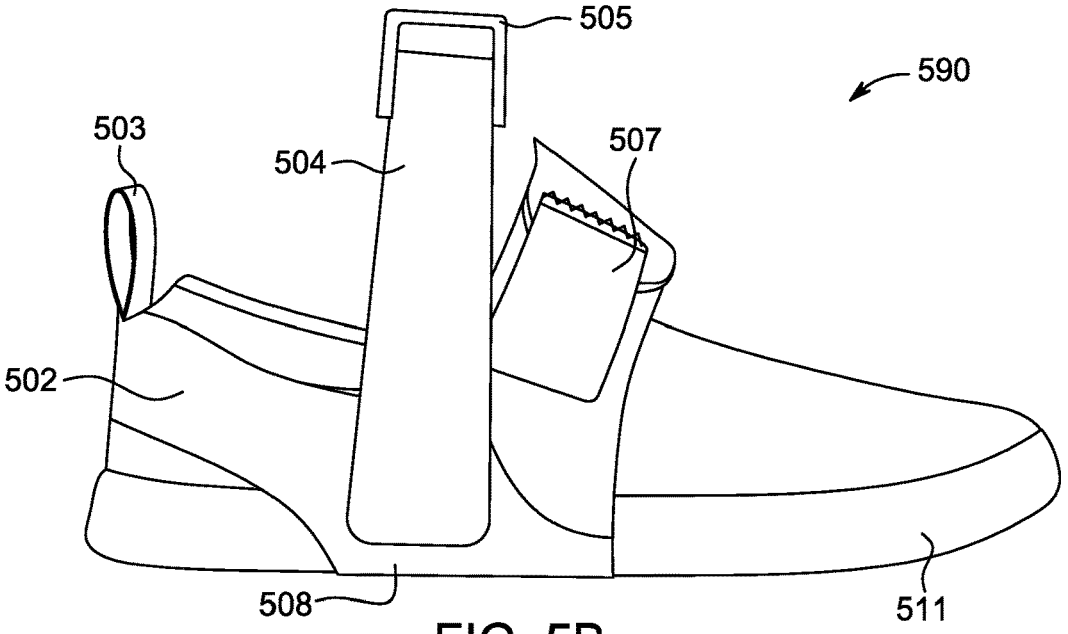
FIG. 5B is a view of an embodiment of a dedicated foot anchor in which a shoe has been secured within the dedicated foot anchor as shown in FIG. 5A.

Referring to FIGS. 5A and 5B, in conjunction with FIG. 1A, another embodiment of a dedicated foot anchor 590 is shown that may be implemented with a resistance band 150 and modular handle portion 110 of the herein described embodiments. As shown in FIGS. 5A and 5B, the dedicated foot anchor 590 may include a resistor band attachment portion 505 that may be utilized to detachably couple the dedicated foot anchor 590 to a resistance band 150. The resistor band attachment portion 505 may be a metal clip or metal loop that provides an attachment point for a carabiner or a metal-gated hook 163, at the bottom of a resistance band 150, to hook or attach to the resistor band attachment portion 505 of the dedicated foot anchor 590.

In use, a heel of a user's walking shoe 511 such as a sneaker (as shown in FIG. 5B), may slide into a strap 502 at the back of the dedicated foot anchor 590. The strap 502 may be adjustable to fit different shoe sizes. A loop member 503 may assist the user to help pull the strap 502 over the user's shoe. The user's shoe may then be secured by a one-strap Velcro® closing 507 that wraps over the user's foot and then locks down at the tongue of the user's shoe with the one-strap Velcro® closing 507. The resistor strap 504 may be secured to the dedicated foot anchor 590 via rubber nails or by a stitched hinge. The resistor strap 504 with resistor band attachment portion 505 may allow a carabiner or a metal-gated hook 163, at the bottom of a resistance band 150, to hook to the resistor band attachment portion 505 of the dedicated foot anchor 590. Based on the dedicated foot anchor 590 as shown in FIGS. 5A and 5B, a user may pull up each step taken with their own body weight.

As further shown in FIGS. 5A and 5B, the resistor strap 504 with resistor band attachment portion 505 resides on an outside portion of a user's shoe. Based on the positioning of the resistor strap 504 with resistor band attachment portion 505 on an outside of a user's shoe, the resistance band 150 does not contact the user's knee or interfere with the user's leg movement during the user's exercise with the variable resistance walking device 100 as described herein. Further, because a construction of the dedicated foot anchor 590 disposes the resistor strap 504 with resistor band attachment portion 505 on an outside of a user's shoe, as shown in FIGS. 5A and 5B, even when resistance is applied to the resistance band 150 and a user pulls up on the resistance band 150, the resistor strap 504 with resistor band attachment portion 505 stays on an outside of the user's foot and does not migrate to the center of the user's foot. As such, the resistance band 150 does not contact the user's knee or interfere with the user's leg movement during the user's exercise with the variable resistance walking device 100 as described herein.

Referring again to the dedicated foot anchor 590 as shown in FIGS. 5A and 5B, a sole 508 of the dedicated foot anchor 590 may feature an abrasion-resistant material with a traction grip. Based upon the abrasion-resistant material of the sole 508 with a traction grip, a user's shoe may advantageously prevent the sole of a user's shoe from slipping on the surface of the sole 508 when the user's shoe or sneaker is secured within the dedicated foot anchor 590 for use with the variable resistance walking device 100 as described herein. In addition, the abrasion-resistant material of the sole 508 with a traction grip may also prevent a user from slipping on a surface of the ground or floor when exercising on various indoor and outdoor surfaces with the variable resistance walking device 100 as described herein.

Referring to FIG. 5C through 5F, another embodiment of a dedicated foot anchor 591 is shown that may be implemented with the variable resistance walking device 100 as described herein. As shown in FIGS. 5C through 5F, the dedicated foot anchor 591 provides for an adjustable sleeve 592 that may slide over a user's foot. The adjustable sleeve 592 may be adjusted for size to accommodate a user's foot size and shape. The adjustable sleeve 592 may be adjusted and secured to the user's foot based upon a Velcro® portion of the adjustable sleeve 592. The dedicated foot anchor 591 as shown in FIGS. 5C through 5F may fit over a user's foot (rather than a user's shoe) so that the dedicated foot anchor 591 may also go inside the user's shoe when the user's foot is inside the user's shoe.

Figure 5C:
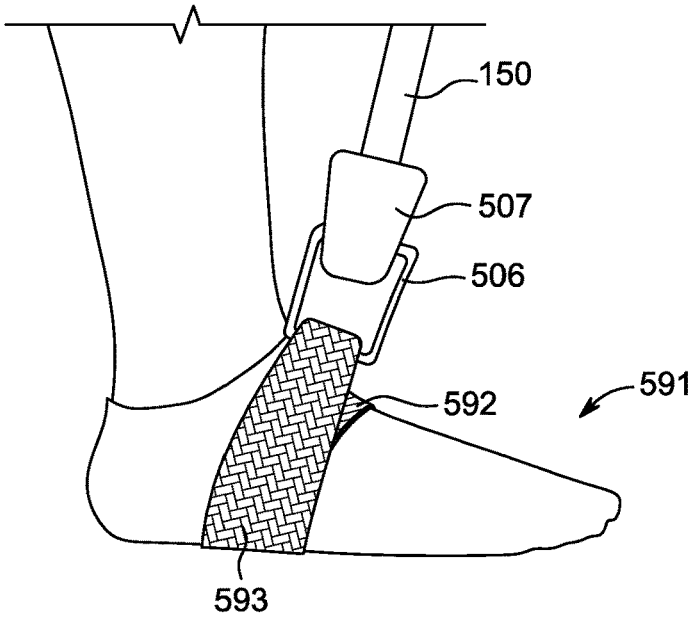
FIG. 5C is a perspective view of an outside portion of a user's foot showing another embodiment of a dedicated foot anchor that may reside over a user's foot and inside the user's shoe.
Figure 5D:
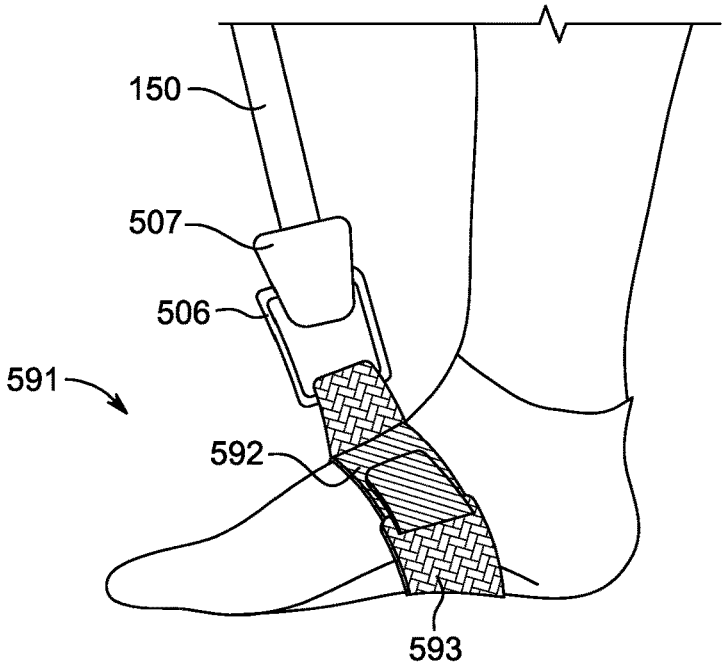
FIG. 5D is a perspective view of an inside portion of a user's foot showing the embodiment of the dedicated foot anchor as shown in FIG. 5C that may reside over a user's foot and inside the user's shoe.
Figure 5E:
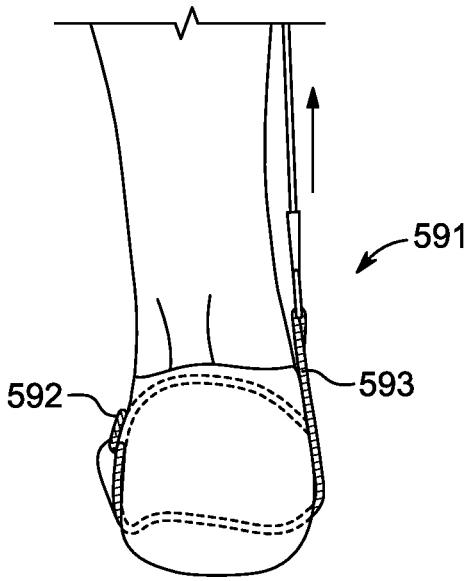
FIG. 5E is a perspective view of a rear portion of a user's foot showing the embodiment of the dedicated foot anchor as shown in FIGS. 5C and 5D that may reside over a user's foot and inside the user's shoe.
Figure 5F:
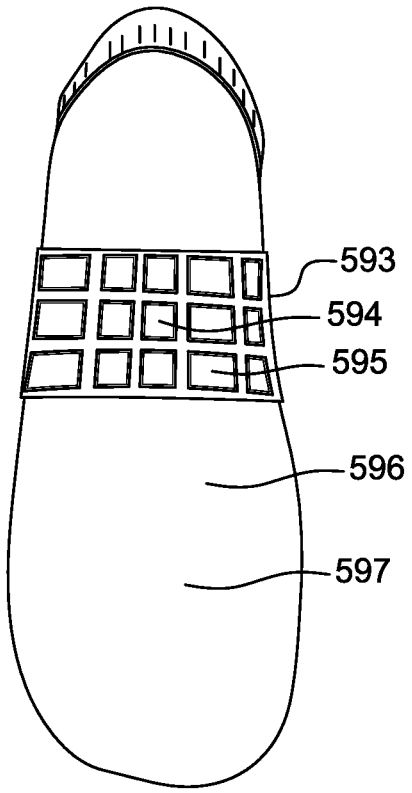
FIG. 5F is a perspective view of a friction element of a dedicated foot anchor as shown in the embodiments of FIGS. 5C through 5E.

As shown in FIG. 5C through 5F, an additional sleeve member 593 may couple to the adjustable sleeve 592. The additional sleeve member 593 may wrap around a bottom of the user's foot (as shown in FIGS. 5E and 5F) and extend upwardly on an outside of the user's foot to attach to a resistor band attachment portion 506 of the dedicated foot anchor 591. The resistor band attachment portion 506 may be a metal clip or metal loop that provides an attachment point for a hardware 507 of the resistance band 150, such as a carabiner or a metal-gated hook 163, at the bottom of a resistance band 150, to hook or attach to the resistor band attachment portion 506 of the dedicated foot anchor 591. The additional sleeve member 593 with resistor band attachment portion 506 may allow a carabiner or a metal-gated hook 163, at the bottom of a resistance band 150, to hook to the resistor band attachment portion 506 of the dedicated foot anchor 591.

As shown in FIG. 5E illustrating the rear portion of a user's foot 596 (the foot also shown in FIG. 5F) with the embodiment of the dedicated foot anchor 591 as shown in FIGS. 5C and 5D, the adjustable sleeve 592 may slide over and reside on a top surface of a user's foot 596 (as indicated by the dotted line showing the adjustable sleeve 592 over the top of the user's foot). As aforementioned, the adjustable sleeve 592 may be adjusted for size to accommodate a user's foot size and shape. The adjustable sleeve 592 may be adjusted and secured to the user's foot 596 based upon a Velcro® portion of the adjustable sleeve 592.

Referring again to FIG. 5E, the additional sleeve member 593 may couple to the adjustable sleeve 592. The additional sleeve member 593 may wrap around a bottom of the user's foot 596 (as shown in FIGS. 5E and 5F and as indicated in FIG. 5E by the dotted line showing the additional sleeve member 593 wrapping underneath the bottom of the user's foot) and extend upwardly on an outside of the user's foot to attach to a resistor band attachment portion 506 of the dedicated foot anchor 591, as shown in FIGS. 5C and 5D.

Referring again to FIGS. 5C through 5F, a material of the additional sleeve member 593 may be a different material than the material of the adjustable sleeve 592. It is to be understood that a bottom surface of the additional sleeve member 593 that may wrap around a bottom of the user's foot 596 (as shown in FIGS. 5E and 5F) may comprise a friction element 594, such as an over molded friction grip to ensure that the dedicated foot anchor 591 does not shift on the user's foot 596 within the user's shoe when the user pulls up on the resistance band 150 during exercise with the variable resistance walking device 100 as described herein. For example, the friction element 594 may comprise a material such as a rubber material or other suitable material that may provide a resistive friction against a sock 597, such as a cotton sock, worn by a user when wearing the dedicated foot anchor 591. The friction element 594 may be a contiguous friction element, such as a singular piece of resistive rubber that covers a majority of a portion of the sole of a user's foot 596, for example, or a plurality of smaller resistive circular or square shaped portions 595 (as shown in FIG. 5F) that together provide a friction element against a surface of a user's sock 597. Because the bottom surface of the additional sleeve member 593 that may wrap around a bottom of the user's foot 596 (as shown in FIG. 5F) may comprise a friction element 594 to hold the dedicated foot anchor 591 in place within the user's shoe (to prevent migration of the dedicated foot anchor 591 within the user's shoe during exercise), the friction element 594 may distribute the force from the resistance band 150 during exercise to the dedicated foot anchor 591. The friction element 594 at the bottom, sole surface of the additional sleeve member 593 may cover a portion or an entire area of the sole of a user's foot 596 when the user is wearing the dedicated foot anchor 591. While a material of both the adjustable sleeve 592 and the additional sleeve member 593 may be a suitable material to withstand repetitive use and force during exercise with the variable resistance walking device 100 as described herein, a material of the additional sleeve member 593 including the friction element 594 of the additional sleeve member 593 may be further reinforced by a material suitable to withstand the repetitive force applied by the user when pulling the resistance band 150 that may be attached to the resistor band attachment portion 506 of the dedicated foot anchor 591.

As further shown in FIGS. 5C and 5D, the additional sleeve member 593 with resistor band attachment portion 506 resides on an outside of a user's shoe. Based on the positioning of the additional sleeve member 593 with resistor band attachment portion 506 on an outside of a user's shoe, the resistance band 150 does not contact the user's knee or interfere with the user's leg movement during the user's exercise with the variable resistance walking device 100 as described herein. Further, because a construction of the dedicated foot anchor 591 disposes the additional sleeve member 593 with resistor band attachment portion 506 on an outside of a user's shoe, as shown in FIGS. 5C and 5D, even when resistance is applied to the resistance band 150 and a user pulls up on the resistance band 150, the additional sleeve member 593 with resistor band attachment portion 506 stays on an outside of the user's foot and does not migrate to the center of the user's foot. As such the resistance band 150 does not contact the user's knee or interfere with the user's leg movement during the user's exercise with the variable resistance walking device 100 as described herein.

Figure 6A:
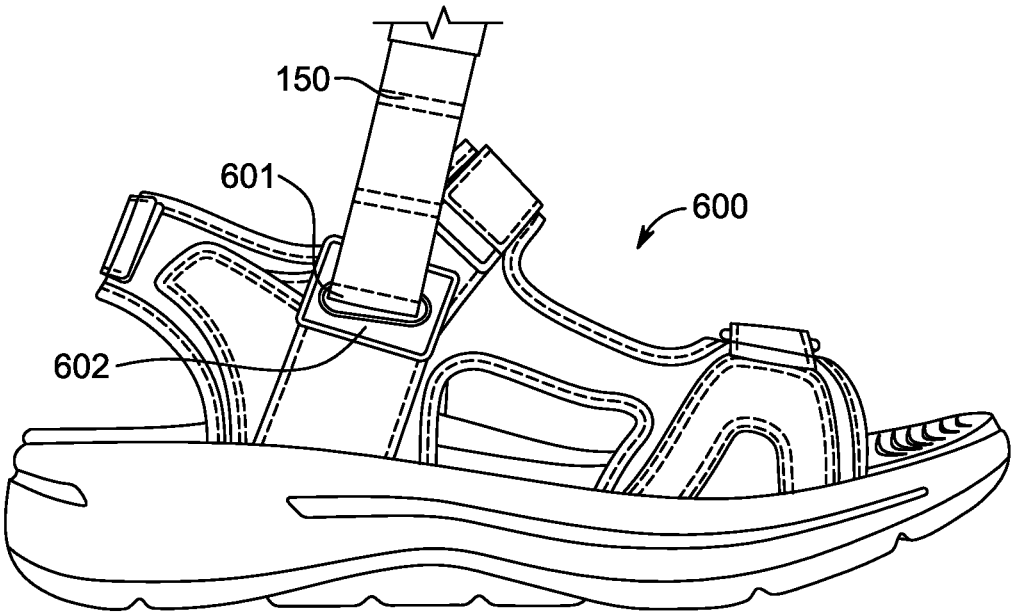
FIG. 6A is an embodiment of an anchor sandal with a clip mechanism that may be sewn into a construction of the anchor sandal, where a resistance band is detachably coupled to the anchor sandal at the clip mechanism.
Figure 6B:
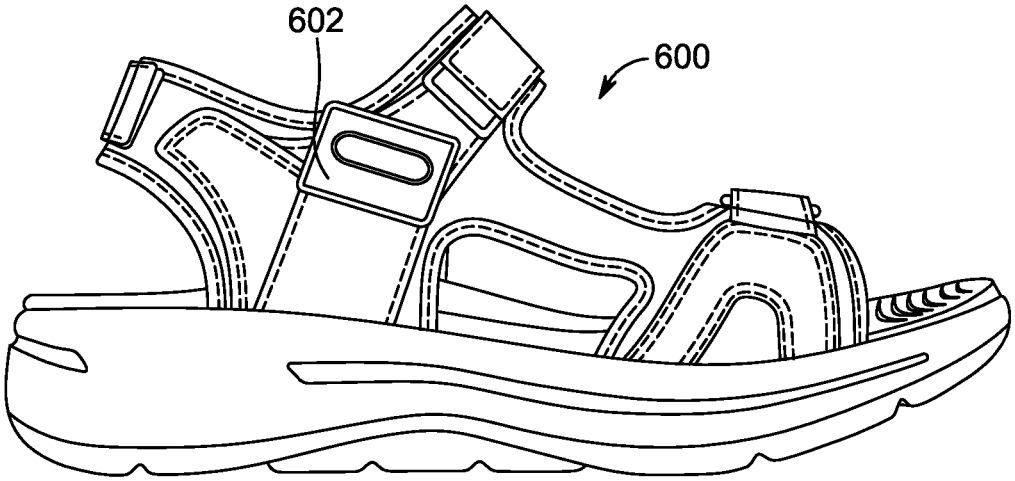
FIG. 6B is another view of an exemplary anchor sandal with an clip mechanism that may be sewn into a construction of the anchor sandal to provide an attachment point for a resistance band.

Referring to FIGS. 6A and 6B, an exemplary embodiment of an anchor sandal 600 may comprise an attachment point or clip mechanism 602 that may be sewn into a construction of the anchor sandal 600 of the variable resistance walking device 100. A resistor band 150 and modular handle portion 110, as shown in FIG. 1A, may be detachably coupled via a clip member 601 on an end of the resistor band 150 to the attachment point or clip mechanism 602 that is sewn into a construction of the anchor sandal 600. It is understood that an anchor sandal 600 may be implemented in various embodiments of the variable resistance walking device as disclosed herein. In FIG. 6A, an exemplary embodiment of an anchor sandal 600 is shown in which a resistor band 150 has been attached or clipped onto the anchor sandal 600 at the attachment point 602. In FIG. 6B, the resistor band 150 has been detached or unclipped from the anchor sandal 600 at the attachment point 602.

Figure 7A:
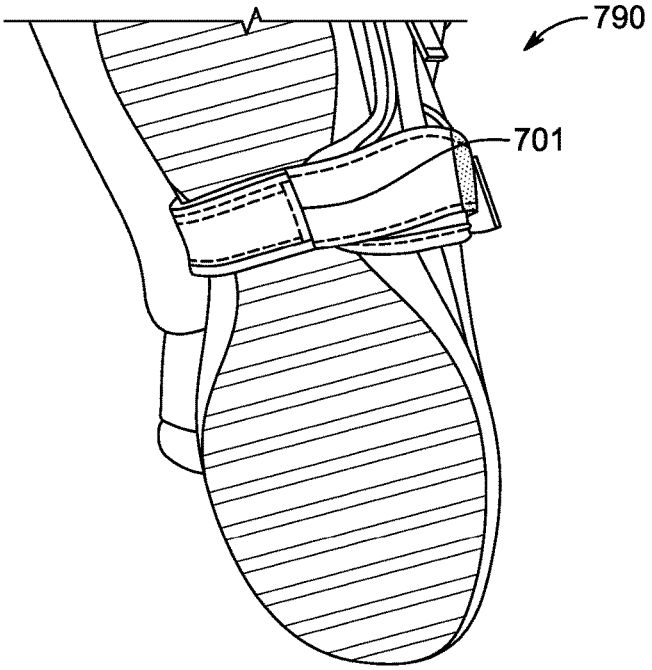
FIG. 7A is an embodiment of a foot anchor of the resistance walking device that may utilize an adjustable strap that wraps around a bottom of the user's shoe to secure the dedicated foot anchor to the user's shoe.
Figure 7B:
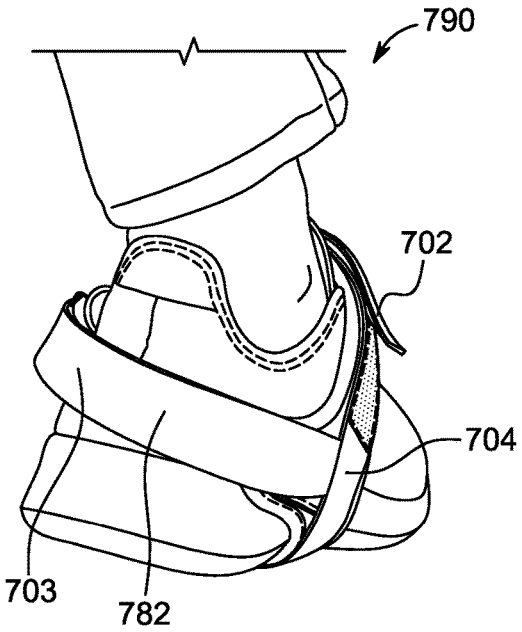
FIG. 7B is a view of an embodiment of a foot anchor of the resistance walking device that may utilize adjustable straps extending over a user's instep and heal and sole regions to secure the dedicated foot anchor to the user's shoe.
Figure 7C:
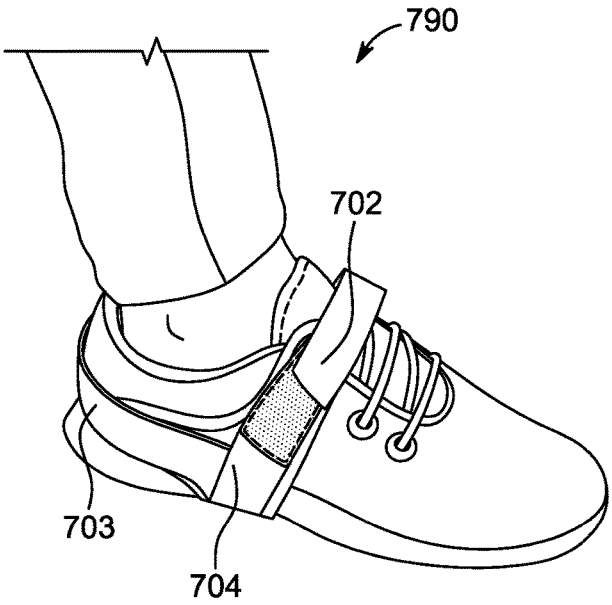
FIG. 7C is an additional view of an embodiment of a foot anchor of the resistance walking device that may utilize adjustable straps extending over a user's instep and heal and sole regions to secure the dedicated foot anchor to the user's shoe.

Referring to FIGS. 7A through 7C, another exemplary embodiment of a dedicated foot anchor 790 is shown that may securely fasten a resistance band 150 and a modular handle portion 110, as shown in FIG. 1A, to a user's foot accessory, such as a shoe, hiking boot, or sneaker, for example. As shown in FIG. 7A, the dedicated foot anchor 790 of the resistance walking device 100 may utilize a Velcro® strap 701 that wraps around a bottom of the user's shoe to secure the dedicated foot anchor 790 to the user's shoe. As further shown in FIGS. 7B and 7C, the dedicated foot anchor 790 may also include an adjustable Velcro® instep strap 702 extending over a user's instep region and an adjustable Velcro® heal strap 703. The adjustable Velcro® instep strap 702 and heal strap 703 secure the foot anchor 790 to a user's shoe. In addition, in an embodiment, the adjustable Velcro® heal strap 703 may also feature a rechargeable Bluetooth® battery-operated safety light 782 that may removably attach to the heal strap 703. Together, the adjustable Velcro® instep strap 702, adjustable Velcro® heal strap 703, and Velcro® strap 701 that wraps underneath at a bottom of the user's shoe secure the foot anchor 790 to a user's shoe.

Referring again to FIGS. 7B and 7C, the dedicated foot anchor 790 may also include an attachment point 704 located on a side of the adjustable Velcro® instep strap 702 of the dedicated foot anchor 790. In an embodiment, the attachment point 704 on the side of the adjustable Velcro® instep strap 702 may include a rubber nail or rivet that is configured to detachably couple to a resistance band 150. In another embodiment, the attachment point 704 of the dedicated foot anchor 790 may comprise an integrated loop or hook portion similar to the loop portion 167 of the dedicated foot anchor 390, as shown in FIG. 3C, that is sewn or heat pressed on the attachment point 704. In an embodiment of the dedicated foot anchor 790 including an attachment point 704 comprising an integrated loop or hook portion similar to the loop portion 167 of the dedicated foot anchor 390, as shown in FIG. 3C, a metal-gated hook 163 as shown in the embodiment of FIG. 3C, or a carabiner, similar to the carabiner 146 as shown and described relative to FIG. 3A, may attach and hook onto the attachment point 704 comprising an integrated loop or hook portion similar to the loop portion 167 of the dedicated foot anchor 390, as shown in FIG. 3C. The attachment point 704 may provide a coupling member of the dedicated foot anchor 390, for a detachable coupling of the metal-gated hook 163 as shown in the embodiment of FIG. 3C, or a carabiner, similar to the carabiner 146 as shown and described relative to FIG. 3A.

Based on the location of the attachment point 704 on the side of the adjustable Velcro® instep strap 702, a resistance band 150 may extend from an outside surface rather than an inside arch surface of a user's shoe. As such, a resistance band 150 may extend along the outer side of a user's leg, rather than the inner side of a user's leg, to provide an ergonomic and comfortable experience when exercising with the resistance walking device 100.

Referring again to the exemplary embodiment of a dedicated foot anchor 790 as shown in FIGS. 7A through 7C, a material of the foot anchor 790 may comprise a Hypalon® material or similar material that may be a wear-resistant material suitable for repetitive use with force applied.

Figure 8A:
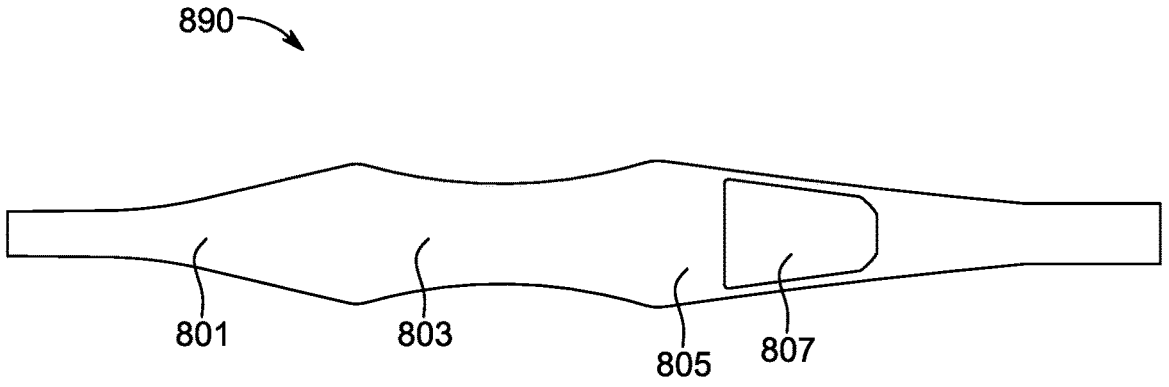
FIG. 8A is a diagram of another embodiment of a foot anchor of the resistance walking device that may utilize an inner section, a sole section, and an outer body section to secure the dedicated foot anchor to the user's shoe.
Figure 8B:
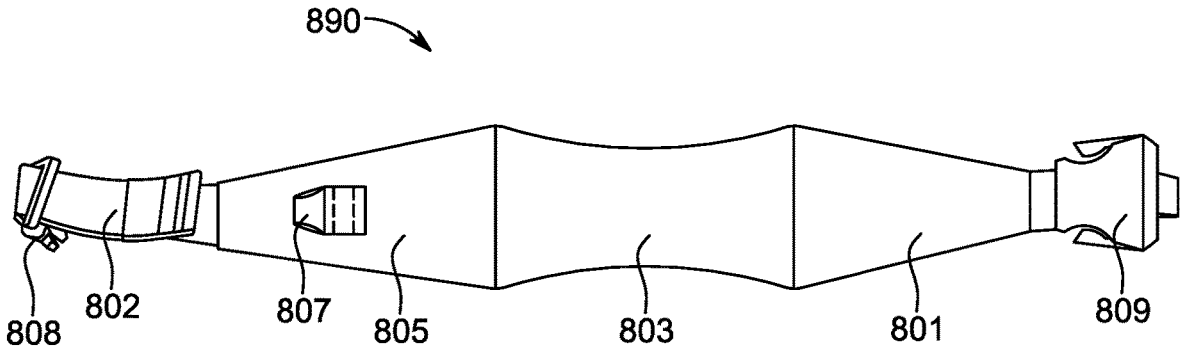
FIG. 8B is a perspective view of an embodiment of a foot anchor of the resistance walking device that may utilize an inner section, a sole section, and an outer body section to secure the dedicated foot anchor to the user's shoe.

Referring to FIGS. 8A and 8B, another exemplary embodiment of a dedicated foot anchor 890 is shown that may securely fasten a resistance band 150 and a modular handle portion 110, as shown in FIG. 1A, to a user's foot accessory, such as a shoe, hiking boot, or sneaker, for example. As shown in FIGS. 8A and 8B, a dedicated foot anchor 890 may be comprised of a Hypalon® material or similar material and include an inner section 801, a sole section 803 configured for positioning on the bottom sole of a user's shoe, and an outer body section 805. As shown in FIG. 8B, the dedicated foot anchor 890 fastens around a user's shoe via the clip 808 and clip receiver 809, and once the dedicated foot anchor 890 has been secured to a user's shoe, it may be further secured by tightening the strap 802.

In an embodiment, the sole section 803 may feature an abrasion-resistant material with a traction grip. Based upon the abrasion-resistant material of the sole 803 with a traction grip, a user's shoe may advantageously prevent the sole of a user's shoe from slipping on the surface of the sole 803 when the user's shoe or sneaker is secured within the dedicated foot anchor 890 for use with the variable resistance walking device 100 as described herein. In addition, the abrasion-resistant material of the sole 803 with a traction grip may also prevent a user from slipping on a surface of the ground or floor when exercising on various indoor and outdoor surfaces with the variable resistance walking device 100 as described herein.

Referring to FIG. 8B, the outer body section 805 of the dedicated foot anchor 890 may further include a loop portion 807. In use, a metal-gated hook 163 or a carabiner that is coupled to a resistance band 150 (as illustrated and described with respect to FIG. 3C) may attach or hook to a loop portion 807 of the dedicated foot anchor 890 to securely fasten a resistance band 150 and a modular handle portion 110, as shown in FIG. 1A, to a user's foot accessory, such as a shoe, hiking boot, or sneaker.

Figure 9:
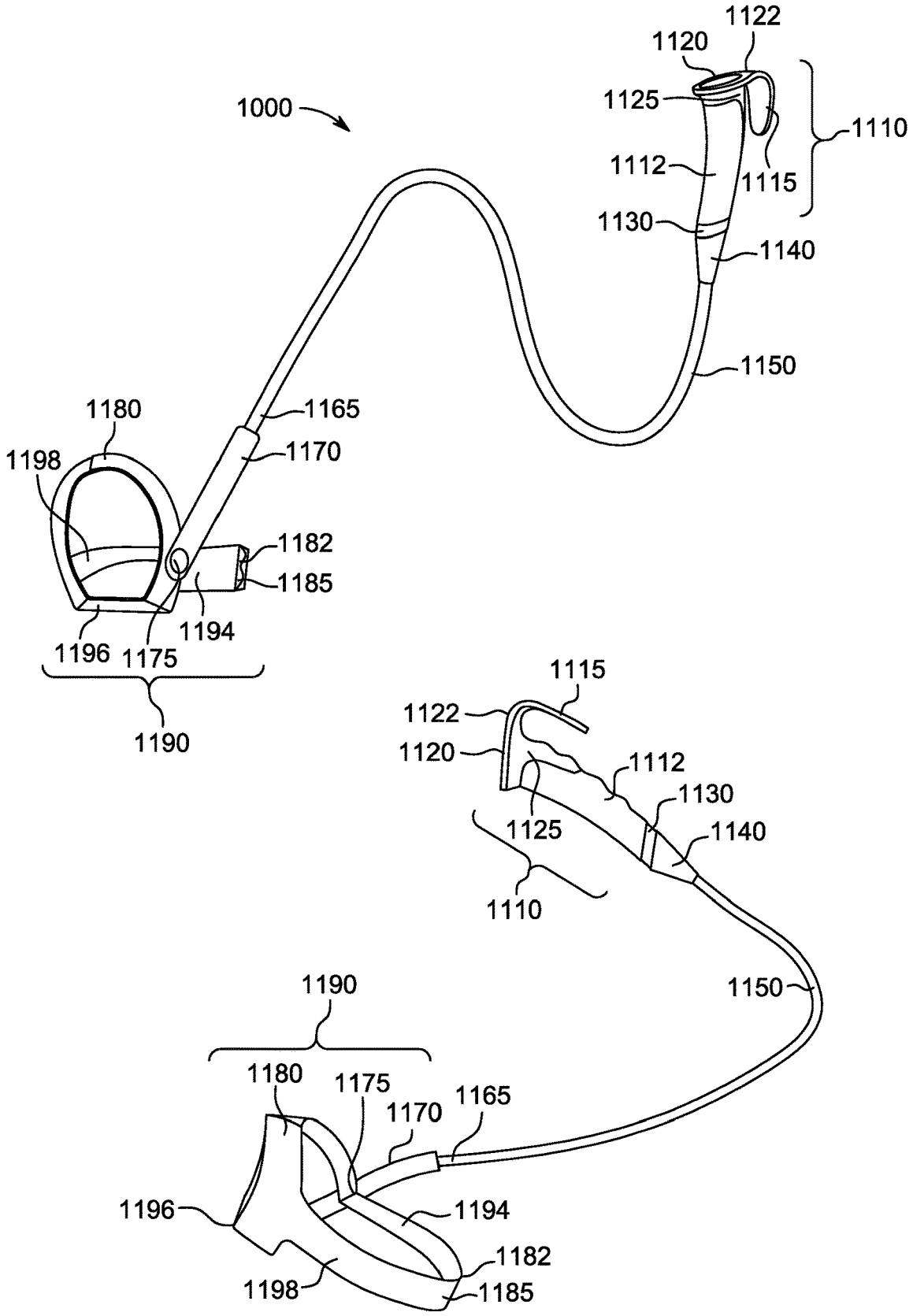
FIG. 9 is a perspective view of an embodiment of the variable resistance walking device with a dedicated foot anchor and ergonomic handle, including a display and network interface.

Referring to FIG. 9, a perspective view of an embodiment of a variable resistance walking device 1000 as described herein is shown, including a pair of elastomeric resistance bands 1150, with each band 1150 featuring a dedicated foot anchor 1190 at the first end of each band 1150 and a modular handle portion 1110 at a second end of each resistance band 1150. The modular handle portion 1110 may provide an ergonomic and comfortable grip when exercising, and the dedicated foot anchor 1190 may securely fasten a resistance band 1150 to a user's foot accessory, such as a shoe, hiking boot, or sneaker, for example.

Referring again to FIG. 9, as will be described in further detail, the modular handle portion 1110 may comprise one or more of a variety of mechanical and electrical features detailed in the herein-disclosed embodiments of the variable resistance walking device 1000. The modular handle portion 1110 may generally include a palm member 1112 configured to meet the palm of a user's hand. The palm member 1112 may extend linearly toward a top section 1122 with a securing member 1115 adjacent to the palm member 1112. When a user grasps the palm member 1112, the top section 1122 with securing member 1115 may extend over and around an upper portion of a user's hand to secure the modular handle portion 1110 within the user's grasp. The configuration of the securing member 1115 adjacent to the palm member 1112 may provide a comfortable and ergonomic space for the user's hand to securely hold the modular handle portion 1110 without requiring the user to clench the palm member 1112 tightly within the user's hand.

In addition, and as shown in FIG. 9, the palm member 1112 may extend linearly from top to bottom in the same axis as the resistance band 1150, thereby alleviating carpal tunnel stress while providing an additional ergonomic configuration of the handle portion 1110 relative to a user's pulling force against the resistance of a band 1150.

Referring to FIG. 9, an upper portion of the palm member 1112 may also feature a cushion member 1125 comprising a material that may be softer than a material of the palm member 1112. A cushion member 1125 may meet a top region of a user's hand when the user grasps the palm member 1112. When a user grasps the palm member 1112 with cushion member 1125 and exerts a force against cushion member 1125 to stretch the resistance band 1150, the user's hand may exert force against cushion member 1125 to provide force to stretch the resistance of band 1150. In such a configuration, it may not be necessary for the user to tightly grasp the palm member 1112 with cushion member 1125 when exerting force against the resistance band 1150 since a user may instead effectively stretch the resistance band 1150 based upon the force applied to the cushion member 1125. As such, an embodiment of the resistance walking device 1000 that includes a cushion member 1125 in the modular handle portion 1110 may also alleviate carpal tunnel stress when a user exerts a force against the resistance of a band 1150.

As will be described in further detail, the top section 1122 of the modular handle portion 1110 shown in FIG. 9 may include insertable electronic components 1120, including a GUI or LED display that may reside within the modular handle portion 1110. Although the embodiment of FIG. 9 illustrates the insertable electronic components 1120 within the modular handle portion 1110, it is understood that other embodiments of the modular handle portion 1110 may not include the insertable electronic components 1120. For example, the insertable electronic component 1120 may indicate a desired exercise metric, such as the number of steps taken by a user, a user's oxygen consumption, a user's heart rate, or any other available health metrics when exercising with the variable resistance walking device 1000. It is understood that the insertable electronic components 1120 may also include sensors such as a force gauge to measure the amount of force exerted by a user when exerting a pulling force against a resistance of a band 1150. Sensors may also include an accelerometer to measure repetitions based on the displacement of a band 1150 via stretching movements. Sensors in the device, as disclosed herein, may also include a gyroscope to measure orientation in space and angular velocity. Additional insertable electronic components 1120 that may be implemented within the modular handle portion 1110 of the resistance walking device 1000 may include an internal battery component that may be utilized to power a Bluetooth® communication component. Insertable electronic components 1120 within the modular handle portion 1110 may include a network interface in communication with at least one of the sensors mentioned above and a website via a network. The network interface may include a processor and memory. It may be in communication with input and output devices with wireless network connections for sharing performance information that is tracked and measured by one or more sensors in the modular handle portion 1110. The network interface may communicate wirelessly with at least one sensor and with at least one website via a network. The insertable electronic components 1120 may communicate wirelessly such as via Bluetooth®, to applications on a user device such as a phone, tablet or computer. The applications may then communicate with the website. In addition, the device 1000 may include a wireless interface with a website displaying the exercise data and shared data. In an embodiment, the insertable electronic components 1120 may communicate wirelessly to applications on a user device such as a phone, tablet or computer even if the application does not communicate with a website. In another embodiment, a user's tracked exercise data may be collected on the device 1000 by the insertable electronic components 1120 before the same tracked exercise data may then be transferred wirelessly or otherwise by a direct USB connection or other cable connection to an application on a user device such as a phone, tablet or computer.

Referring again to FIG. 9, the resistance walking device 1000 may further include elastomeric resistance bands 1150 that may directly or indirectly and permanently or detachably be coupled to the dedicated foot anchor 1190 at the first end of each band 1150 and to the modular handle portion 1110 at a second end of each resistance band 1150. In the embodiment shown in FIG. 9, the resistance band 1150 may directly and detachably couple to the modular handle portion 1110 or dedicated foot anchor 1190. For example, to directly and detachably couple an upper section 1140 of the resistance band 1150 to the modular handle portion 1110, a threaded attachment member 1130 may be screwed into and attached to the lower portion of the modular handle portion 1110. To directly and detachably couple the resistance band 1150 to the dedicated foot anchor 1190, an attachment point 1165 of the resistance band 1150 may be attached and removed from an adjustable sheath 1170 of the dedicated foot anchor 1190. A material of an adjustable sheath 1170 may be comprised of a material suitable to provide a thin and durable adjustable sheath 1170 members that may reside between an attachment point 1165 of the resistance band 1150 and an attachment point 1175 located on an outside strap 1194 of the foot anchor 1190.

Concerning the amount of resistance provided by the resistance bands 1150, as shown in FIG. 9, a resistance level may be determined by the length of the bands 1150. In embodiments of the resistance walking device 1000 featuring elastomeric resistance bands 1150 that may directly and detachably couple to the dedicated foot anchor 1190 and the modular handle portion 1110, a resistance level of the resistance bands 1150 may be increased by attaching a shorter resistance band 1150 or decreased by attaching a more extended resistance band 1150. A resistance level of the resistance band 1150 may also be increased by attaching a more wide, thicker resistance band 1150 or decreased by attaching a narrower, thinner resistance band 1150. In addition, a resistance level of the resistance band 1150 may also be increased by attaching a more broad, shorter resistance band 1150 or decreased by attaching a narrower, longer resistance band 1150. Additionally, different materials may be used for the bands that may provide more or less resistance for the user.

Referring to FIG. 9, the dedicated foot anchor 1190 of the resistance walking device 1000 may comprise an adjustable sheath 1170 configured to accommodate a user's height. In particular, a length of an adjustable sheath 1170 may be increased to accommodate taller users and decreased to accommodate shorter users. In addition, a length of an adjustable sheath of 1170 (for a user's height) may also be adjusted independently of a length of a resistance band of 1150. A length of a resistance band of 1150 (for a resistance level of the resistance walking device 1000) may be adjusted independently of the length of an adjustable sheath 1170.

As shown in FIG. 9, the adjustable sheath 1170 of the foot portion 1190 may extend and detachably couple to an attachment point 1175 located on an outside strap 1194 of the dedicated foot anchor 1190. Because the adjustable sheath 1170 detachably couples to an attachment point 1175 located on an outside strap 1194 of the foot anchor 1190, a resistance band 1150 may extend from an outside surface rather than an inside arch surface of a user's shoe. As such, a resistance band 1150 may extend along the outer side of a user's leg, rather than the inner side of a user's leg, to provide an ergonomic and comfortable experience when exercising with the resistance walking device 1000.

Referring again to FIG. 9, the foot anchor 1190 of the resistance walking device 1000 may utilize straps 1180, 1185, 1196, 1198, and 1194 to secure the foot anchor 1190 to a user's shoe or another foot accessory described herein. For example, the foot anchor 1190 may include an adjustable instep strap 1180 extending over a user's instep region and a heal strap 1185. The adjustable instep strap 1180 and heal strap 1185 secure the foot anchor 1190 to a user's shoe. In addition, the heal strap 1185 may also feature a rechargeable Bluetooth® battery-operated safety light 1182 that may removably attach to the heal strap 1185. The foot anchor

1190 may include a bottom tread strap 1196 that wraps underneath a user's shoe. In addition, the foot anchor 1190 may include an interior arch strap 1198 configured to extend along the inside, the arch surface of a user's shoe. Together, the adjustable instep strap 1180, heal strap 1185, bottom tread strap 1196, interior, arch strap 1198, and outside strap 1194 secure the foot anchor 1190 to a user's shoe. Additionally, rechargeable Bluetooth® battery-operated safety lights (not shown) may be placed along, on top of, or within the resistance bands 1150.

Figure 10A:
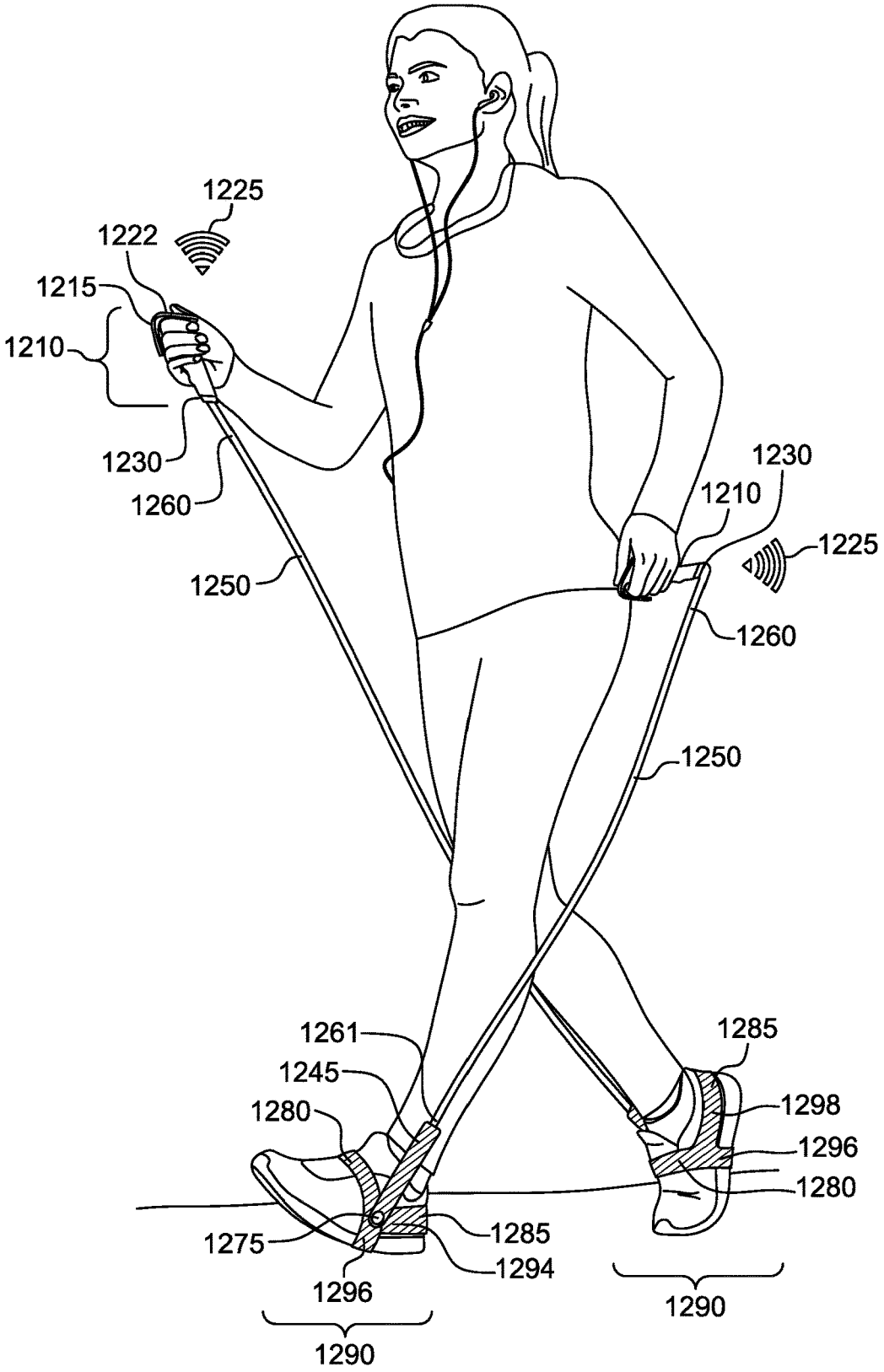
FIG. 10A is an exemplary view of a user exercising with an embodiment of the variable resistance walking device with a dedicated foot anchor and ergonomic handle, including a display and network interface.

Referring to FIG. 10A, an exemplary illustration is provided of a user exercising with an embodiment of the variable resistance walking device 1000 as shown in FIG. 9 with a dedicated foot anchor 1290 and a modular handle portion 1210, including a display and network interface. The modular handle portion 1210 provides the user with an ergonomic and comfortable experience when exercising with the device 1000, as the top 1222 section with securing member 1215 may extend over and around an upper portion of the user's hand to secure the modular handle portion 1210 within the user's grasp. The user's hand may securely hold the modular handle portion 1210 without requiring the user to clench the palm member 1112 tightly within the user's hand.

Referring again to FIG. 10A, in conjunction with FIG. 9, the top 1222 section of the modular handle portion 1210 may include insertable electronic components 1120, including a GUI or LED display that may reside within the modular handle portion 1210. Accordingly, the modular handle portion 1210 may feature wireless capability 1225, including a rechargeable Bluetooth® battery and a network interface with wireless network connections in communication with at least one of the sensors mentioned above and the website via a network for communication of performance information that is tracked and measured by the one or more sensors in the modular handle portion 1210.

In addition to the insertable electronic components 1120 within the modular handle portion 1210, the resistance band 1250, as shown in FIG. 10A, may also include an insert or slot region 1260 within the resistance band 1250 and just below the modular handle portion 1210 for insertion of an LED light within the resistance band 1250 and modular handle portion 1210, so that the resistance band 1250 may be lit from the inside of the band 1250 and modular handle portion 1210, as a safety feature when utilizing the device 1000 at night. It is understood that in such embodiments that comprise an insert or slot region 1260 within the resistance band 1250 for insertion of an LED light or another lighting device, a material of the resistance band 1250 may be sufficiently transparent to enable the light provided by the LED light or other lighting device inserted within the slot region 1260 of the resistance band 1250 to be visible through the material of the resistance band 1250. It is further understood that an LED light or other lighting device inserted within the slot region 1260 of the resistance band 1250 may include a wireless charging feature such as a rechargeable Bluetooth® battery or a battery that may be utilized to power a Bluetooth® communication component. It should also be noted that the color of the LED lights may be configured by the user or may automatically adjust based on the user's performance. This adjustment may be based on the number of steps, frequency of steps, portion of the complete walk, the resistance level of the band, a team that the user is part of, or any other factors.

As shown in the embodiment of FIG. 10A, a user may select a desired resistance for exercise with the variable resistance walking device 1000 by choosing longer or thinner bands 1250 of less resistance or shorter or thicker bands 1250 of more excellent resistance. Accordingly, particular bands 1250 of predetermined resistance may be interchangeably implemented into the variable resistance walking device 1000. Upon selecting a particular band 1250 of desired resistance, the resistance band 1250 may then be directly and detachably coupled to the modular handle portion 1210 or a dedicated foot anchor 1290. As aforementioned, to fasten a resistance band 1250 to the modular handle portion 1210, a threaded attachment member 1230 may be screwed into and attached to the lower portion of the modular handle portion 1210.

Figure 10B:
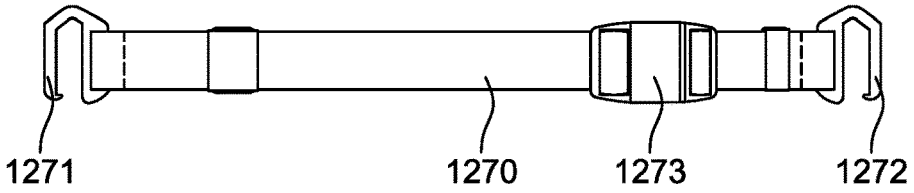
FIG. 10B is an exemplary view of a configuration of an adjustable sheath of the dedicated foot anchor of the variable resistance walking device.
Figure 10C:
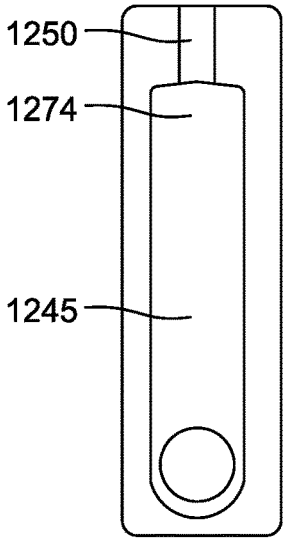
FIG. 10C is another exemplary view of an adjustable sheath of the dedicated foot anchor that may permanently attach to a resistance band.
Figure 10D:
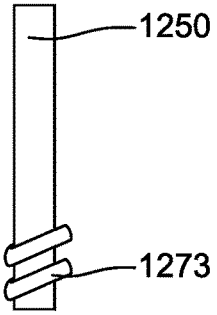
FIG. 10D is an exemplary view of an attachment point of a resistance band that may permanently attach to an adjustable sheath.

Referring to FIGS. 10A and 10B, to fasten a resistance band 1250 to a dedicated foot anchor 1290, an attachment point 1261 of the resistance band 1250 may be attached or removed from an adjustable sheath 1245 of the dedicated foot anchor 1290. For example, as shown in FIG. 10B, an attachment point 1261 of the resistance band 1250 may be coupled to a hook 1271, 1272 on either end of an adjustable sheath 1245. Those skilled in the art would understand that in other embodiments, a hook 1271, 1272 may alternatively be supplemented with or replaced by a clip, ratchet, or other mechanical part configured to detachably couple the attachment point 1261 of the resistance band 1250 to the adjustable sheath 1245. In another embodiment, as shown in FIGS. 10C and 10D, an attachment point 1261 of the resistance band 1250 may feature compression rings 1273 that are affixed to a circumference area of the attachment point 1261 of the resistance band 1250. An end portion 1274 of an adjustable sheath 1245 may be sewn over the compression rings 1273 to hold the adjustable sheath 1245 onto the resistance band 1250 at attachment point 1261.

Figure 15B:
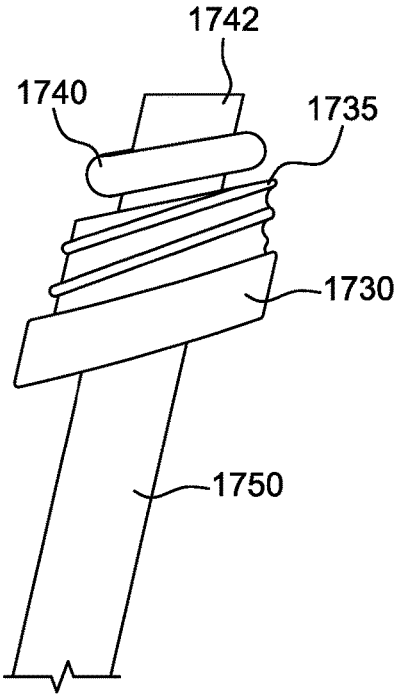
FIG. 15B is a view of a top portion of a resistor band featuring a threaded member and a flanged member over the resistor band.

Referring again to FIG. 10A, other embodiments of the device 1000 may provide additional ability for selecting a desired resistance of a band 1250 based upon the functionality of the modular handle portion 1210. In particular, the modular handle portion 1210 may also include mechanical components for adjusting a variable resistance of a band 1250 attached to the modular handle portion 1210. For example, in an embodiment, a modular handle portion 1210 may include a winding wheel component (not shown) that enables a user to wind a band 1250 to shorten or extend the length of band 1250 to increase or decrease a variable resistance of band 1250. In another embodiment, a modular handle portion 1210 may feature grommets of varying diameter to enable a user to pull up and secure a band using a flanged member 1740 (as shown in FIG. 15B) attached to the band 1250 to reduce slack in the band 1250 and to increase a variable resistance of a band 1250. Likewise, in an embodiment featuring grommets of varying diameters, a user may extend and secure a band 1250 to increase slack in band 1250 to reduce a variable resistance of band 1250. In another embodiment, a modular handle portion 1210 may enable a user to pinch a band 1250 at a desired length of band 1250 to set the device 1000 to a calibrated, predetermined resistance.

Figure 10E:
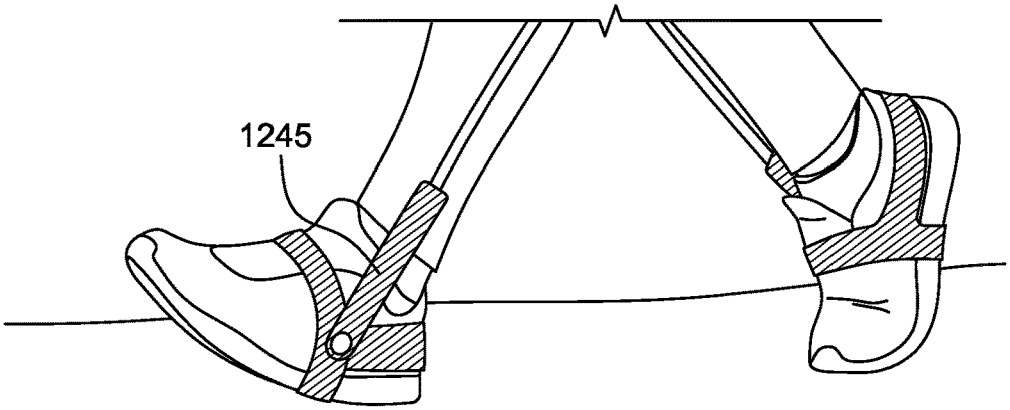
FIG. 10E is an exemplary view of a user exercising with an adjustable sheath that is detachably coupled to the dedicated foot anchor of the variable resistance walking device.

Referring to FIG. 10E, in addition to determining the level of resistance for exercise with the variable resistance walking device 1000, a user may also lengthen or shorten the adjustable sheath 1245 of the dedicated foot anchor 1290 according to the height of the user. A length of an adjustable sheath 1245 may be increased to accommodate taller users and decreased to accommodate shorter users. A length of an adjustable sheath 1245 relatives to a user's height may also be adjusted independently of an adjustment of a respective length of a resistance band 1250 relative to a selectable resistance level of the resistance walking device 1000.

Figure 10F:
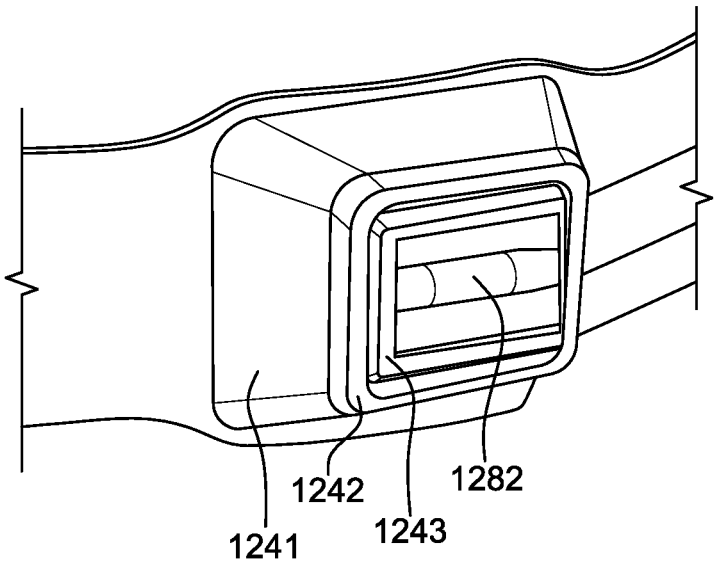
FIG. 10F is an exemplary safety light that may removably attach to the heal strap of a dedicated foot anchor.

Referring to FIG. 10F, the heal strap 1285 (as shown in FIG. 10A) may also feature a rechargeable Bluetooth® battery-operated safety light 1282 that may removably attach to the heal strap 1285. In an embodiment, the safety light 1282 may be secured within an inner housing frame 1243 configured to fit within an outer housing frame 1242 of a light fixture element 1241 that may be affixed to the heal strap 1285. In another embodiment, a battery operated safety light may detachably clip onto the heal strap 1285. A material of an inner housing frame 1243 and an outer housing frame 1242 may be a plastic, metal or other material suitable to house and contain the rechargeable Bluetooth® battery-operated safety light 1282.

Figure 10G:
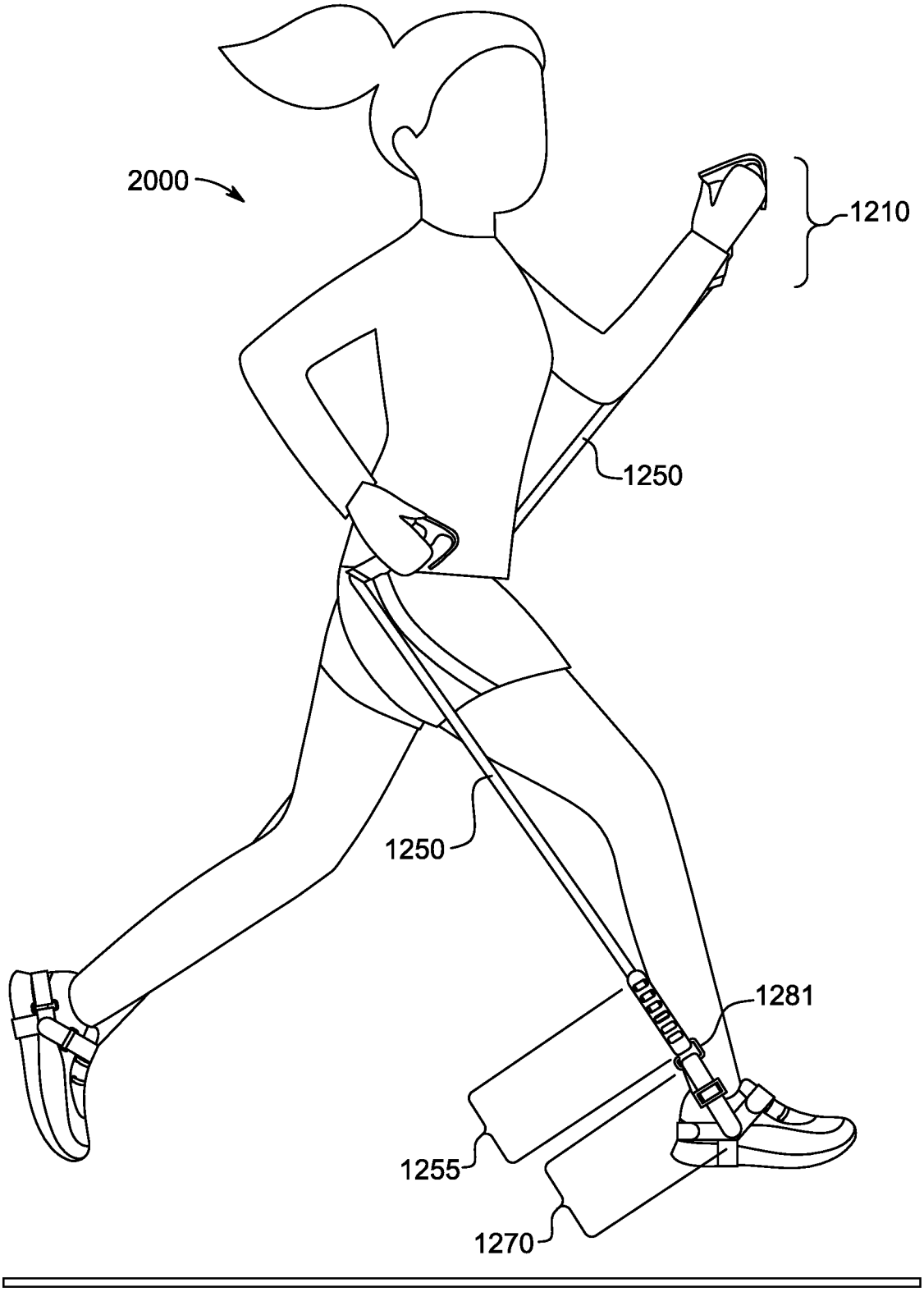
FIG. 10G is an additional exemplary view of a user exercising with another embodiment of the variable resistance walking device with a dedicated foot anchor and ergonomic handle, including a display and network interface.

Referring to FIG. 10G, an exemplary illustration is provided of a user exercising with another embodiment of the variable resistance walking device 2000 including resistance bands 1250 and a modular handle portion 1210, including a display and network interface. In the embodiment shown in FIG. 10G, an adjustable sleeve or sheath 1255 over the resistance band 1250 may adjust the resistance band 1250 length for adjusting a resistance level of the resistance band 1250. In addition, an adjustable strap 1270 may be adjusted to accommodate a size and height of a user. To attach the adjustable sleeve 1255 to the adjustable strap 1270, the adjustable sleeve 1255 may feature a clip 1281 that may loop or attach to the adjustable strap 1270.

Referring again to FIG. 10G, an attachment of a resistance band 1250 with adjustable sleeve 1255 and clip 1281 to the adjustable strap 1270 may include an ability to adjust a length of the resistance band 1250 to change a length of a resistance band 1250 or resistance level of the resistance band 1250. In addition, the adjustable strap 1270 may accommodate a particular body size or height of a given user. An adjustment of the adjustable strap 1270 to accommodate a user's body size or height may be done independently of and without any change to the length of a resistance band 1250 or resistance level of the resistance band 1250.

Figure 10H:
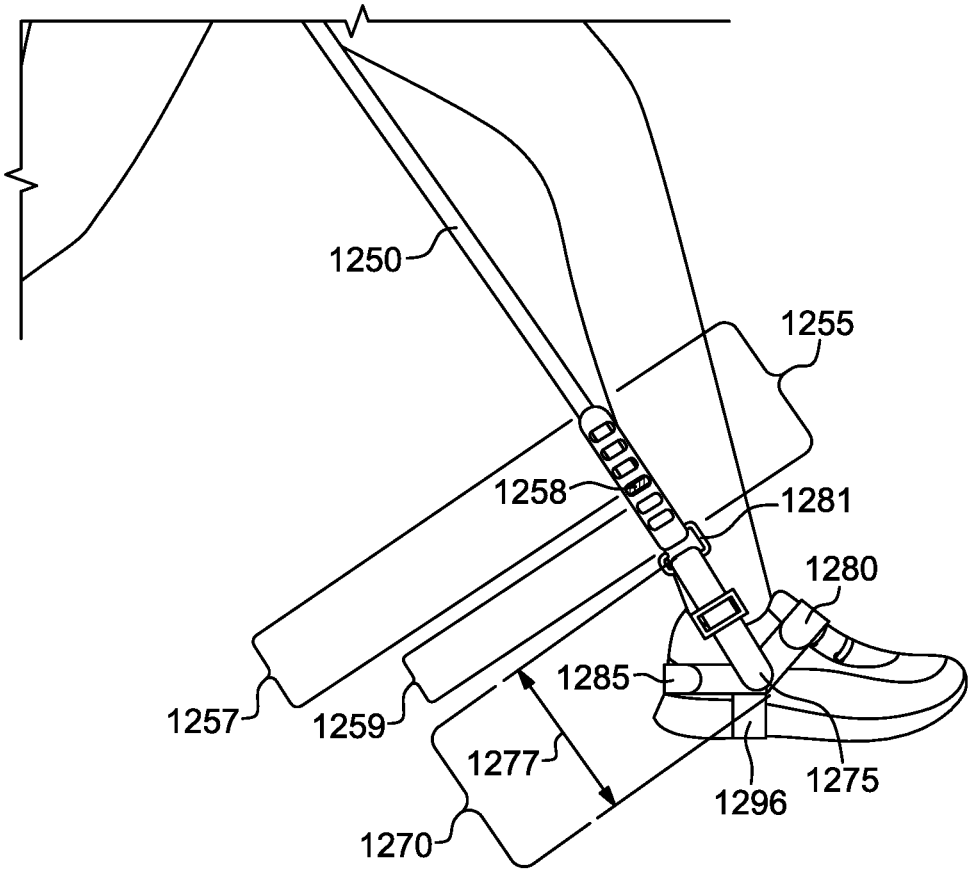
FIG. 10H is a close up exemplary view of a user exercising with another embodiment of a dedicated foot anchor.

Referring to FIG. 10H, a zoomed-in perspective view is provided of a user exercising with an embodiment of the variable resistance walking device (as shown in FIG. 10G) including the adjustable sleeve or sheath 1255 over the resistance band 1250 and the adjustable strap 1270. The adjustable sleeve 1255 over the resistance band 1250 may be utilized to adjust the resistance band 1250 length for adjusting a resistance level of the resistance band 1250. The adjustable strap 1270 may be adjusted to accommodate a size and height of a user. To attach the adjustable sleeve 1255 to the adjustable strap 1270, the adjustable sleeve 1255 may feature a clip 1281 that may loop or attach to the adjustable strap 1270.

Referring again to FIG. 10H, the adjustable strap 1270 may detachably couple to an attachment point 1275 located on the foot anchor comprising straps 1280, 1285, and 1296. It is understood that an attachment point 1275 may comprise a detachable coupling feature such as a plastic or metal button, hook or other fastening feature. An attachment point 1275 may also feature a permanent coupling of the adjustable sheath 1270 to an attachment point 1275 by sewing the adjustable sheath 1270 to the attachment point 1275. The straps 1280, 1285, 1296 may secure the foot anchor to a user's shoe. In particular, the adjustable instep strap 1280 may extend over a user's instep region, and the heal strap 1285 may fasten to the back of a shoe. In addition, the bottom tread strap 1296 may wrap underneath the user's shoe. Together, the adjustable instep strap 1280, heal strap 1285, bottom tread strap 1296 secure the foot anchor to a user's shoe. An adjustment of the adjustable strap 1270 to accommodate a user's body size or height may be achieved via a variable length of the adjustable strap 1270 that may include VELCRO®, mechanical strap hardware, a screw/compression element for variable length adjustment or mechanical fixed positions via button, snap, or grommet and hooks assembly. Further, the adjustable strap 1270 features a length 1277 defined by an adjustment of the adjustable strap 1270 to accommodate a size and height of a user.

As shown in FIG. 10H, the adjustable sleeve 1255 over the resistance band 1250 may feature one or more grommets 1258 that may be secured and affixed to a resistance band 1250. In such embodiments that include one or more grommets 1258, the resistance bands 1250 may be either permanently or detachably coupled to the modular handle portion 1210 and the foot anchor comprising straps 1280, 1285, and 1296. One or more grommets 1258 may be mechanically secured and affixed over the resistance band 1250 with glue or heat molding during assembly to secure and hold the grommets 1258 in place over the resistance band 1250. Grommets 1258 secured on an elastomeric resistance band 1250 may enable a length and variable resistance of the elastomeric resistance band 1250 to be adjusted based upon a friction provided by the grommet 1258 against the resistance band 1250, or based upon a pinching or deforming of the resistance band 1250 by the grommet 1258. Grommets 1258 may be of varying diameters to enable a user to pull up and secure a resistance band 1250 to reduce slack in the resistance band 1250 to increase a variable resistance of a resistance band 1250. Likewise, in an embodiment featuring grommets 1258 of varying diameters, a user may extend and secure a resistance band 1250 to increase slack in the resistance band 1250 to reduce a variable resistance of a resistance band 1250. Referring again to FIG. 10H, the adjustable sleeve 1255 may feature a length 1257 defined by a portion of the resistance band 1250 within the adjustable sleeve 1255 and another length 1259 where the resistance band 1250 is not within the adjustable sleeve 1255. As aforementioned, the grommet 1258 may be secured on the elastomeric resistance band 1250 with glue or heat molding during assembly to secure and hold the grommet 1258 in place over the resistance band 1250. A variable length of the resistance band 1250 may be determined by where the grommet 1258 protrudes through the adjustable sleeve 1255. As shown in the embodiment of FIG. 10H, the length 1259 of the adjustable sleeve 1255 represents an area where the resistance band 1250 is not disposed within the adjustable sleeve 1255. The length 1257 of the adjustable sleeve 1255 represents an area where the resistance band 1250 is disposed within the adjustable sleeve 1255.

Figure 10I:
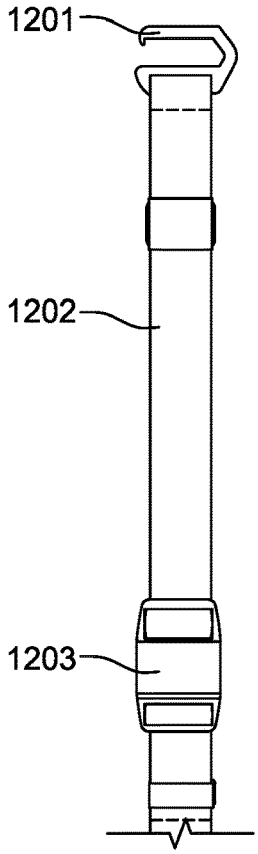
FIG. 10I is an exemplary view of a configuration of an adjustable sheath of the dedicated foot anchor of the variable resistance walking device.

Referring to FIG. 10I through FIG. 10L, perspective views are provided of exemplary embodiments of an adjustable sheath 1270 of the dedicated foot anchor of the variable resistance walking device, as shown in FIGS. 10G and 10H. To fasten an adjustable sleeve 1255 of the resistance band 1250 to an adjustable sheath 1270, a clip 1281 on the adjustable sleeve 1255 may be attached or removed from an adjustable sheath 1270 of the dedicated foot anchor. Alternatively, as shown in FIG. 10I, an adjustable sheath 1270 may feature a hook 1201 that may detachably couple to an attachment point of an adjustable sleeve 1255 of the resistance band 1250. Those skilled in the art would understand that in other embodiments, a hook 1201 may alternatively be supplemented with or replaced by a clip, ratchet, or other mechanical part configured to detachably couple an adjustable sheath 1270 to an adjustable sleeve 1255 of a resistance band 1250. It is further understood that the straps 1280, 1285, 1296 of a foot anchor may implement the configurations as illustrated in FIG. 10I through FIG. 10L to secure a foot anchor to a user's shoe.

Figure 10J:
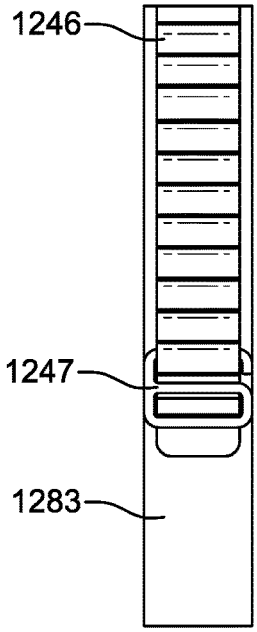
FIG. 10J is another exemplary view of a configuration of an adjustable sheath of the dedicated foot anchor of the variable resistance walking device.
Figure 10K:
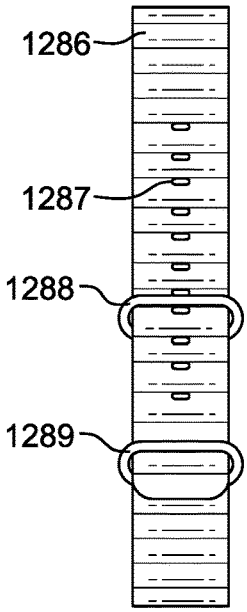
FIG. 10K is another exemplary view of a configuration of an adjustable sheath of the dedicated foot anchor of the variable resistance walking device.
Figure 10L:
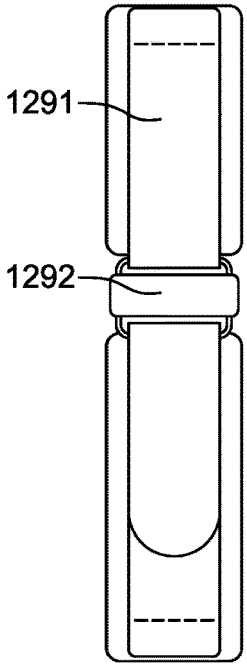
FIG. 10L is another exemplary view of a configuration of an adjustable sheath of the dedicated foot anchor of the variable resistance walking device.

As shown in FIG. 10I, a double-back buckle strap configuration 1202 is depicted with a hook 1201 and buckle 1203. FIG. 10J illustrates a hook an loop configuration 1283 including a buckle piece 1247 and loops 1246. FIG. 10K illustrates a post and slot configuration 1286 with post holes 1287, post member 1288, and buckle members 1289. FIG. 10L illustrates a VELCRO® loop configuration 1291 with loop member 1292. The configurations as shown in FIG. 10I through FIG. 10L may be implemented as part of an adjustable sheath 1270 or as part of the straps 1280, 1285, 1296 of a foot anchor of the variable resistance walking device as described herein.

Figure 10O:
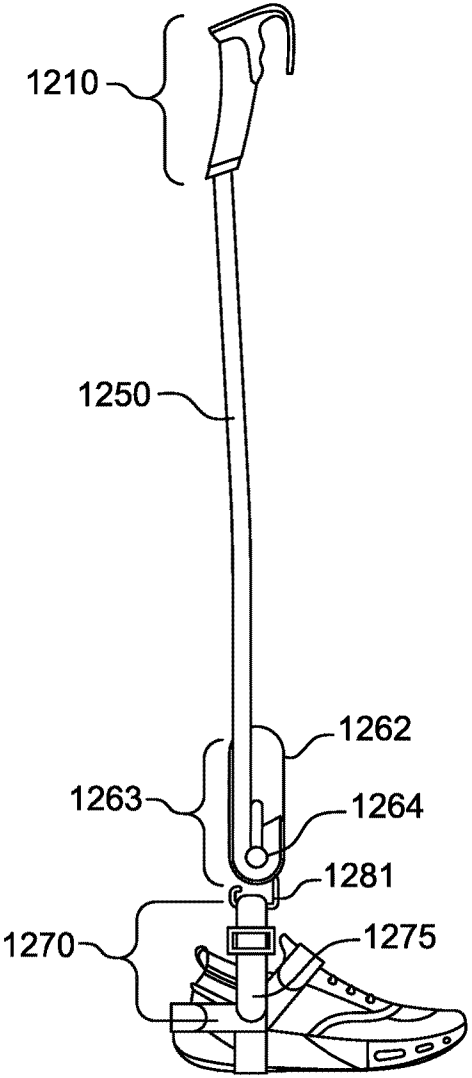
FIG. 10O is another embodiment of an adjustable resistance band that may include a winding component to adjust the variable resistance walking device.
Figure 10N:
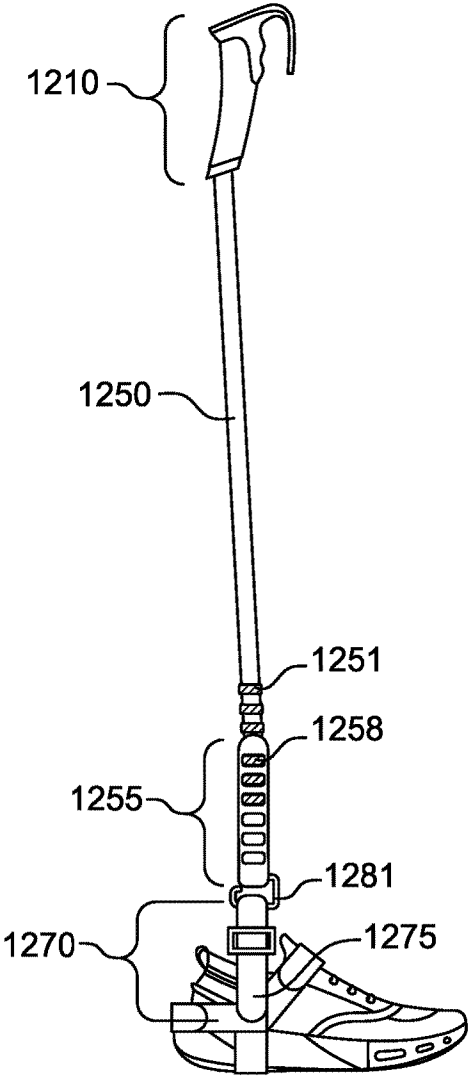
FIG. 10N is another embodiment of an adjustable resistance band of the variable resistance walking device.
Figure 10M:
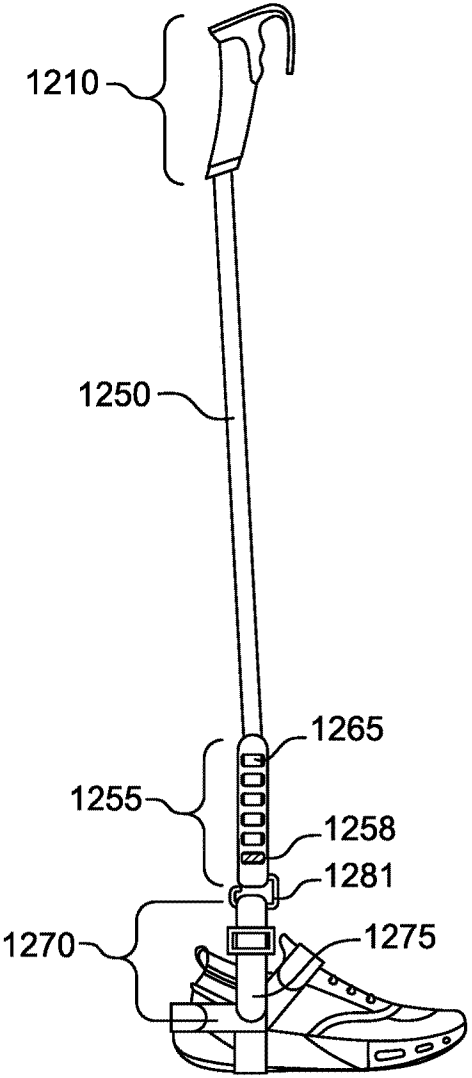
FIG. 10M is an embodiment of an adjustable resistance band of the variable resistance walking device.

Referring to FIG. 10M through FIG. 10N, embodiments of an adjustable sleeve or sheath 1255 over a resistance band 1250 are shown to illustrate an adjustment in a level of resistance provided by the resistance band 1250. As aforementioned, one or more grommets 1258 may be secured on the elastomeric resistance band 1250 with glue or heat molding during assembly to secure and hold the one or more grommets 1258 in place over the resistance band 1250. A variable length of the resistance band 1250 may be determined by where the one or more grommets 1258 protrudes through the notched openings 1265 in the adjustable sleeve 1255.

As shown in the embodiment of FIG. 10M that features one grommet 1258, the grommet 1258 protrudes through a notched opening 1265 located closest to the adjustable sheath 1270 of the dedicated foot anchor. As such, the length of the resistance band 1250 is decreased so that a level of resistance provided by the resistance band 1250 is increased.

As shown in the embodiment of FIG. 10N that features multiple grommets 1251, 1258, the grommets 1258 protrude through notched openings 1265 (also shown in FIG. 10M) located closest to the modular handle portion 1210. As such, the length of the resistance band 1250 is increased so that a level of resistance provided by the resistance band 1250 is decreased. As shown in FIG. 10N, the additional grommets 1251 not protruding through the notched openings 1265 provide additional capability to decrease the length of the resistance band 1250 by securing the additional grommets 1251 within the notched openings 1265.

Referring to FIG. 10O, another embodiment of a variable resistance walking device is provided illustrating a winding component 1263 that enables a user to wind a resistance band 1250 to shorten or extend a length of the resistance band 1250 to increase or decrease a variable resistance of the resistance band 1250. The winding component 1263 may feature a housing 1262 to contain the resistance band 1250. When the resistance band 1250 is wound, it may be wrapped and pinched within the housing 1262 to increase or decrease a length of the resistance band 1250 that is free to extend out of the housing 1262 of the winding component 1263. A resistance band 1250 may be wound on a spool member 1264 located within the housing 1262 of the winding component 1263. The spool member 1264 may enable a length and variable resistance of the elastomeric resistance band 1250 to be adjusted based upon a friction provided by the spool member 1264 against the resistance band 1250, or based upon a pinching or deforming of the resistance band 1250 by the spool member 1264.

Figure 10P:
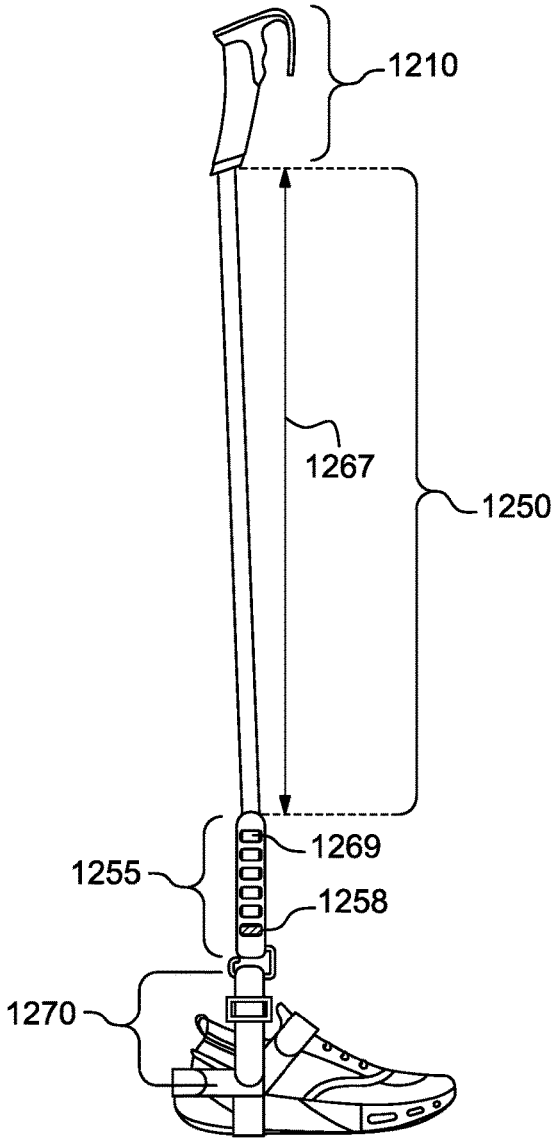
FIG. 10P is an exemplary view of an adjustable resistance band that has been adjusted to decrease the length of the resistance band to increase the force required to extend the resistance band.
Figure 10Q:
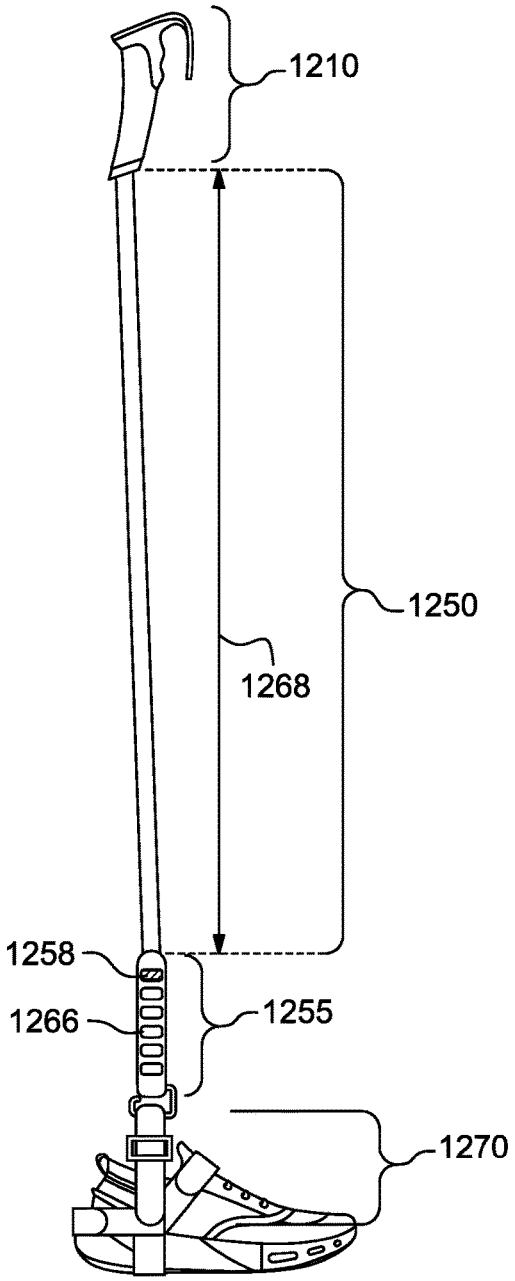
FIG. 10Q is an exemplary view of an adjustable resistance band that has been adjusted to increase the length of the resistance band to decrease the force required to extend the resistance band.

Referring to FIGS. 10P and 10Q, perspective views of an adjustable sleeve or sheath 1255 over the resistance band 1250 are provided. The adjustable sleeve 1255 over the resistance band 1250 may be utilized to adjust the resistance band 1250 length for adjusting a resistance level of the resistance band 1250. As aforementioned, one or more grommets 1258 may be secured on the elastomeric resistance band 1250 with glue or heat molding during assembly to secure and hold the one or more grommets 1258 in place over the resistance band 1250. A variable length of the resistance band 1250 may be determined by where the one or more grommets 1258 protrudes through the notched openings 1265 in the adjustable sleeve 1255.

As shown in the embodiment of FIG. 10P that features a grommet 1258 protruding through a notched opening 1265 located closest to the adjustable sheath 1270 of the dedicated foot anchor, the length of the resistance band 1250 as shown in the embodiment of FIG. 10P has been decreased so that a level of resistance provided by the resistance band 1250 is increased. As the length of the resistance band 1250 is decreased, the length that is free to move outside of the adjustable sleeve 1255 is decreased, so that more force is required to extend the resistance band 1250.

As shown in the embodiment of FIG. 10Q that features a grommet 1258 protruding through a notched opening 1265 located closest to the modular handle portion 1210, the length of the resistance band 1250 as shown in the embodiment of FIG. 10Q has been increased so that a level of resistance provided by the resistance band 1250 is decreased. As the length of the resistance band 1250 is increased, the length that is free to move outside of the adjustable sleeve 1255 is increased, so that less force is required to extend the resistance band 1250.

Referring to FIG. 10P and FIG. 10Q in conjunction with FIG. 10H, the length 1259 (as shown in FIG. 10H) of the adjustable sleeve 1255 represents an area where the resistance band 1250 is not disposed within the adjustable sleeve 1255. The length 1257 (as shown in FIG. 10H) of the adjustable sleeve 1255 represents an area where the resistance band 1250 is disposed within the adjustable sleeve 1255. Accordingly and as shown in FIG. 10P and FIG. 10Q, depending on how a resistance band is adjusted within an adjustable sleeve 1255, a resistance band 1250 may be seen through a filled notched opening 1269 (as in FIG. 10P), and a resistance band 1250 may not be seen through an unfilled notched opening 1266 (as in FIG. 10Q).

Figure 11A:
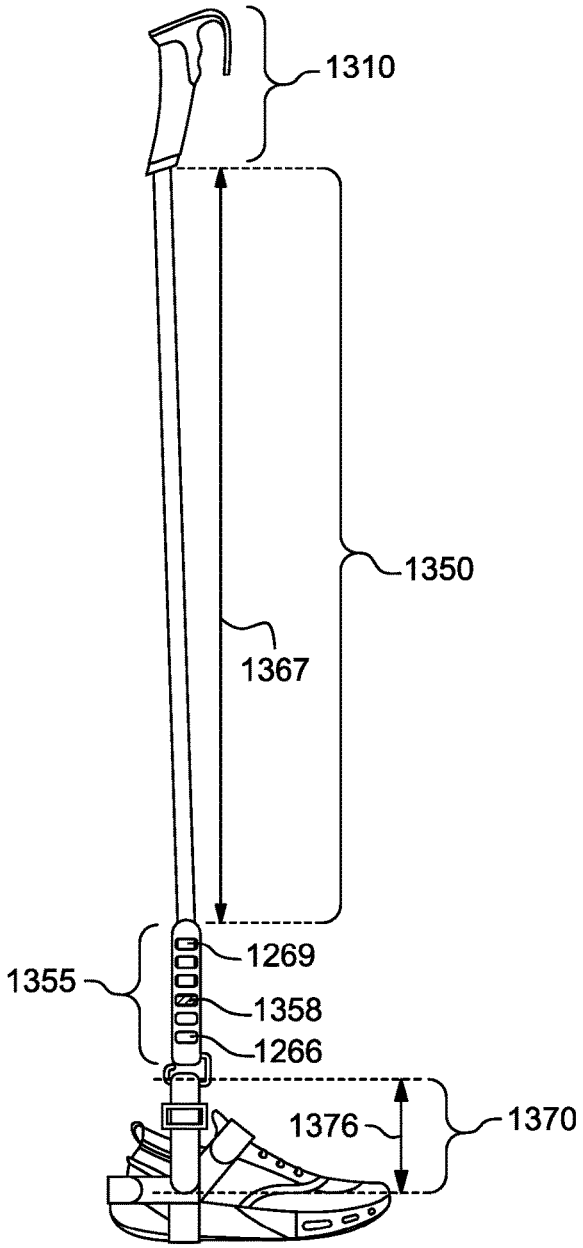
FIG. 11A is an exemplary view of an adjustable sheath that has been adjusted to decrease the sheath length to accommodate a shorter user.
Figure 11B:
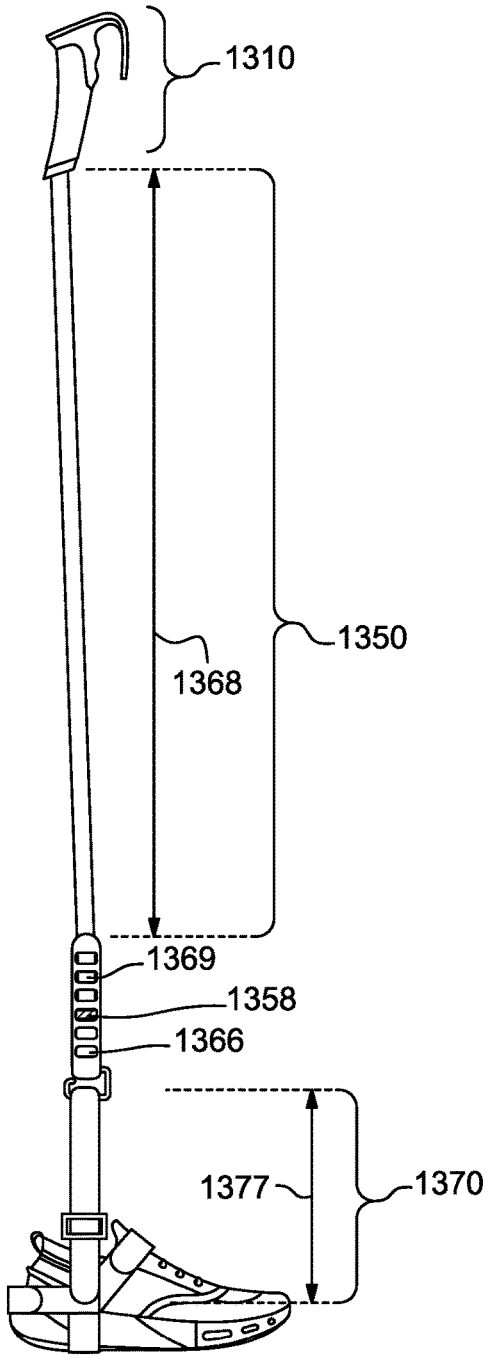
FIG. 11B is an exemplary view of an adjustable sheath that has been adjusted to increase the sheath length to accommodate a taller user.

Referring to FIGS. 11A and 11B, perspective views of an adjustable strap 1370 of the dedicated foot anchor are provided. The adjustable strap 1370 may be utilized to accommodate a size and height of a user without adjusting the resistance band 1350 length 1367, 1368. As shown in FIG. 11A, a length 1367 of a resistance band 1350 may remain the same when a length 1376 of an adjustable strap 1370 is decreased relative to a size and height of a user. Further, as shown in FIG. 11B, a length 1368 of a resistance band 1350 may remain the same when a length 1377 of an adjustable strap 1370 is increased relative to a size and height of a user. Accordingly, an adjustment of a length 1376, 1377 of the adjustable strap 1370 to accommodate a user's body size or height may be done independently of and without any change to the length 1367, 1368 of a resistance band 1350 or resistance level of the resistance band 1350.

In addition, and in reference to FIG. 10P and FIG. 10Q, an adjustment of a length 1267, 1268 of a resistance band 1250 to increase or decrease a resistance level of the resistance band 1250 may be done independently of an adjustment of a length 1376, 1377 of the adjustable strap 1370 (as shown in FIG. 11A and FIG. 11B) to accommodate a user's body size or height.

Accordingly, once a user has adjusted the variable resistance walking device 1000 to accommodate the user's particular height and to provide a desired level of resistance, the user may fasten the dedicated foot anchor 1290 of the device 1000 to the user's shoes. In general, the foot anchor 1290 of the resistance walking device 1000 may comprise straps 1280, 1285, 1296, 1298, and 1294 to secure the foot anchor 1290 to a user's shoe. In particular, the adjustable instep strap 1280 may extend over a user's instep region, and the heal strap 1285 may fasten to the back of a shoe. In addition, the bottom tread strap 1296 may wrap underneath the user's shoe, and the interior arch strap 1298 may extend along the inside arch surface of a user's shoe. Together, the adjustable instep strap 1280, heal strap 1285, bottom tread strap 1296, interior, arch strap 1298, and outside strap 1294 secure the foot anchor 1290 to a user's shoe.

As shown in the exemplary illustration in FIG. 10A, because the adjustable sheath 1270 detachably couples to an attachment point 1275 located on an outside strap 1294 of the foot anchor 1290, a resistance band 1250 may extend from an outside surface rather than an inside arch surface of a user's shoe. As such, a resistance band 1250 may extend along the outer side of the user's leg, rather than the inner side, to provide an ergonomic and comfortable experience when exercising with the resistance walking device 1000. It is understood that an attachment point 1275 may comprise a detachable coupling feature such as a plastic or metal button, hook or other fastening feature. An attachment point 1275 may also feature a permanent coupling of the adjustable sheath 1270 to an attachment point 1275 by sewing the adjustable sheath 1270 to the attachment point 1275.

Figure 12D:
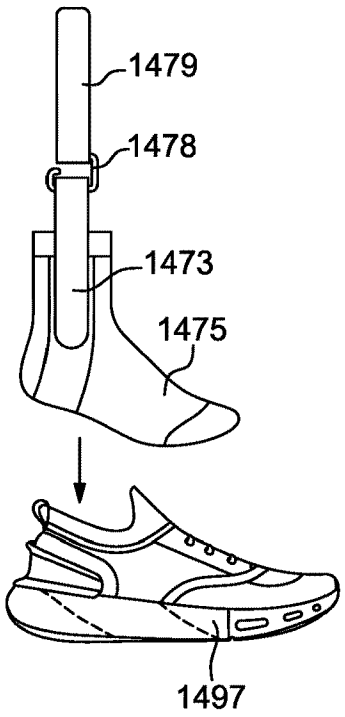
FIG. 12D is an exemplary view of an anchor sock that may be implemented in embodiments of a variable resistance walking device.
Figure 12C:
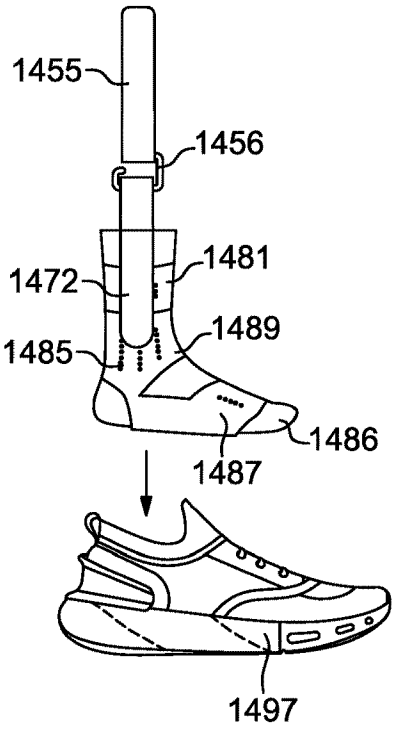
FIG. 12C is an exemplary view of an anchor compression support that may be implemented in embodiments of a variable resistance walking device.
Figure 12B:
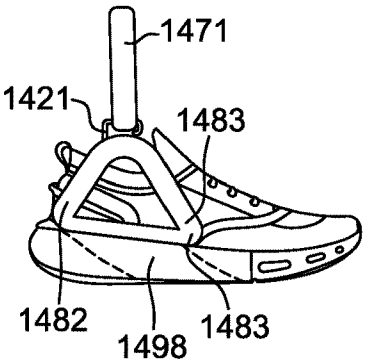
FIG. 12B is an exemplary view of an anchor shoe that may be implemented in embodiments of a variable resistance walking device.
Figure 12A:
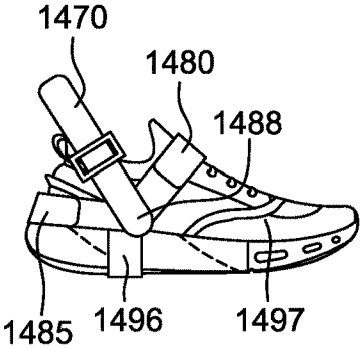
FIG. 12A is an exemplary view of a dedicated foot anchor that has been anchored to a shoe.

Referring to FIG. 12A through FIG. 12D, various embodiments of an adjustable foot anchor are provided that may be implemented in the variable resistance walking device. As shown in FIG. 12A, a foot anchor may comprise straps 1480, 1485, and 1496 that may secure the foot anchor to a user's shoe 1497. An adjustable strap 1470 may detachably couple to an attachment point 1488 located on the foot anchor.

Referring to FIG. 12B, an anchor shoe 1498 may comprise anchor straps 1482, 1483 that may be sewn into a construction of the anchor shoe 1498 of the variable resistance walking device. An adjustable strap 1471 as described in the embodiments herein that may be adjusted relative to a size or height of a user may be detachably or permanently attached via an attachment point 1421 such as a clip to the anchor straps 1482, 1483 that may be sewn into a construction of the anchor shoe 1498. It is understood that an anchor shoe 1498 may be implemented in various embodiments of the variable resistance walking device as disclosed herein.

FIG. 12C is an exemplary view of an anchor compression support 1481 that may be implemented in certain embodiments of a variable resistance walking device. The anchor compression support 1481 may provide a user with podiatry benefits by supporting instep 1489, ankle 1485 and foot regions 1487 of a user's foot 1486. In addition, an adjustable anchor strap 1472 may be sewn into the fabric of the anchor compression support 1481. A material of the anchor compression support 1481 may be a neoprene material or other suitable material to provide a compression support of the instep 1489, ankle 1485 and foot regions 1487 of a user's foot 1486. The adjustable anchor strap 1472 may be detachably or permanently attached via an attachment point 1456 such as a clip to an additional adjustable element 1455. The additional adjustable element 1455 may be an adjustable sheath 1270 (as shown in FIG. 10C) or an adjustable sleeve or sheath 1255 over a resistance band 250 (as shown in FIG. 2H for example).

FIG. 12D is an exemplary view of an anchor sock 1475 that may be implemented in certain embodiments of a variable resistance walking device. An anchor sock 1475 may comprise an adjustable anchor strap 1473 that may be sewn into the fabric of the anchor sock 1475 of the variable resistance walking device. The adjustable anchor strap 1473 may be detachably or permanently attached via an attachment point 1478 such as a clip to an additional adjustable element 1479. The additional adjustable element 1479 may be an adjustable sheath 1270 (as shown in FIG. 10C) or an adjustable sleeve or sheath 1255 over a resistance band 1250 (as shown in FIG. 10H for example).

Figure 13A:
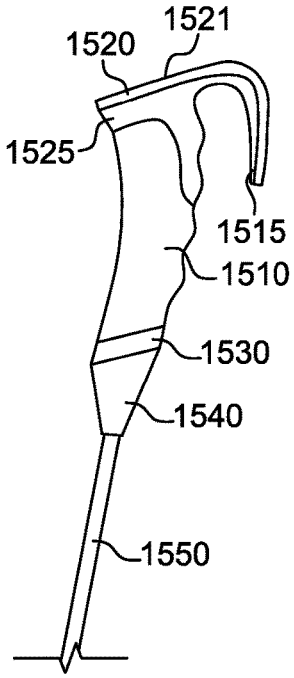
FIG. 13A is a perspective view of an embodiment of an ergonomic handle, including a display and network interface.
Figure 13B:
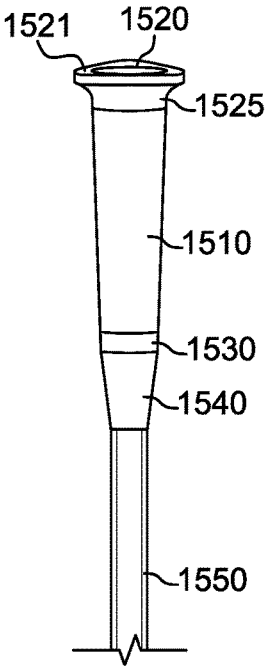
FIG. 13B is an additional perspective view of an embodiment of an ergonomic handle, including a display and network interface.
Figure 13C:
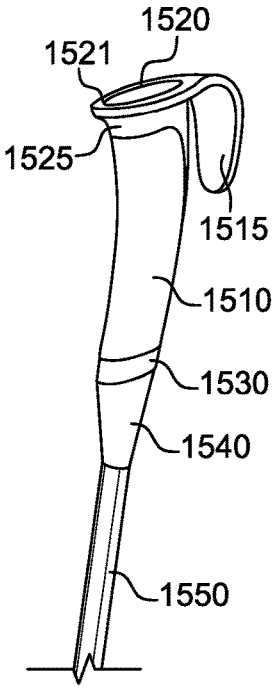
FIG. 13C is another perspective view of an embodiment of an ergonomic handle, including a display and network interface.

Referring to FIGS. 13A through 13C, perspective views of the modular handle portion 1110 as implemented in the variable resistance walking device 1000 of FIG. 9 is illustrated for additional reference. As shown in the embodiments of FIGS. 13A through 13C, the modular handle portion 1110 may provide an ergonomic and comfortable grip when exercising and includes a palm member 1510 configured to meet the palm of a user's hand, a securing member 1515 that protrudes outward from and adjacent to the palm member 1510, and a cushion member 1525 comprising a material that may be softer than a material of the palm member 1510. The palm member 1510 may extend linearly toward the securing member 1515 adjacent to the palm member 1510. When a user grasps the palm member 1510, the securing member 1515 may extend over and around an upper portion of a user's hand to secure the modular handle portion 1110 within the user's grasp. The configuration of the securing member 1515 adjacent to the palm member 1510 may provide a comfortable and ergonomic space for the user's hand to securely hold the modular handle portion 1110 without requiring the user to clench the palm member 1510 tightly within the user's hand.

As shown in the embodiments of the modular handle portion 1110 in FIGS. 13A through 13C, the palm member 1510 may extend linearly from top to bottom in the same axis as the resistance band 1550, thereby alleviating carpal tunnel stress while providing an additional ergonomic configuration of the modular handle portion 1110 relative to a user's pulling force against the resistance of a band 1550.

Referring again to FIGS. 13A through 13C, an upper portion of the palm member 1510 may also feature a cushion member 1525 comprising a material that may be softer than a material of the palm member 1510. A cushion member 1525 may meet a top region of a user's hand when the user grasps the palm member 1510. When a user grasps the palm member 1510 with cushion member 1525 and exerts a force against the cushion member 1525 to stretch the resistance band 1550, the user's hand may exert force against the cushion member 1525 to provide force to stretch resistance of a band 1550. In such a configuration, it may not be necessary for the user to tightly grasp the palm member 1510 with cushion member 1525 since a user may instead effectively stretch the resistance band 1550 based upon the force applied to the cushion member 1525. As such, an embodiment of the resistance walking device 1000 that includes a cushion member 1525 in the modular handle portion 1110 may also alleviate carpal tunnel stress when a user exerts a force against the resistance of a band 1550.

As will be described in further detail, the modular handle portion 1110 is shown in FIGS. 13A through 13C may also include a press-fit or threaded removable capsule bezel 1521 (illustrated in FIGS. 13B and 13C) that secures the insertable electronic components 1520, including a GUI or LED display that may reside within the modular handle portion 1110. Depending on the relative size of the insertable electronic components 1520, the insertable electronic components 1520 may reside partially or entirely within the palm member 1510 of the modular handle portion 1110. The removable capsule bezel 1521 may be removed to place and install insertable electronic components 1520. The insertable electronic components 1520 may indicate a desired exercise metric, such as the number of steps taken by a user or a user's oxygen consumption when exercising with the variable resistance walking device 1000. It is understood that the insertable electronic components 1520 may also include sensors such as a force gauge to measure the amount of force exerted by a user when exerting a pulling force against a resistance of a band 1550. Sensors may also include an accelerometer to measure repetitions based on the displacement of a band 1550 via stretching movements. Sensors in the device, as disclosed herein, may also include a gyroscope to measure orientation in space and angular velocity. Additional insertable electronic components 1520 that may be implemented within the modular handle portion 1110 of the resistance walking device 1000 may include an internal battery component that may be utilized to power a Bluetooth® communication component. Insertable electronic components 1520 within the modular handle portion 1110 may include a network interface in communication with at least one of the sensors above and a website via a network. The network interface may include a processor and a memory and may be in communication with input and output devices with wireless network connections for sharing of performance information that is tracked and measured by one or more sensors in the modular handle portion 1110

Referring again to FIGS. 13A through 13C, in conjunction with FIG. 9, the resistance bands 1550 may directly and detachably couple to the modular handle portion 1110. To directly and detachably couple an upper section 1540 of the resistance band 1550 to the modular handle portion 1110, a threaded attachment member 1530 may be screwed into and attached to the lower portion of the modular handle portion 1110. A threaded attachment member 1530 may be comprised of metal or another suitable material to provide a secure threaded attachment to the lower portion of the modular handle, portion 1110. In an embodiment of the modular handle portion 1110 that features a threaded attachment member 1530, a user may select a resistance band 1550 with a desired resistance level for attachment to the modular handle portion 1110. Concerning a selectable resistance level of a resistance band, the threaded attachment member 1530 may accommodate the attachment of bands of greater width and thickness that provide an increased resistance level. For example, as further shown in FIGS. 13A through 13C, a diameter of the upper section 1540 of the resistance band 1550 may gradually increase as the resistance band extends linearly toward the threaded attachment member 1530. Accordingly, the resistance band 1550 features a gradually increasing width and thickness as it approaches the threaded attachment member 1530, so the resistance band 1550 is in FIGS. 13A through 13C may provide an increased amount of resistance compared to a resistance band 1550, have a smaller width and thickness.

Figure 14A:
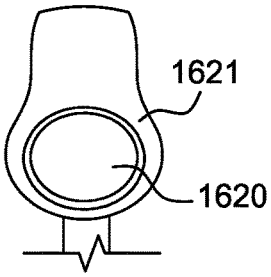
FIG. 14A is a top perspective view of an embodiment of an ergonomic handle, including a display and network interface.
Figure 14B:
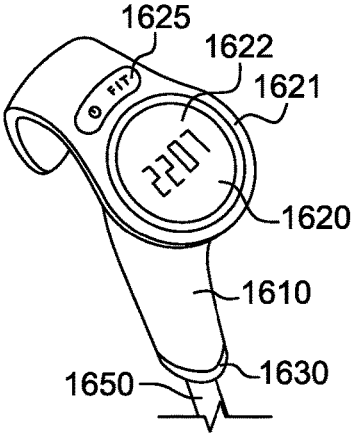
FIG. 14B is an additional top-perspective view of an embodiment of an ergonomic handle, including a display and network interface.

Referring to FIGS. 14A and 14B, in conjunction with FIG. 9, perspective views of a modular handle portion 1110 are shown illustrating a press-fit or threaded removable capsule bezel 1621 (as illustrated in FIGS. 13B and 13C) that secures a lens 1622 over the insertable electronic components 1620 including an active display area comprising a GUI or LED display that may reside within the modular handle portion 1110. The lens may be made from a suitable transparent plastic material or other glass or quartz glass material, for example. The removable capsule bezel 1621 may be removed to place, insert and install insertable electronic components 1620 within the palm member 1610 of the modular handle portion 1110. Depending on the relative size of the insertable electronic components 1620, the insertable electronic components 1620 may reside partially or entirely within the palm member 1610 of the modular handle portion 1110. As shown in FIG. 14B, when the removable capsule bezel 1621 is attached to the modular handle portion 1110 to secure the insertable electronic components 1620, a user may visualize a visual display of the 1620. When a user holds the palm member 1610, a visual display of the insertable electronic components 1620 may be oriented to face the user while the user is exercising. The insertable electronic components 1620 may feature push button controls 1625. It may indicate a desired exercise metric, such as the number of steps taken by a user or a user's oxygen consumption when exercising with the variable resistance walking device 1000. It is understood that the insertable electronic components 1620 may also include sensors such as a force gauge to measure the amount of force exerted by a user when exerting a pulling force against a resistance of a band 1650. Sensors may also include an accelerometer to measure repetitions based on the displacement of a band 1650 via stretching movements. Sensors in the device, as disclosed herein, may also include a gyroscope to measure orientation in space and angular velocity. Additional insertable electronic components 1620 that may be implemented within the modular handle portion 1110 of the resistance walking device 1000 may include an internal battery component, such as a rechargeable Bluetooth® battery. Insertable electronic components 1620 within the modular handle portion 1110 may include a network interface in communication with at least one of the sensors above and a website via a network. The network interface may include a processor and memory. It may be in communication with input and output devices with wireless network connections for sharing performance information that is tracked and measured by one or more sensors in the modular handle portion.

Figure 14C:
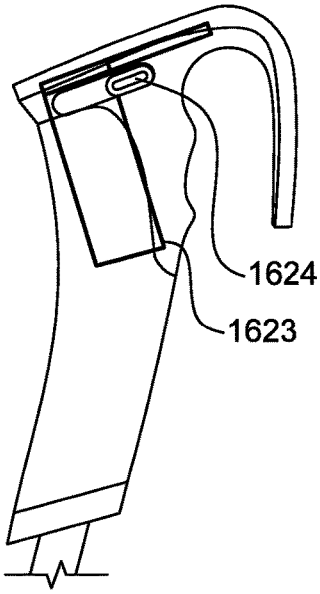
FIG. 14C is an additional perspective view illustrating an area within the modular handle portion where insertable electronic components may reside.

Referring to FIG. 14C, in conjunction with FIG. 9, an additional perspective view of a modular handle portion 1110 is shown, illustrating an area 1623 within the modular handle portion 1110 where the insertable electronic components 1620 may reside. It is understood that in other embodiments of the modular handle portion 1110, the area 1623 within the modular handle portion 1110, where the insertable electronic components 1620 may reside, may be larger or smaller. In addition, the modular handle portion 1110 is shown in FIG. 14C may include a port 1624 for charging an internal researchable battery or syncing the insertable electronic components 1620 with user devices, such as a mobile device or other wearable electronics.

Referring to FIGS. 15A and 15B, in conjunction with FIG. 10G, an embodiment of a modular handle portion 1210 with palm member 1710 and cushion member 1725 is shown to illustrate further the functionality of a threaded attachment member 1730, which may include threads 1735 that may be screwed into and attached to the lower portion of the modular handle portion 1210. The threaded attachment member 1730 may enable the resistance bands 1750 to directly and detachably couple to the modular handle portion 1210. As shown in FIG. 15A, the resistance band 1750 may extend through the opening 1745 of the threaded attachment member 1730. In the embodiment of the modular handle portion 1210 as shown in FIG. 15A, when the resistance band 1750 is detachably coupled to the modular handle portion 1210, the threaded attachment member 1730 with threads 1735 and the resistance band 1750 including the tip 1742 of the resistance band extend into and within the modular handle portion 1210, itself. In the embodiment of FIG. 15A, because the threaded attachment member 1730 with threads 1735 (that detachably couples the modular handle portion 1210 to the resistance band 1750) is disposed within and inside of the modular handle portion 1210, the threaded attachment member 1730 and point of attachment between the resistance band 1750 and modular handle portion 1210 may be isolated and protected from the accumulation of debris and dirt that may accumulate on the exterior, outside surface of the modular handle portion 1210 during a user's exercise with the variable resistance walking device 2000.

As further detailed in FIG. 15B, a compression ring or flanged member 1740 may reside around a portion of the resistance band 1750 to hold the resistance band 1750 at a specified location relative to the threaded attachment member 1730 so that when the threads 1735 may be screwed into and attached to the lower portion of the modular handle portion 1210, the resistance band 1750 with compression ring or flanged member 1740 may not exit through the opening 1745 of the threaded attachment member 1730 when a user applies force to the resistance band 1750. The threaded attachment member 1730 may also feature threads 1735 that secure the threaded attachment member 1730 within the modular handle portion 1210. As shown in FIG. 15B, as the resistance band 1750 extends linearly toward tip 1742 of the resistance band, the threaded attachment member 1730 may precede the flanged member 1740, such that the flanged member 1740 resides closer and more proximal to the tip 1742 of the resistance band 1750 than the threaded attachment member 1730. The tip 1742 may be inserted through the opening 1745 of the threaded attachment member 1730 to screw and attach the threaded attachment member 1730 into the modular handle portion 1210. Once the resistance band 1750 is screwed into and attached to the modular handle portion 1210, the flanged member 1740 attached to the resistance band 1750 secures the resistance band 1750 so that the resistance band 1750 cannot slide out through the opening 1745 of the threaded attachment member 1730. In particular, the circumference of the flanged member 1740 may be larger than the circumference of the opening 1745 of the threaded attachment member 1730, thereby preventing the resistance band 1750 from sliding out through the opening 1745 of the threaded attachment member 1730.

Referring again to FIGS. 15A and 15B, with the threaded attachment member 1730, a user may select a resistance band 1750 with a desired resistance level for attachment to the modular handle portion 1210. The threaded attachment member 1730 may accommodate the attachment of bands of varying widths and thicknesses that provide a desired resistance level. For example, as shown in FIGS. 15A and 15B, the resistance band 1750 features a relatively thin width and thickness when compared to the diameter of the upper section 1540 of the resistance band 1550, as shown in FIGS. 13A through 13C. Accordingly, the threaded attachment member 1730 and flanged member 1740 may enable a user to conveniently and interchangeably implement particular bands 1250 of predetermined resistance into the variable resistance walking device 2000.

Figure 16:
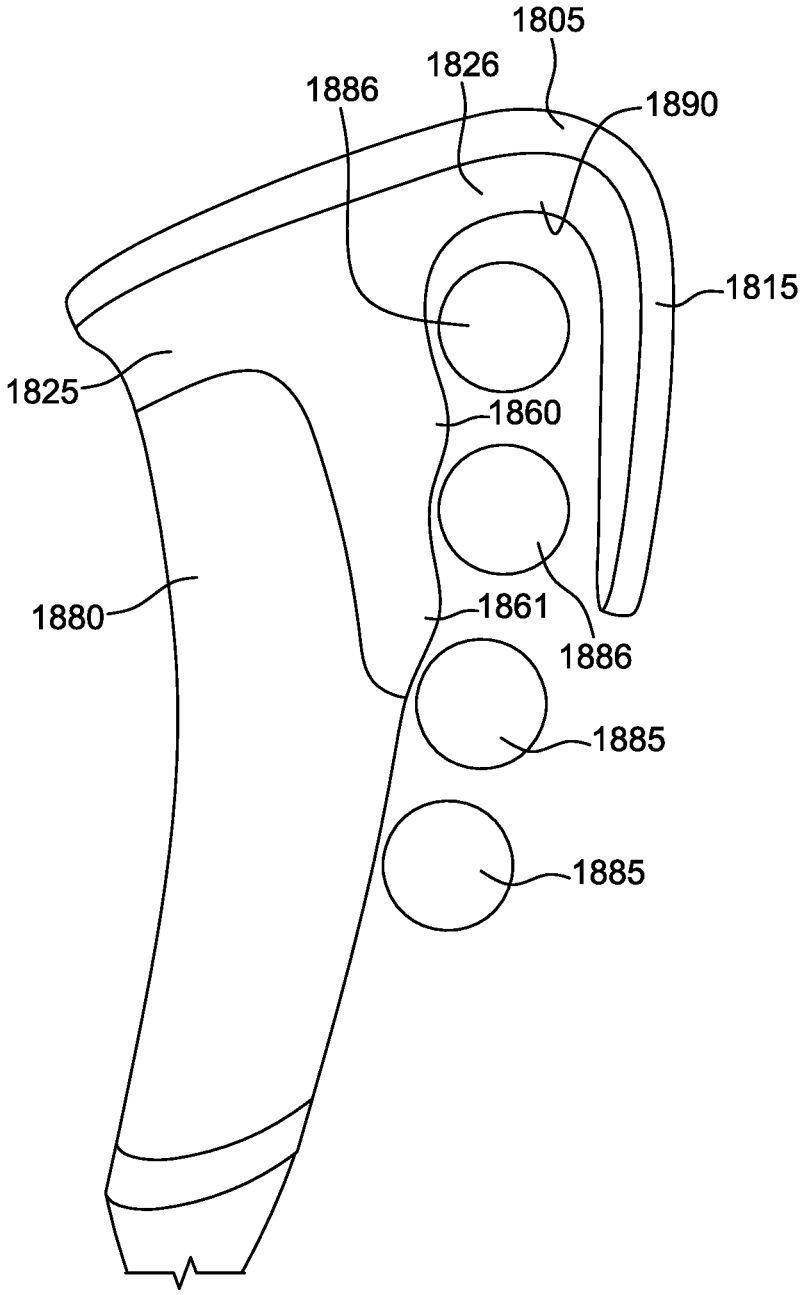
FIG. 16 is a perspective view of an embodiment of an ergonomic handle with additional detail showing how a user's hand may be ergonomically accommodated within the handle.

Referring to FIG. 16 in conjunction with FIG. 9, an exemplary illustration of a modular handle portion 1110 is provided to further detail the geometric and ergonomic features that may provide for a comfortable exercise experience for a user. The features implemented within the modular handle portion 1110 may alleviate complications relative to physical stress upon a user's orthopedic system during exercise to allow for optimal motion and positioning of essential joints, muscles, tendons, bones, and ligaments. As shown in FIG. 16, the geometry of the raised portion 1805 at an upper region 1826 with cushion member 1825 and securing member 1815 of the modular handle portion 1110 may provide a nook or recessed gap support 1890 at an upper region 1826 occupied by a user's hand and top fingers 1886 that may enable a transfer of force by a user's upward hand and arm motion to the nook 1890, so that a user may ergonomically exert force upon a resistance band without relying solely upon the grip force exerted by the user's top and bottom fingers 1886, 1885. With the nook 1890, a user may not need to grasp the modular handle portion 1110 firmly during exercise. In addition, finger bumps 1860 and 1861 may secure the modular handle portion 1110 within the user's top and bottom fingers 1886 and 1885, which further alleviates stress on a user's hand when grasping the modular handle portion 1110.

As shown in FIG. 16, the modular handle portion 1110 may include a palm member 1880 configured to meet the palm of a user's hand. The palm member 1880 may extend linearly and upward toward a cushion member 1825, comprising a material that may be softer than a material of the palm member 1880. In addition, when a user grasps the palm member 1880, the raised portion 1805 with securing member 1815 may extend over and around an upper region 1826 occupied by a user's hand and top fingers 1886 to secure the modular handle portion 1110 within the user's grasp. As shown in FIG. 16, the cushion member 1825 may extend from the top portion of the palm member 1880, over and around an upper region 1826 occupied by a user's upper hand and top fingers 1886, and downward along the securing member 1815 adjacent to the top fingers 1886. As such, the user's full fingers 1886 may rest comfortably against the cushion member 1825 at the upper region 1826 and within the nook 1890. As such, a user may hold the modular handle portion 1110 with only the user's top fingers 1886 while periodically resting and relaxing the user's bottom fingers 1885. Accordingly, the configuration of the securing member 1815 adjacent to the palm member 1880 may provide a comfortable and ergonomic space within the nook 1890 for the user's hand to securely hold the modular handle portion 1110 without requiring the user to clench the palm member 1880 tightly within the user's hand.

Figure 17A:
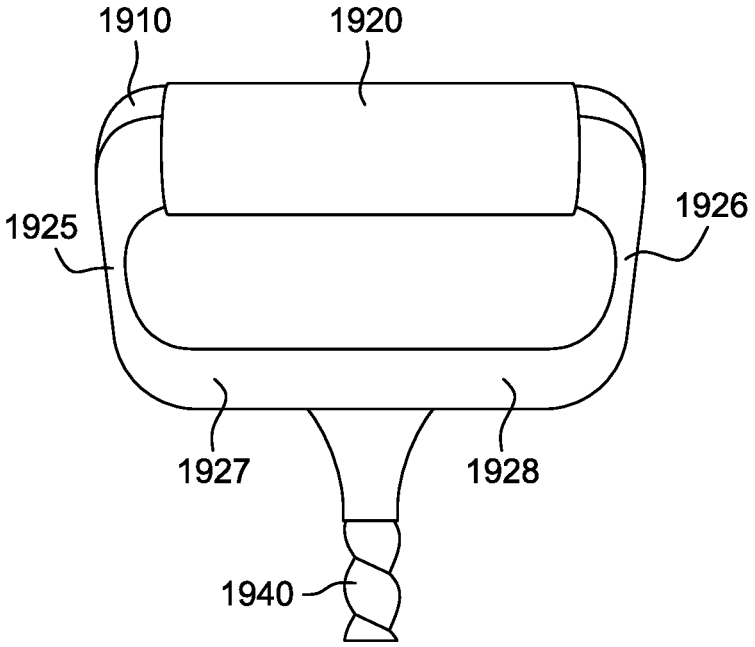
FIG. 17A is a perspective view of another embodiment of an ergonomic handle, including a display and network interface.
Figure 17B:
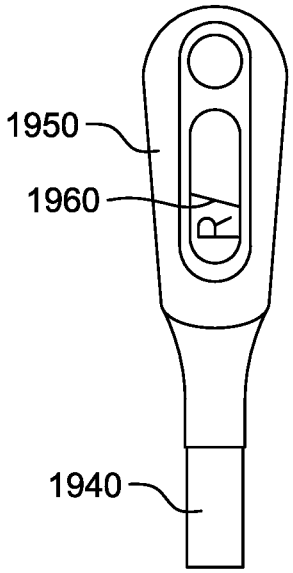
FIG. 17B is a perspective view of the first side of another embodiment of an ergonomic handle.
Figure 17C:
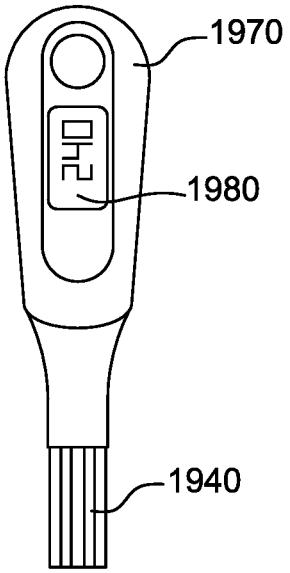
FIG. 17C is a perspective view of the second side of another embodiment of an ergonomic handle.

Referring to FIGS. 17A through 17C, in conjunction with FIGS. 11A-11B, an embodiment of a modular handle portion 1910, as implemented in the variable resistance walking device 100, 1000, 2000, is illustrated for further reference. The modular handle portion 1910 may include a cushioned grip 1920 disposed between respective sides 1925 and 1926 of the modular handle portion 1910. The cushioned grip 1920 may rotate 360 degrees about an axis of the handle portion 1910 to reduce stress on a user's wrist to alleviate carpal tunnel stress when exerting a pulling force against an elastomeric resistance band 1940.

Referring again to FIGS. 17A through 17C, the modular handle portion 1910 may include electronic components within the respective sides 1925 and 1926 of the modular handle portion 1910 and adjacent to cushioned grip 1920. For example, FIG. 17B shows a first side member 1950, including an internal rechargeable battery 1960 and FIG. 17C shows a second side member 1970 comprising an LED display 1980 that may indicate several steps taken by a user. The internal rechargeable battery 1960 and LED display 1980 may utilize Bluetooth® and wireless coupling with phone apps, graphical user interface (GUI) displays, sensors, processors, graphics processing units (GPU), memory, and rechargeable Bluetooth® batteries, for example.

Referring again to FIGS. 17A through 17C, the modular handle portion 1910 may also comprise electrical components within areas, including the cushioned grip 1920 and the handle at portions 1927 and 1928 adjacent to the cushioned grip 1920 and resistance band 1940. As such, the modular handle portion 1910 may house and contain sensors, including a force gauge to measure the amount of force exerted by a user when exerting a pulling force against a resistance of a resistance band 1940. Sensors may also include an accelerometer to measure repetitions based on the displacement of a resistance band 1940 via stretching movements. Sensors in the device, as disclosed herein, may also include a gyroscope to measure orientation in space and angular velocity.

Based upon the sensors described herein that may be implemented in the modular handle portion 1910 of the variable resistance walking device 100, 1000, 2000, it may be possible to measure and track various types of exercise data. For example, exercise data may include metrics based on the time and distance measured during exercise with the resistance walking device 100, 1000, 2000. In addition, performance measurement data may include a calculation of exercise performance based on the distance traveled when using the device 100, 1000, 2000 relative to a user's weight. Further, a biometric sensor tracking data may monitor a user's heart rate independently of the movement and operation of the resistance walking device 100, 1000, 2000.

Referring to FIGS. 17A through 17C, in conjunction with FIG. 11A-11B, various embodiments of the device 100, 1000, 2000 may include a modular handle portion 1910 that includes any combination of the sensors or just one of the sensors, as described herein, to determine the efficacy of a user's workout and thereby motivate a user to exercise. In an embodiment, an accelerometer may determine the number of steps a user takes, and the force exerted. In another embodiment, an accelerometer may be used to acquire metrics, including the number of steps taken and resistance data, to determine exercise metrics. In yet another embodiment, an accelerometer and a gyroscope may be used to calculate force without implementing a force sensor. Another embodiment may include an accelerometer, a gyroscope, and a force sensor to acquire exercise metrics. It is understood that each modular handle portion 1910 of the variable resistance walking device 100, 1000, 2000 may include any combination and number of sensors as described herein.

Electrical components within the modular handle portion 1910 of the device 100, 1000, 2000 may include a network interface in communication with at least one sensor and a website via a network. In addition, the network interface may include a processor and memory. It may be in communication with input and output devices with wireless network connections for sharing performance information that is tracked and measured by one or more sensors in the modular handle portion 1910.

Figure 18A:
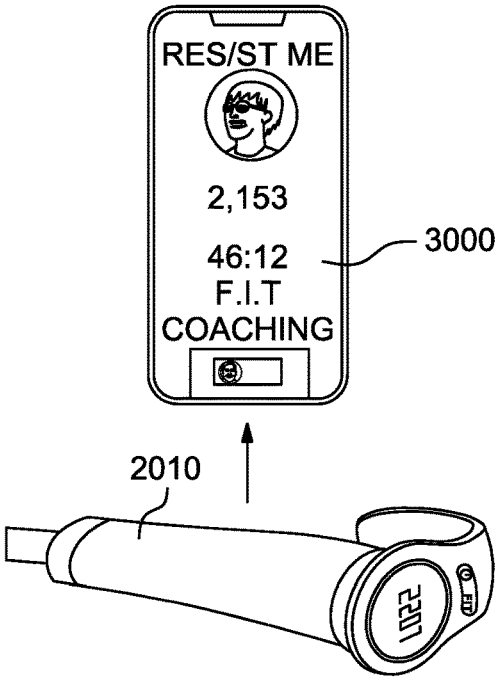
FIG. 18A is an exemplary view of an embodiment of an ergonomic handle with display and network interface coupled to a user mobile device application.
Figure 18B:
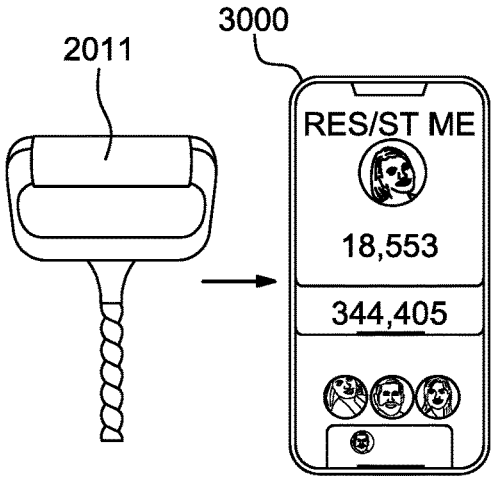
FIG. 18B is an exemplary view of another embodiment of an ergonomic handle with a display and network interface coupled to a user mobile device application.
Figure 18C:
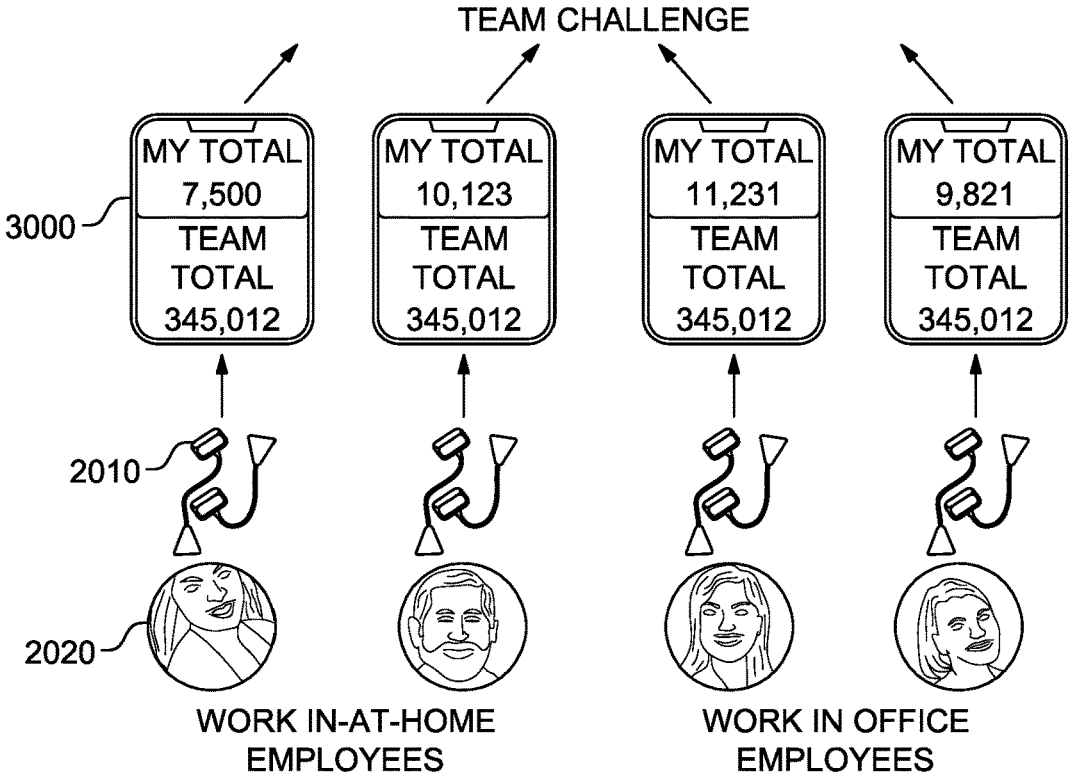
FIG. 18C is an exemplary illustration of social networking capabilities as provided by embodiments of the device with an ergonomic handle, including a network interface for virtual engagement with users in virtual challenges and virtual training.

Referring to FIGS. 18A through 18C, embodiments of the variable resistance walking device 100, 1000, 2000 as disclosed herein may be configured to measure exercise metrics of a user, such as an oxygen consumption that may be shared via a network interface on a dedicated website, so that a user experience may be motivated by shared user statistics and social capabilities including virtual heart walk challenges.

As shown in FIGS. 18A through 18C, based on the aforementioned electronic components that may be implemented within the modular handle portions 2010, 2011, the variable resistance walking device 100, 1000, 2000 may also include a network interface disposed within at least one handle, and the network interface may comprise a processor and a memory. The network interface may communicate with at least one sensor and with at least one website via a network. The device may also include a website and compatibility with user mobile device applications 3000 for displaying the exercise data and shared data of a user 2020, and the processor may store and send the exercise data to the website via the network and retrieve the shared data from the network and store the shared data in the memory.

Referring to FIGS. 18A through 18C, the device, as disclosed herein, may also provide social networking capabilities for virtual engagement with users via user 2020 mobile device applications 3000 in virtual challenges and virtual training. Networking capability may include sharing performance information and competing in personal and team challenges, such as virtual heart walk challenges within a community network for users 2020 of the device 100, 1000, 2000 in outdoor and indoor resistance walking.

Figure 19:
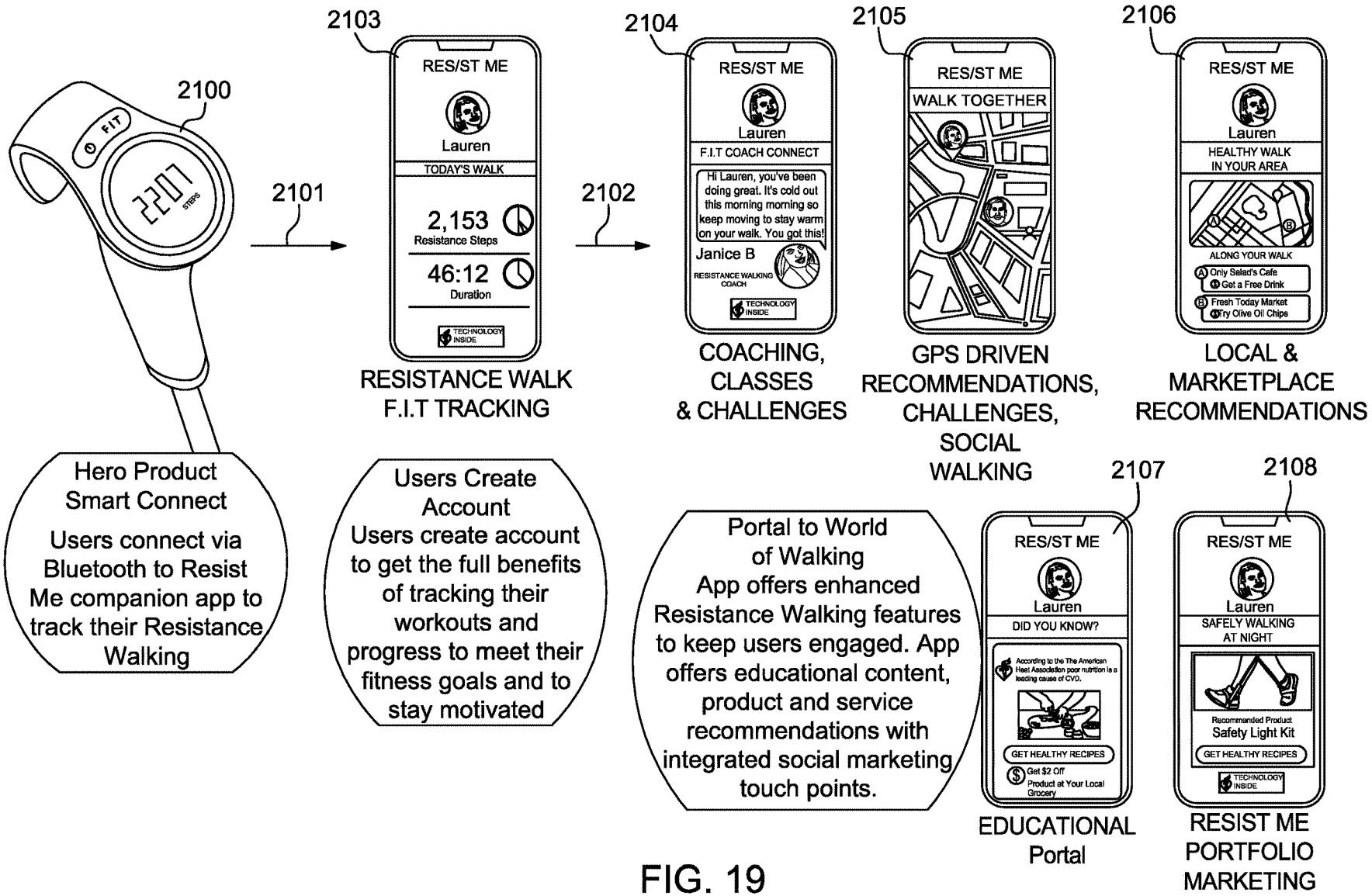
FIG. 19 is another exemplary illustration of social networking capabilities as provided by embodiments of the device with an ergonomic handle, including a network interface for integration of tracked user exercise data with user mobile device applications for virtual engagement and social marketing touch points.

Referring to FIG. 19, a modular handle portion 2100 (also shown in FIG. 9 and FIG. 10A) is illustrated in conjunction with a series of screen shots of a user mobile device application 2103, and social marketing touch points 2104, 2105, 2106, 2107, 2108 of the user mobile device application 2103 to detail the wireless communication and functionality of the modular handle portion 2100 in conjunction with the user mobile device application 2103. As shown in FIG. 19, based on exercise measurement and tracking capability of the modular handle portion 2100 as described herein, a user may connect 2101 wirelessly, such as via Bluetooth® to a dedicated user mobile application 2103 of the variable resistance walking device. With the dedicated user mobile application 2103, a user may create a user account to track fitness metrics for workouts and exercise data and biomarkers, so that the user may evaluate the fitness metrics and maintain motivation for progression toward the user's fitness goals.

Referring again to FIG. 19, based upon the dedicated user mobile application 2103 of the variable resistance walking device, a user may access 2102 social marketing touch points 2104, 2105, 2106, 2107, 2108 of the user mobile device application 2103. In an embodiment, the social marketing touch points 2104, 2105, 2106, 2107, 2108 may provide enhanced resistance walking features to engage a user, such as educational content, and product and service recommendations with the various social marketing touch points 2104, 2105, 2106, 2107, 2108. For example, the educational content and product and service recommendations may include coaching classes and challenges 2104, GPS driven recommendations, challenges and social walking 2105, local marketplace recommendations 2106, an educational portal 2107, and portfolio marketing 2108 for components of the variable resistance walking device, such as a rechargeable Bluetooth® battery-operated safety light 1282 (as described in FIG. 10F).

Figure 20:
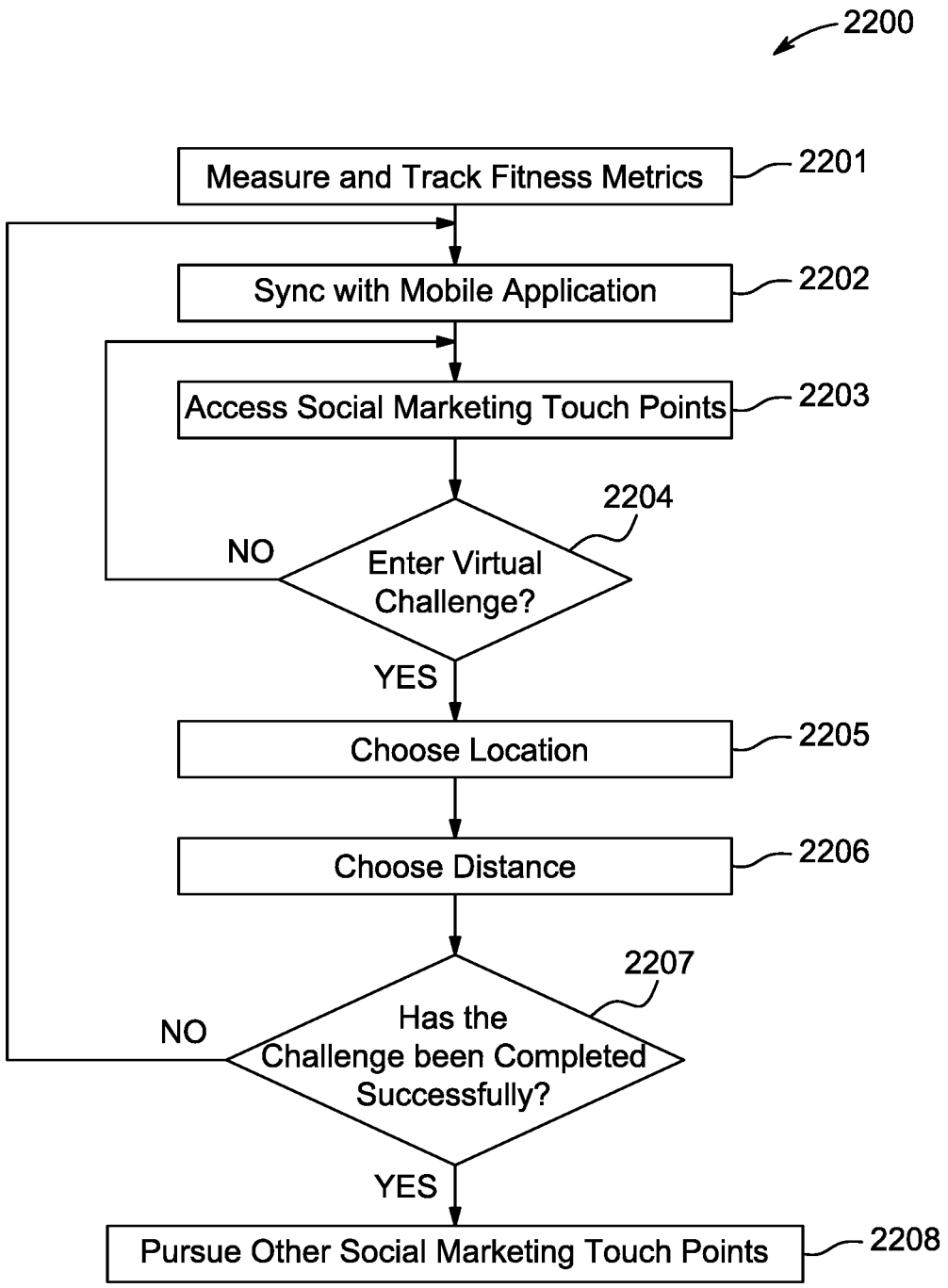
FIG. 20 is a flow diagram of an example process for virtual engagement with social marketing touch points which may be used in conjunction with the disclosed embodiments of the variable resistance walking device.

Referring to FIG. 20, a flow diagram illustrates the process 2200 of measuring and tracking fitness metrics 2201 including a user's exercise data and biomarkers as described herein by utilizing a modular handle portion 1110, 1210 of the variable resistance walking device 100, 1000, 2000. Once a user has tracked a user's own fitness metrics 2201 with a modular handle portion 1110, 1210, a user may wirelessly connect and sync 2202 the modular handle portion 1110, 1210 with a user mobile device application 2103, as illustrated in FIG. 19. Based on the user mobile device application 2103, the user may then access 2203 an array of enhanced resistance walking features to further engage the user. The enhanced walking features may comprise educational content, and product and service recommendations with the various social marketing touch points 2104, 2105, 2106, 2107, 2108 (as detailed in FIG. 19). With the enhanced walking features, a determination 2204 is then made of whether the user would like to enter a virtual challenge. The determination 2204 may be made based in part on whether the user feels prepared to enter a challenge in light of the user's own fitness metrics 2201 that have been tracked and measured with a modular handle portion 1110, 1210 of the variable resistance walking device. If the user determines 2204 that additional training with the variable resistance walking device 100, 1000, 2000 is necessary before entering a virtual challenge, then the user may pursue alternative educational content and product and service recommendations including coaching classes, GPS driven recommendations, social walking, and an educational portal as detailed in FIG. 19. If the user decides 2204 to enter a virtual challenge, the user may choose a location 2205 and distance 2206 for the challenge. Once the user participates in the challenge, a determination 2207 may then be made by the user whether the user successfully completed the virtual challenge. If a determination 2207 is made that the user did not successfully complete the virtual challenge, the user may return to tracked and measured 2201 individual training with the variable resistance walking device 100, 1000, 2000. The modular handle portion 1110, 1210 may then be wirelessly connected and synced 2202 with the user mobile device application 2103, as illustrated in FIG. 19. Alternatively, if a determination 2207 is made that the user successfully completed the virtual challenge, the user may pursue 2208 other educational content and product and service recommendations such as coaching classes and other challenges 2104, GPS driven recommendations, new challenges and social walking 2105, local marketplace recommendations 2106, an educational portal 2107, and portfolio marketing 2108 for components of the variable resistance walking device, such as a rechargeable Bluetooth® battery-operated safety light 1282 (as described in FIG. 10F).

Figure 21:
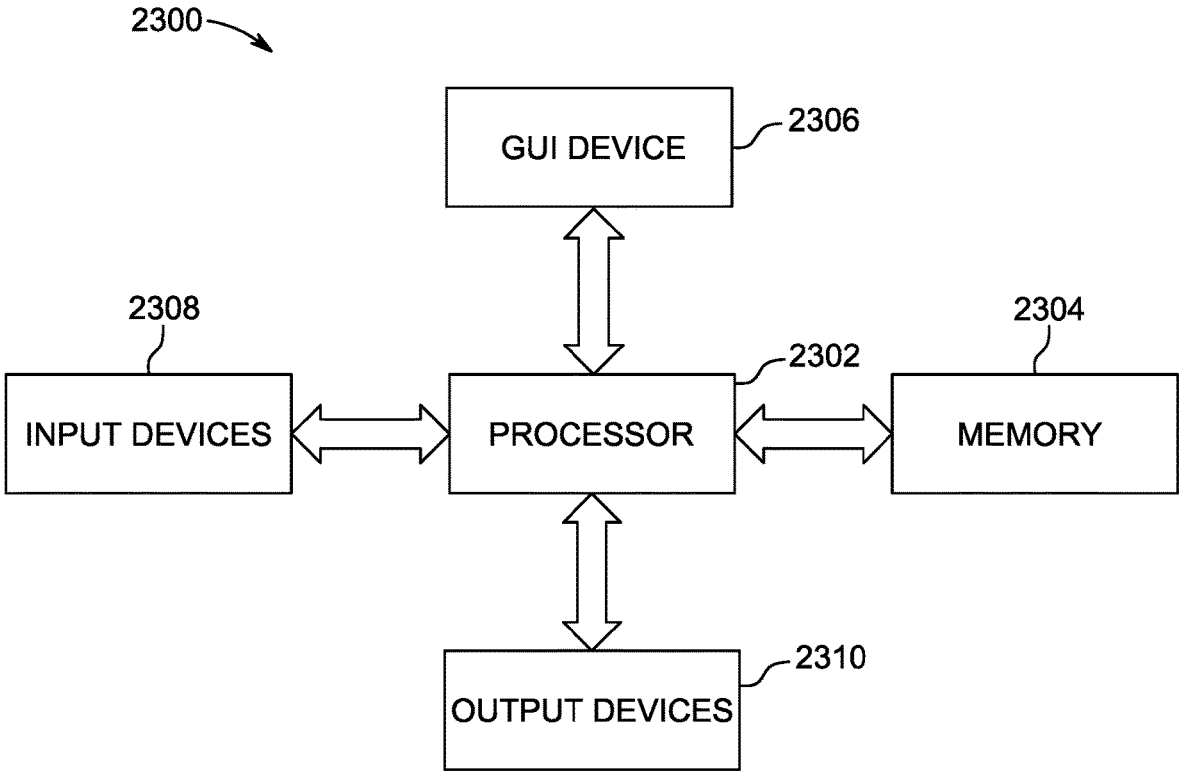
FIG. 21 is a block diagram of an example network interface used in conjunction with one or more disclosed embodiments.

FIG. 21 is a block diagram of an example network interface 2300 in which one or more disclosed embodiments can be implemented. The network interface 2300 can include, for example, a computer, a gaming device, a handheld device, a set-top box, a television, a mobile phone, or a tablet computer. In addition, the network interface 2300 includes a processor 2302, a memory 2304, a GUI device, one or more input devices 2308, and one or more output devices 2310. It is understood that the network interface 2300 of the variable resistance walking device 100, 1000, 2000 can include additional components not shown in FIG. 21.

The processor 2302 can include a central processing unit (CPU), a graphics processing unit (GPU), a CPU and GPU located on the same die, or one or more processor cores, wherein each core can be a CPU or a GPU. The memory 2304 can be located on the same die as the processor 2302 or separately from the processor 2302. In addition, the memory 2304 can include volatile or non-volatile memory, for example, random access memory (RAM), dynamic RAM, or a cache.

The input devices 2308 can include a keyboard, a keypad, a touch screen, a touchpad, a detector, a microphone, an accelerometer, a gyroscope, a biometric scanner, or a network connection (e.g., a wireless local area network card for transmission and reception of wireless IEEE 802 signals). The output devices 2310 can include a display, a speaker, a printer, a haptic feedback device, one or more lights, an antenna, or a network connection (e.g., a wireless local area network card for transmission and reception of wireless IEEE 802 signals).

Referring again to FIG. 21, in use, when a user is a resistance walking with a variable resistance walking device 100, 1000, 2000, the input devices 2308 may track and collect a user's exercise data that may be sent via the network interface 2300 to a user's virtual challenge member account that may be accessible via mobile user device applications 3000 (as shown in FIG. 18C). For example, while a user is a resistance walking, the input devices 2308 may periodically or constantly deliver a user's exercise data to a user's virtual challenge member account. In other embodiments, the input device 2308 may deliver a user's exercise data to a user's virtual challenge member account upon a user's command. A user's exercise data may also be delivered via the network interface 2300 to a dedicated website in communication with the network interface 2300.

Figure 22:
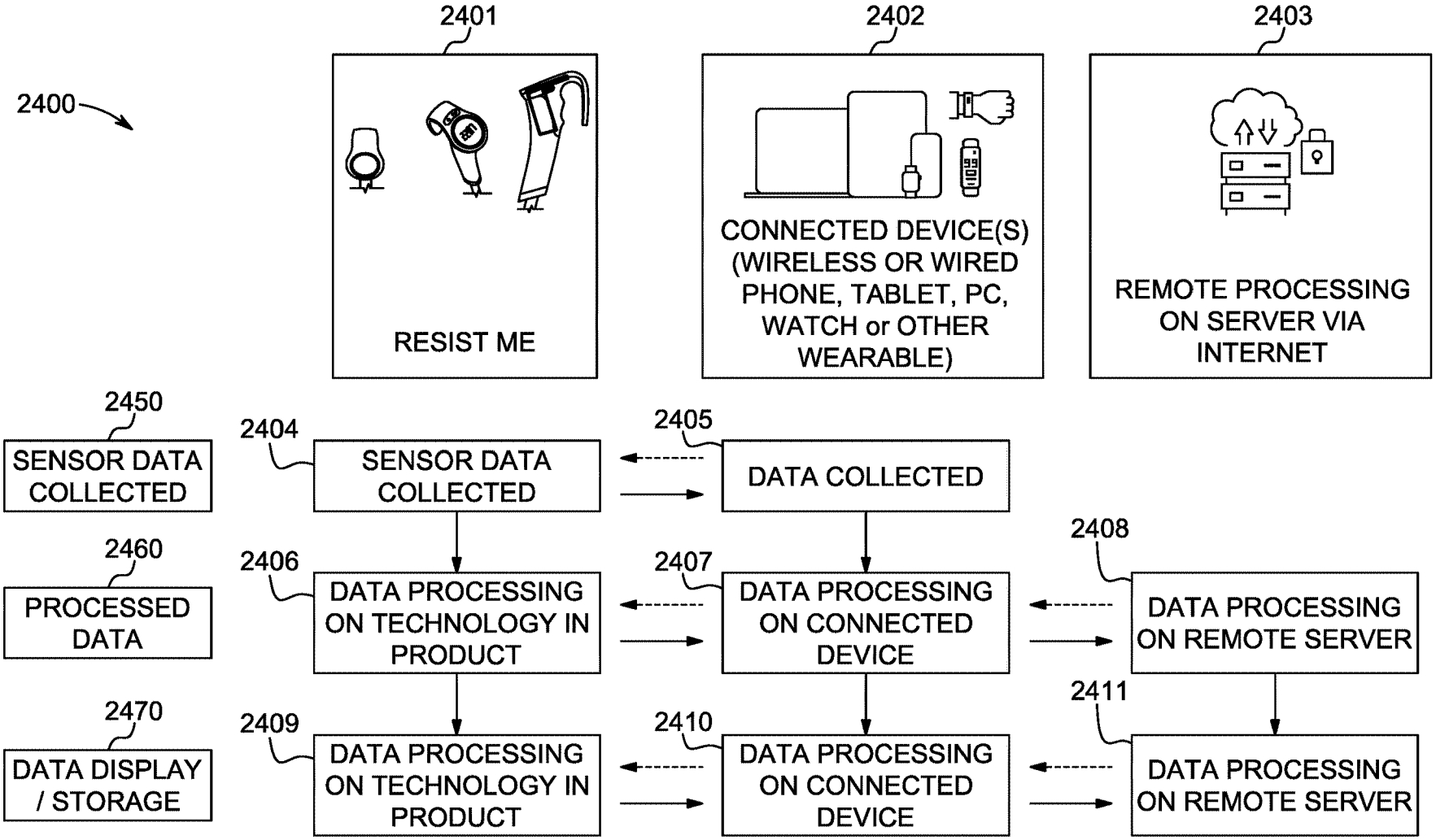
FIG. 22 is an additional block diagram of an example network interface showing operations for data collection, processing, storage and display used in conjunction with one or more disclosed embodiments.

Referring to FIG. 22, an additional block diagram of an example network interface 2400 illustrates operations for data collection 2450, processing 2460, storage and display 2470 used in conjunction with one or more disclosed embodiments. The operations for data collection 2450, processing 2460, and storage and display 2470 may be accomplished based upon the respective performances of the modular handle portion 2401 comprising insertable electronic components, the wirelessly connected or cable-connected devices 2402 such as a user mobile device, tablet, PC, exercise tracking watch, or other wearable device, and the remote processor 2403 for processing of collected data on a server via the internet.

Referring again to FIG. 22, the exemplary network interface 2400 may provide for efficient power consumption relative to the processing of exercise and biomarker data collected by the modular handle portion 2401 and the sending of information from the modular handle portion 2401 to the wirelessly connected or cable-connected devices 2402 and the remote processor 2403. In general, it is understood that a processing operation may consume less power than a sending operation. Accordingly, the exemplary network interface 2400 may provide for efficient power consumption by initially processing the collected exercise and biomarker data on a chip within the modular handle portion 2401 comprising insertable electronic components. By initially processing collected data within the modular handle portion 2401, a subsequent power requirement for the sending of the processes data may be reduced. In other embodiments, processing of collected exercise data may instead be performed on the wirelessly connected or cable-connected devices 2402 or in a cloud environment on the remote processor 2403.

Referring again to FIG. 22, a modular handle portion 2401 may perform collection of sensor data 2450. The collected sensor data 2404 may include heart EKG, repetitions of lifting and lowering arm cycles, time duration of overall exercise session, time duration of a cycle relative to raising and lowering of an arm or leg, resistance force exerted on an elastomeric resistance band, motion of the device, position data of the device relative to the user, position data via GPS of the device in the world, continuous blood sugar monitoring during workouts, temperature of ambient temperature, and temperature of user's skin. In addition, the collected sensor data 2404 may include tracking several steps taken, and cardiac metrics relative to oxygen consumption, heart rate, recovery time, resting heart rate, and average and peak heart rates of a user The modular handle portion 2401 may perform data processing 2460 of the collected sensor data 2404, and the processed data 2406 may subsequently be stored or displayed 2409 on the modular handle portion 2401 based upon a data display or storage operation 2470 of the modular handle portion 2401.

Referring again to FIG. 22, the wirelessly connected or cable-connected devices 2402 may also perform collection of sensor data 2450. The devices 2402 may perform data processing 2460 of the collected sensor data 2405, and the processed data 2407 may subsequently be stored or displayed 2410 on the wirelessly connected or cable-connected devices 2402 based upon a data display or storage operation 2470 of the devices 2402. It is understood that a collected sensor data 2404 of the modular handle portion 2401 may also be sent to the wirelessly connected or cable-connected devices 2402. It is further understood that a processed data 2406 of the modular handle portion 2401 may also be sent to the wirelessly connected or cable-connected devices 2402. A processed and stored data 2409 from the modular handle portion 2401 may also be sent to the wirelessly connected or cable-connected devices 2402.

Referring again to FIG. 22, a collected sensor data 2404 of the modular handle portion 2401 or a collected sensor data 2405 of the wirelessly connected or cable-connected devices 2402 may be sent to the remote processor 2403 in a cloud environment for performance of data processing 2460. The processed data 2408 of the remote processor 2403 may also be displayed or stored 2411 by the remote processor 2403 in a cloud environment based upon a data display or storage operation 2470 of the remote processor 2403. A display 2411 of the processed data 2408 may include a website that enables a user to visualize the processed data 2408.

Accordingly, as shown in FIG. 22, a collected sensor data 2404, 2405 may be processed on either the modular handle portion 2401, the wirelessly connected or cable-connected devices 2402, or on the remote processor 2403 in a cloud environment. As such, a collected sensor data 2404, 2405 may be processed on any of the devices 2401, 2402, or 2403 of the network interface 2400. In addition, a processed sensor data 2406, 2407, 2408 may be stored or displayed on any of the devices 2401, 2402, or 2403 of the network interface 2400. The stored or displayed data 2409, 2410, 2411 may be accessibly to any of the devices 2401, 2402, or 2403 of the network interface 2400. As such, the network interface 2400 may provide capability and optionality for power consumption relative to selecting where a collected sensor data 2404, 2405 may be processed. In addition, the network interface 2400 may provide capability and optionality for power consumption relative to selecting the devices 2401, 2402, or 2403 that may send the collected data and the processed data. Once the network interface 2400 has a collected sensor data 2404, 2405, the collected sensor data 2404, 2405 may be processed, stored or displayed on any of the devices 2401, 2402, or 2403 as selected by a user relative a user's interest in power consumption and/or accessibility.

Although features and elements are described above in particular combinations, each feature or element can be used alone without the other features and elements or in various combinations with or without other features and elements.

While exemplary embodiments are described above, these embodiments are not intended to describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the disclosure that may not be explicitly described or illustrated. While various embodiments could have been described as providing advantages or being preferred over other embodiments or prior art implementations concerning one or more desired characteristics, those of ordinary skill in the art recognize that one or more features or characteristics can be compromised to achieve desired overall system attributes, which depend on the specific application and implementation. These attributes can include but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations concerning one or more characteristics, these embodiments are not outside the scope of the disclosure and can be desirable for particular applications.

What is claimed is:

1. An apparatus for resistance walking comprising:

a pair of elastomeric bands, each band further comprising:

a foot anchor at a first end; and a handle at a second end, each handle housing a plurality of insertable electronic components comprising at least one sensor, the at least one sensor configured to track exercise data;

a network interface disposed within at least one handle, the network interface comprising a processor and a memory, the network interface in communication with said at least one sensor and with at least one website via a network; and a website for displaying an exercise data and shared data, wherein the processor stores and sends the exercise data to the website via the network and retrieves the shared data from the network, and stores the shared data in the memory, each band further comprising:

an adjustable sheath including a first attachment point and a second attachment point, the first attachment point detachably coupled to the first end of each band, the second attachment point detachably coupled to the foot anchor, and the second end detachably coupled to the handle wherein an adjustable sheath length may be adjusted independently of an adjustable band length, and the adjustable band length may be adjustable independently of the adjustable sheath length, wherein the adjustable sheath is configured for an adjustment of the adjustable sheath length relative to a predetermined height of a user, and wherein the apparatus is configured for an adjustment of a selectable resistance of each band based upon a selected resistance of the user and the adjustable band length.

2. The apparatus for resistance walking of claim 1, each band further comprising:

a first detachable securing member disposed between the anchor and the first end of each band and configured to provide a detachable coupling between the anchor and the first end of each band, and a second detachable securing member disposed between the handle and the second end of each band and configured to provide a detachable coupling between the handle and the second end of each band.

3. The apparatus for resistance walking of claim 2, wherein the pair of elastomeric bands are further configured to provide a selectable resistance, wherein a user selects the pair of elastomeric bands from a plurality of elastomeric bands each having a predetermined resistance from a range of predetermined resistances, and the user interchanges the pair of elastomeric bands in the apparatus for resistance walking from among the plurality of elastomeric bands based upon the detachable coupling between the foot anchor and the first end of each band and the detachable coupling between the handle and the second end of each band.

4. The apparatus for resistance walking of claim 3, wherein the insertable electronic components within each handle further comprise a gyroscope sensor and an accelerometer sensor, the network interface in communication with said gyroscope sensor and said accelerometer sensor.

5. The apparatus for resistance walking of claim 4, wherein the apparatus is further configured to calculate the exercise data of the user, including an oxygen consumption of the user based on measurements taken by the gyroscope sensor and the accelerometer sensor.

6. The apparatus for resistance walking of claim 5, wherein each handle includes a palm member extending linearly to a top section comprising:

a removable capsule bezel configured to secure the insertable electronic components within the palm member of each handle; and a recess disposed at an upper region, including a cushion member and a securing member, the recess is configured to transfer a force of an upward motion of an arm of the user to the top section to stretch the band during resistance walking.

7. A device for resistance walking comprising:

a pair of elastomeric bands, each band having:

a first end extending toward a foot anchor; and a second end detachably coupled to a handle portion, a sensor disposed within each handle and configured to track an exercise data;

a network interface disposed within at least one handle, the network interface comprising a processor and a memory, the network interface in communication with said sensors and with at least one website via a network; and a website for displaying an exercise data and shared data, wherein the processor stores and sends the exercise data to the website via the network and retrieves the shared data from the network, and stores the shared data in the memory, each band further comprising:

an adjustable sheath including a first attachment point and a second attachment point, the first attachment point detachably coupled to the first end of each band, the second attachment point detachably coupled to the foot anchor, and the second end detachably coupled to the handle wherein an adjustable sheath length may be adjusted independently of an adjustable band length, and the adjustable band length may be adjustable independently of the adjustable sheath length, wherein the adjustable sheath is configured for an adjustment of the adjustable sheath length relative to a predetermined height of a user, and wherein the apparatus is configured for an adjustment of a selectable resistance of each band based upon a selected resistance of the user and the adjustable band length.

8. The device for resistance walking of claim 7, each band further comprising:

a first detachable securing member disposed between the foot anchor and the first end of each band and configured to provide a detachable coupling between the foot anchor and the first end of each band, and a second detachable securing member disposed between the handle portion and the second end of each band and configured to provide a detachable coupling between the handle portion and the second end of each band.

9. The device for resistance walking of claim 8, wherein the pair of elastomeric bands are further configured to provide a selectable resistance, wherein a user selects the pair of elastomeric bands from a plurality of elastomeric bands each having a predetermined resistance from a range of predetermined resistances, and the user interchanges the pair of elastomeric bands in the apparatus for resistance walking from among the plurality of elastomeric bands based upon the detachable coupling between the anchor and the first end of each band and the detachable coupling between the handle and the second end of each band.

10. The device for resistance walking of claim 9, wherein each handle portion further comprises a gyroscope sensor and an accelerometer sensor, the network interface in communication with said gyroscope sensor and said accelerometer sensor.

11. The device for resistance walking of claim 10, wherein the device is further configured to calculate the exercise data of the user, including an oxygen consumption of the user based on measurements taken by the gyroscope sensor and the accelerometer sensor.

12. The device for resistance walking of claim 11, wherein each handle includes a palm member extending linearly to a top section comprising:

a removable capsule bezel configured to secure a plurality of insertable electronic components within each handle, the plurality of insertable electronic components comprising the sensor and the network interface; and a recess disposed at an upper region, including a cushion member and a securing member, the recess configured to transfer a force of an upward motion of an arm of the user to the top section to stretch the band during resistance walking.

13. A device for measuring an oxygen consumption by a user during resistance walking comprising:

a pair of elastomeric resistance elements, each resistance element having:

an anchor at a first end, the anchor configured to detachably couple to a foot accessory of the user; and a handle portion at a second end, the resistance element extending linearly in an axis of the handle portion;

at least one sensor is disposed of within each handle and configured to track an exercise data including an oxygen consumption of the user based upon measurements are taken by the at least one sensor;

a network interface disposed within at least one handle, the network interface comprising a processor and a memory, the network interface in communication with said at least one sensor and with at least one website via a network; and a website for displaying an exercise data and shared data, wherein the processor stores and sends the exercise data to the website via the network and retrieves the shared data from the network, and stores the shared data in the memory, each resistance element further comprising:

an adjustable sheath including a first attachment point and a second attachment point, the first attachment point configured to couple to a first detachable end of each resistance element, and the second attachment point configured to detachably couple to the anchor, wherein an adjustable sheath length may be adjusted independently of an adjustable resistance element length, and the adjustable resistance element length may be adjustable independently of the adjustable sheath length, wherein the adjustable sheath is configured for an adjustment of the adjustable sheath length relative to a predetermined height of the user, and wherein the device is configured for an adjustment of a selectable resistance of each resistance element based upon a selected resistance of the user and the adjustable resistance element length.

14. The device of claim 13, each band further comprising:

a first detachable securing member disposed between the anchor and the first end of each band and configured to provide a detachable coupling between the anchor and the first end of each band, and a second detachable securing member disposed between the handle and the second end of each band and configured to provide a detachable coupling between the handle and the second end of each band.

15. The device of claim 14, wherein the pair of elastomeric bands are further configured to provide a selectable resistance, wherein the user selects the pair of elastomeric bands from a plurality of elastomeric bands each having a predetermined resistance from a range of predetermined resistances, and the user interchanges the pair of elastomeric bands in the apparatus for resistance walking from among the plurality of elastomeric bands based upon the detachable coupling between the anchor and the first end of each band and the detachable coupling between the handle and the second end of each band.

16. The device of claim 15, wherein each handle portion further comprises a gyroscope sensor and an accelerometer sensor, the network interface in communication with said gyroscope sensor and said accelerometer sensor.

17. The device of claim 16, wherein each handle portion includes a palm member disposed between a top side and a bottom side of the handle portion, the top side unattached to the second end of the resistance element and the bottom side coupled to the second end of the resistance element.

18. The device of claim 17, wherein the top side of the handle portion comprises:

a removable capsule bezel configured to secure a plurality of insertable electronic components within the handle portion, the plurality of insertable electronic components comprising the at least one sensor and the network interface; and a recess disposed at an upper region of the handle portion, including a cushion member and a securing member, the recess configured to transfer a force of an upward motion of an arm of the user to the top side of the handle portion to stretch the resistance element during resistance walking.

* * * * *